US009210999B2

(12) United States Patent
Martin et al.

(10) Patent No.: US 9,210,999 B2
(45) Date of Patent: Dec. 15, 2015

(54) FRAME TYPE TABLE ASSEMBLIES

(75) Inventors: Kirt Martin, Alto, MI (US); David C Eberlein, Hudsonville, MI (US)

(73) Assignee: STEELCASE INC., Grand Rapids, MI (US)

( * ) Notice: Subject to any disclaimer, the term of this patent is extended or adjusted under 35 U.S.C. 154(b) by 918 days.

(21) Appl. No.: 13/092,504

(22) Filed: Apr. 22, 2011

(65) Prior Publication Data

US 2011/0297052 A1 Dec. 8, 2011

Related U.S. Application Data

(60) Provisional application No. 61/350,726, filed on Jun. 2, 2010.

(51) Int. Cl.

| | |
|---|---|
| ***A47B 17/00*** | (2006.01) |
| ***A47B 21/06*** | (2006.01) |
| ***A47B 13/00*** | (2006.01) |
| ***A47B 13/02*** | (2006.01) |
| ***A47B 13/08*** | (2006.01) |
| ***A47B 83/04*** | (2006.01) |

(52) U.S. Cl.

CPC ..... *A47B 21/06* (2013.01); *A47B 13/003* (2013.01); *A47B 13/021* (2013.01); *A47B 13/08* (2013.01); *A47B 13/081* (2013.01); *A47B 83/04* (2013.01); *A47B 2200/0016* (2013.01)

(58) Field of Classification Search

USPC ..... 108/11, 12, 59–65, 50.02; 312/194–203, 223.6

See application file for complete search history.

(56) References Cited

U.S. PATENT DOCUMENTS

| | | | |
|---|---|---|---|
| 8,934 | A | 5/1852 | Betts |
| 99,246 | A | 1/1870 | Shannon |
| 114,515 | A | 5/1871 | Beek |
| 285,995 | A | 10/1883 | Gesking |
| 327,413 | A | 9/1885 | Rohrbach |
| 418,084 | A | 12/1889 | Swinnerton |
| 443,108 | A | 12/1890 | Owen |
| 451,599 | A | 5/1891 | Meigs |

(Continued)

FOREIGN PATENT DOCUMENTS

| | | | |
|---|---|---|---|
| CN | 1170554 | A | 1/1998 |
| CN | 2919992 | Y | 7/2007 |

(Continued)

OTHER PUBLICATIONS

PCT International Search Report and Written Opinion, PCT/US2011/038904, Nov. 23, 2011.

(Continued)

*Primary Examiner* — Matthew Ing
*Assistant Examiner* — Timothy M Ayres
(74) *Attorney, Agent, or Firm* — Quarles & Brady LLP

(57) ABSTRACT

A table assembly comprising at least a first leg member that forms a leg opening and a first support surface and a rigid elongated channel member that forms a channel that extends between first and second ends, at least the first end forming a wire passing opening suitable to pass wires into and out of the channel, the first end supportable by the first support surface in at least first and second different locations, wherein, when the channel is supported by the support surface at either of the first and second different positions, the wire passing opening is aligned with the leg opening so that wires can pass through the leg opening and into the channel.

64 Claims, 69 Drawing Sheets

(56) References Cited

U.S. PATENT DOCUMENTS 452,971 A 5/1891 Kidder
501,935 A 7/1893 Harsha
543,053 A 7/1895 Ripking
571,652 A 11/1896 Dodd
604,215 A 5/1898 Quarry
636,548 A 11/1899 Owen
654,922 A 7/1900 Schipkowsky
658,983 A 10/1900 Francis
659,987 A 10/1900 Ray
688,104 A 12/1901 Lohrman
710,376 A 9/1902 Smith
794,809 A 7/1905 Marsh
795,957 A 8/1905 Cartland
859,987 A 7/1907 Smith
907,507 A 12/1908 Kerr
978,299 A 12/1910 Jacobs
983,903 A 2/1911 Horton
1,014,848 A 1/1912 Reinert
1,050,409 A 1/1913 Wadsworth et al.
1,201,305 A 10/1916 Jones
1,277,550 A 9/1918 Connell
1,340,562 A 5/1920 Sandmann
1,386,469 A 8/1921 Gomoll
1,395,166 A 10/1921 Tomlinson
1,398,611 A 11/1921 Van Alstyn
1,411,260 A 4/1922 Baker et al.
1,421,929 A 7/1922 Floreskul
1,448,642 A 3/1923 Tomlinson
1,454,467 A 5/1923 Crooks
1,514,512 A 11/1924 Fisher
1,527,094 A 2/1925 Tomlinson
1,542,693 A 6/1925 Gordon
1,547,301 A 7/1925 Cordes
1,638,612 A 8/1927 Baus
1,643,101 A 9/1927 Thompson
1,656,868 A 1/1928 Davis et al.
1,706,388 A 3/1929 Ashkenas
1,766,077 A 6/1930 Jensen
1,770,156 A 7/1930 Hoyer, Jr. et al.
1,780,118 A 10/1930 D'Humy
1,785,463 A 12/1930 Strongson
1,786,823 A 12/1930 Carrington et al.
1,792,406 A 2/1931 Tomlinson
1,800,685 A 4/1931 Griffis
1,810,618 A 6/1931 Nelson
1,845,142 A 2/1932 Friesner
1,852,749 A 4/1932 Hiner
1,854,248 A 4/1932 Cairney
1,965,785 A 7/1934 Vallone
1,992,574 A 2/1935 Jenkins
D95,588 S 5/1935 Holsman
2,002,128 A 5/1935 Reidenbaugh
2,005,593 A 6/1935 Onions et al.
2,017,844 A 10/1935 Ferney
2,018,250 A 10/1935 Cohan
2,031,848 A 2/1936 Ogden
2,056,356 A 10/1936 Logan
2,089,059 A 8/1937 Harley
2,110,466 A * 3/1938 Louis ..... 108/12
2,115,239 A 4/1938 Strain
2,119,319 A 5/1938 D'Esopo
2,156,633 A 5/1939 La Ducer
2,179,395 A 11/1939 Yerrick
2,182,703 A 12/1939 Rainwater
2,191,701 A 2/1940 Wood
2,240,484 A 5/1941 Anderson
2,299,443 A 10/1942 Walmsley
2,345,913 A 4/1944 Bishop
2,359,109 A 9/1944 Hormes
2,362,567 A 11/1944 La Rue
2,380,379 A 7/1945 Attwood
D150,242 S 7/1948 McDonald
2,497,278 A 2/1950 Soderlund
2,506,844 A 5/1950 Smith
2,511,949 A 6/1950 Simon
2,522,149 A 9/1950 Tunstall
2,530,474 A 11/1950 Lutes
2,557,766 A 6/1951 Ronfeldt
2,570,000 A 10/1951 Lowry
2,620,024 A 12/1952 Rietman
2,640,644 A 6/1953 Hennessey et al.
2,664,331 A 12/1953 Glotfelter
2,675,863 A 4/1954 Lee
2,683,639 A 7/1954 Brenny
2,735,519 A 2/1956 Frischmann
D177,215 S 3/1956 Collins
2,793,926 A 5/1957 Deaton
2,821,450 A 1/1958 Knoll
2,825,614 A 3/1958 Card
2,834,478 A 5/1958 Macdonald
2,840,243 A 6/1958 Brinker
2,845,187 A 7/1958 Bianchi
2,900,085 A 8/1959 Levy
2,903,316 A 9/1959 Schmidt
2,905,114 A 9/1959 Olson
2,921,607 A 1/1960 Caveney
2,930,665 A 3/1960 Budai
2,937,765 A 5/1960 Shank
2,942,924 A 6/1960 Stangert
2,944,861 A 7/1960 Lessin
2,963,031 A 12/1960 Carroll
2,965,161 A 12/1960 Knoll
2,975,908 A 3/1961 Huet
2,976,097 A 3/1961 Devine
2,981,583 A 4/1961 Eisenberg
2,988,412 A 6/1961 Vannice
2,993,603 A 7/1961 Fohn
3,001,755 A 9/1961 Doyle
3,017,153 A 1/1962 Johnson
3,027,212 A 3/1962 Pearson
3,031,244 A 4/1962 Stopek
3,036,864 A 5/1962 Arai
3,041,109 A 6/1962 Eames
3,045,961 A 7/1962 Cygan
3,059,825 A 10/1962 Thomas
3,083,007 A 3/1963 Campfield
3,098,239 A 7/1963 Nader
3,117,534 A 1/1964 Martland
3,127,216 A 3/1964 Clouse
3,167,352 A 1/1965 Johnson
3,170,742 A 2/1965 Berkowitz
3,172,711 A 3/1965 Gillotte
3,180,459 A 4/1965 Liskey, Jr.
3,181,923 A 5/1965 Guillon
3,197,822 A 8/1965 Herrschaft
3,200,962 A 8/1965 Davelaar
3,213,580 A 10/1965 Mark
3,217,673 A 11/1965 Knoblock
3,233,942 A * 2/1966 Creutz ..... 297/463.2
3,235,218 A 2/1966 Graham
3,238,004 A 3/1966 Goebel
3,241,885 A 3/1966 Deaton
3,249,351 A 5/1966 Smith
3,252,469 A 5/1966 Peake
3,255,467 A 6/1966 Kowalski
3,289,676 A 12/1966 Saunders
3,295,764 A 1/1967 Geary
3,298,743 A 1/1967 Albinson
3,301,597 A 1/1967 Bereday
3,326,147 A 6/1967 Toney
3,339,502 A 9/1967 Fyffe
3,364,882 A 1/1968 Merrick
3,367,290 A 2/1968 Barecki
3,370,389 A 2/1968 Macaluso
3,388,711 A 6/1968 Huddle
3,404,930 A 10/1968 Cafiero
3,406,645 A 10/1968 Monroe
3,413,053 A 11/1968 Featherston
3,428,108 A 2/1969 Singer
3,437,737 A 4/1969 Wagner
3,438,687 A 4/1969 Wikey
3,441,146 A 4/1969 Summers
3,456,833 A 7/1969 Cornelius
3,464,372 A 9/1969 Fiterman et al.

(56) References Cited

U.S. PATENT DOCUMENTS 3,475,769 A 11/1969 Fasanella
3,489,290 A 1/1970 Larson
3,497,081 A 2/1970 Field
3,497,279 A 2/1970 Chovanec
3,498,239 A 3/1970 Bartlett et al.
3,511,193 A 5/1970 Schild
3,514,170 A 5/1970 Shewchuk
3,517,822 A 6/1970 Wagner
3,517,963 A 6/1970 Woods et al.
3,521,579 A 7/1970 Stafford
3,529,880 A 9/1970 Christen
3,552,579 A 1/1971 Simon et al.
3,556,586 A 1/1971 Beardmore
3,563,624 A 2/1971 Stice
3,566,566 A 3/1971 Janic
3,570,682 A 3/1971 Elliott
3,570,798 A 3/1971 Squibb
3,572,874 A 3/1971 Hassel
3,574,434 A 4/1971 Propst
3,575,465 A 4/1971 Dolby et al.
3,591,233 A 7/1971 Turcksin
3,596,297 A 8/1971 James
3,601,825 A 8/1971 Moorhead et al.
3,605,650 A 9/1971 Hebel et al.
3,608,959 A 9/1971 Sarvas
3,612,289 A 10/1971 Zink
3,619,004 A 11/1971 McKernan et al.
3,620,376 A 11/1971 Gingher
3,626,647 A 12/1971 Guzelimian
3,635,174 A 1/1972 Ball et al.
3,640,445 A 2/1972 Durham
3,643,608 A 2/1972 DeCesaris
3,655,065 A 4/1972 Yellin
3,655,253 A 4/1972 Deeds et al.
3,663,059 A 5/1972 Omlie
3,667,803 A 6/1972 Ford
3,674,068 A 7/1972 Lucci
3,680,942 A 8/1972 Davis
3,682,523 A 8/1972 Esposito
3,687,092 A 8/1972 Manning
3,688,707 A 9/1972 White
3,693,923 A 9/1972 Ayoub et al.
3,700,282 A 10/1972 Rowland
3,712,698 A 1/1973 Propst et al.
3,713,257 A 1/1973 Beavers
3,724,792 A 4/1973 Thalenfeld
3,730,601 A 5/1973 Misenheimer, III
3,736,602 A 6/1973 Miller
3,741,450 A 6/1973 Seastrom
3,741,852 A 6/1973 Keener
3,743,332 A 7/1973 Sonolet
3,745,936 A 7/1973 Bennett
3,748,006 A 7/1973 Levit et al.
3,749,299 A 7/1973 Ingle
3,758,182 A 9/1973 Barecki et al.
3,761,971 A 10/1973 Behnke
3,774,966 A 11/1973 Faulkner et al.
3,778,175 A 12/1973 Zimmer
3,786,765 A 1/1974 Burr
3,786,932 A 1/1974 Smith
3,790,241 A 2/1974 Messina
3,797,790 A 3/1974 Iseki
3,806,220 A 4/1974 Payne
3,808,607 A 5/1974 Harder
3,810,430 A 5/1974 Siegal
3,811,728 A 5/1974 Redemske
D231,880 S 6/1974 Weinstock
3,814,034 A 6/1974 Seiz
3,827,377 A 8/1974 Aughtry, Jr.
3,830,168 A 8/1974 Crete
3,831,533 A 8/1974 Kellogg
3,835,795 A 9/1974 Levenberg
3,838,902 A 10/1974 Tenani
3,841,725 A 10/1974 Dorner
3,845,985 A 11/1974 Behrend et al.
3,851,936 A 12/1974 Muller
3,851,981 A 12/1974 Corsi
3,857,622 A 12/1974 Mohr et al.
3,865,429 A 2/1975 Barker
3,871,153 A 3/1975 Birum, Jr.
3,871,726 A 3/1975 Stegner
D234,988 S 4/1975 Lopez-Benitez
3,877,764 A 4/1975 Hillier, Jr.
3,881,428 A 5/1975 Klecki
3,883,196 A 5/1975 Mohr
3,883,202 A * 5/1975 Konig ..... 312/223.6
3,890,495 A 6/1975 Bauer
3,892,189 A 7/1975 Killam
3,901,612 A 8/1975 Canin
3,910,659 A 10/1975 Peterson
3,913,498 A 10/1975 Hall
3,915,189 A 10/1975 Holbrook
3,922,045 A 11/1975 Meyer
3,927,481 A 12/1975 Safranek
3,944,283 A 3/1976 Molzon
D239,424 S 4/1976 Offradi
3,964,401 A 6/1976 Gutmann, Jr. et al.
3,966,158 A 6/1976 Boundy
3,973,800 A 8/1976 Kogan
3,974,782 A 8/1976 Ruckriegel
3,974,917 A 8/1976 Waxmanski
3,978,554 A 9/1976 Miller, Jr.
3,984,884 A 10/1976 Spitz
3,990,741 A 11/1976 Snyder
4,018,167 A 4/1977 Spangler
4,021,087 A 5/1977 Ferguson
4,022,136 A 5/1977 Schott
4,026,508 A 5/1977 Ziegler
4,029,024 A 6/1977 Klitzky
4,030,748 A 6/1977 Brock
4,032,188 A 6/1977 Jones
4,034,864 A 7/1977 Tyson
4,037,614 A 7/1977 Hines
4,040,588 A 8/1977 Papsco
4,046,417 A 9/1977 Beckley
4,049,230 A 9/1977 Minniear
4,049,331 A 9/1977 Gutmann, Jr.
4,050,752 A 9/1977 Dykstra
D245,950 S 10/1977 Mathur
4,053,192 A 10/1977 Spetner
4,055,373 A 10/1977 Andresen et al.
4,056,196 A 11/1977 Brauning
4,059,248 A 11/1977 Kuntz
4,062,589 A 12/1977 Klein
RE29,522 E 1/1978 Barecki
4,066,305 A * 1/1978 Gazarek ..... 312/195
4,069,927 A 1/1978 Taylor
4,070,013 A 1/1978 Sickler
4,070,075 A 1/1978 Morgan
D247,595 S 3/1978 Corson et al.
4,077,335 A 3/1978 Luzzani
4,094,256 A 6/1978 Holper
4,094,561 A 6/1978 Wolff
4,106,736 A 8/1978 Becker, III
4,106,738 A 8/1978 Kostecky
4,108,086 A 8/1978 Yindra
4,118,061 A 10/1978 Atkinson
4,118,084 A 10/1978 Sussman
D250,922 S 1/1979 Adkinson
4,136,680 A 1/1979 Southworth
4,138,952 A 2/1979 Hodson
4,141,612 A 2/1979 Rowe
4,145,098 A 3/1979 Alexander
4,156,515 A 5/1979 Mochly
4,158,936 A 6/1979 Fulton
D252,487 S 7/1979 Petersilie
4,161,254 A 7/1979 Taylor
4,162,113 A 7/1979 Pallavicini
4,163,572 A 8/1979 Benscoter
4,163,592 A 8/1979 Nelson
4,165,869 A 8/1979 Williams
4,165,902 A 8/1979 Ehrlich
4,166,195 A 8/1979 Schwab
4,185,430 A 1/1980 Gartung

(56) References Cited

U.S. PATENT DOCUMENTS 4,186,666 A 2/1980 Honickman
4,188,066 A 2/1980 Terenzoni
4,192,562 A 3/1980 Bishoff
4,200,254 A 4/1980 Nelson
4,205,876 A 6/1980 Cetina
4,213,650 A 7/1980 Sroub
4,215,840 A 8/1980 Babberl
4,219,101 A 8/1980 Valsvik
D256,829 S 9/1980 Qui et al.
4,222,541 A 9/1980 Cillis
4,224,769 A * 9/1980 Ball et al. ..... 52/36.1
4,227,758 A 10/1980 Clare
4,230,365 A 10/1980 Messinger
D257,603 S 12/1980 Cyplik
4,236,460 A 12/1980 Poupko
4,243,279 A 1/1981 Ackeret
4,258,856 A 3/1981 Marling
4,263,683 A 4/1981 Knoke
4,266,714 A 5/1981 Crane
4,272,136 A 6/1981 Sengua
4,281,602 A 8/1981 Lange
D260,826 S 9/1981 Steinberger
4,287,837 A 9/1981 Bayles
4,290,657 A 9/1981 Haas
4,291,999 A 9/1981 Vandelanoite
4,295,697 A 10/1981 Grime
4,296,981 A * 10/1981 Hildebrandt et al. ..... 312/194
4,297,952 A 11/1981 Zagaroli
4,311,101 A 1/1982 de Almagro
4,311,337 A 1/1982 Brunn
4,312,086 A 1/1982 Bianco
4,314,280 A 2/1982 Rose
4,318,353 A 3/1982 Schier
4,320,935 A 3/1982 Nagelkirk
D263,770 S 4/1982 Melchior
4,323,291 A 4/1982 Ball
4,324,076 A 4/1982 Honickman
4,325,597 A 4/1982 Morrison
4,334,483 A 6/1982 Kellogg
4,352,432 A 10/1982 Smith
4,372,629 A 2/1983 Propst
4,382,642 A 5/1983 Burdick
D269,237 S 6/1983 Burdick
4,387,872 A 6/1983 Hogue
4,387,873 A 6/1983 Pavlo
4,393,915 A 7/1983 Olson
4,401,222 A 8/1983 Kulikowski
4,403,677 A 9/1983 Messinger
4,407,476 A 10/1983 Bohannan
4,418,967 A 12/1983 Winkelman, Jr. et al.
4,422,385 A 12/1983 Rutsche
4,423,913 A 1/1984 Lee
4,429,850 A 2/1984 Weber
4,429,934 A 2/1984 VandenHoek
4,437,714 A 3/1984 Struck
4,450,775 A 5/1984 Brendle
4,457,436 A 7/1984 Kelley
4,458,961 A 7/1984 Browning
4,471,586 A 9/1984 Shuch
4,472,009 A 9/1984 Bell
4,477,128 A 10/1984 Hasbrouck
4,482,195 A 11/1984 Chapin
4,490,064 A 12/1984 Ducharme
4,508,231 A 4/1985 Honickman
4,516,509 A 5/1985 Langenegger
4,522,130 A 6/1985 Worthington
4,525,093 A 6/1985 Moll
4,526,250 A 7/1985 Messinger
4,535,703 A 8/1985 Henriott
4,559,738 A 12/1985 Helfman
4,570,408 A 2/1986 Frascaroli
4,580,854 A 4/1986 Hedfeld
4,582,002 A 4/1986 Wright
D283,855 S 5/1986 Kujawski
4,586,759 A 5/1986 Wrobel
4,588,227 A 5/1986 Austin
4,590,865 A 5/1986 Rutsche
4,591,289 A 5/1986 Vickers
4,601,247 A 7/1986 Welch
4,602,817 A 7/1986 Raftery
4,618,192 A 10/1986 Kelley
4,619,486 A 10/1986 Hannah
4,620,489 A 11/1986 Albano
4,621,381 A 11/1986 Schramek
4,621,865 A 11/1986 Herrera
4,623,088 A 11/1986 Holden
4,624,083 A 11/1986 Diffrient
4,625,483 A 12/1986 Zacky
4,632,040 A 12/1986 Sheffer
4,632,459 A 12/1986 Herschlag
4,633,789 A 1/1987 Kortering
4,637,666 A 1/1987 Worrell
4,639,049 A 1/1987 Frascaroli
4,645,161 A 2/1987 Collins
D288,748 S 3/1987 Klein
4,646,655 A 3/1987 Robolin
4,653,713 A 3/1987 Hamilton
4,654,756 A 3/1987 Wilson
4,666,115 A 5/1987 Schiro
4,678,151 A 7/1987 Radek
4,679,510 A 7/1987 Veyhl
4,684,094 A 8/1987 Everett
4,688,869 A 8/1987 Kelly
4,698,936 A 10/1987 Helfman
4,699,067 A 10/1987 Okopny
4,700,993 A 10/1987 Fu-Long
4,708,132 A 11/1987 Silvestrini
4,713,949 A 12/1987 Wilcox
4,714,027 A 12/1987 Stern
4,717,358 A 1/1988 Chaundy
4,718,132 A 1/1988 Wirland
4,725,030 A 2/1988 Miller
4,730,802 A 3/1988 Chatham
4,732,088 A 3/1988 Koechlin
4,732,089 A 3/1988 Mueller
4,734,826 A 3/1988 Wilson
4,735,152 A 4/1988 Bricker
4,735,467 A 4/1988 Wolters
D295,810 S 5/1988 Saporiti
4,748,913 A 6/1988 Favaretto
4,750,432 A 6/1988 McNamara
4,761,931 A 8/1988 Schrunk
4,762,072 A 8/1988 Boundy
4,765,253 A 8/1988 Schappach
4,766,422 A 8/1988 Wolters
4,771,583 A 9/1988 Ball
4,773,337 A 9/1988 Ball
4,779,940 A 10/1988 Ralston
4,781,127 A 11/1988 Conley
4,784,468 A 11/1988 Tierney
4,785,742 A 11/1988 Esslinger
4,786,119 A 11/1988 Smuda
4,795,355 A 1/1989 Dorn
4,798,423 A 1/1989 LaCour
4,799,432 A 1/1989 Rickner
4,805,784 A 2/1989 Solheim
4,807,838 A 2/1989 Anderson
4,819,986 A 4/1989 Markus
4,827,849 A 5/1989 Vignale
4,831,791 A * 5/1989 Ball ..... 52/36.1
4,832,241 A 5/1989 Radcliffe
4,832,421 A 5/1989 Shoffner
4,834,450 A 5/1989 Stickler
4,838,175 A 6/1989 Hauville
4,838,177 A 6/1989 Vander Park
4,840,584 A 6/1989 Cox
4,846,430 A 7/1989 Ke
4,850,285 A 7/1989 Suttles
4,852,500 A 8/1989 Ryburg
4,856,242 A 8/1989 Baloga
D303,327 S 9/1989 Masarotti
4,869,378 A 9/1989 Miller
4,875,418 A 10/1989 Moeckl
4,879,955 A 11/1989 Moll

(56) References Cited

U.S. PATENT DOCUMENTS

| | | | |
|---|---|---|---|
| 4,884,513 | A | 12/1989 | Newhouse |
| 4,884,702 | A | 12/1989 | Rekow |
| 4,891,922 | A | 1/1990 | Hozer |
| 4,905,428 | A | 3/1990 | Sykes |
| 4,914,873 | A | 4/1990 | Newhouse |
| 4,915,034 | A | 4/1990 | Grabe |
| 4,915,120 | A | 4/1990 | Ziolkowski |
| 4,224,769 | B1 | 5/1990 | Ball |
| 4,934,765 | A | 6/1990 | Slifer, Sr. |
| 4,938,442 | A | 7/1990 | Mastrodicasa |
| 4,941,717 | A | 7/1990 | Beaulieu |
| 4,944,235 | A | 7/1990 | Jahnke |
| 4,945,584 | A | 8/1990 | LaMantia |
| 4,948,205 | A | 8/1990 | Kelley |
| 4,953,696 | A | 9/1990 | Huang |
| 4,957,262 | A | 9/1990 | Kemper |
| 4,957,333 | A | 9/1990 | Hsu |
| 4,971,281 | A | 11/1990 | Steinbeck |
| 4,974,913 | A | 12/1990 | Vogt |
| 4,985,195 | A | 1/1991 | Wilson |
| 4,986,194 | A | 1/1991 | Bollman |
| 4,986,198 | A | 1/1991 | Naito |
| 4,986,330 | A | 1/1991 | McGonagle |
| 5,004,192 | A | 4/1991 | Handler |
| 5,008,966 | A | 4/1991 | Lepow |
| 5,016,765 | A | 5/1991 | Leonardo |
| 5,018,323 | A | 5/1991 | Clausen |
| 5,022,621 | A | 6/1991 | Quest |
| 5,024,167 | A | 6/1991 | Hayward |
| 5,025,603 | A | 6/1991 | Johnson |
| 5,026,614 | A | 6/1991 | Itoh |
| 5,031,683 | A | 7/1991 | Marvy |
| 5,033,624 | A | 7/1991 | DeGelder |
| 5,035,389 | A | 7/1991 | Wang |
| D318,966 | S | 8/1991 | Schroff et al. |
| 5,038,539 | A | 8/1991 | Kelley |
| 5,040,681 | A | 8/1991 | Grusin |
| 5,041,002 | A | 8/1991 | Byrne |
| 5,041,770 | A | 8/1991 | Seiler |
| 5,048,698 | A | 9/1991 | Konrad |
| 5,056,746 | A | 10/1991 | Parsons |
| D321,435 | S | 11/1991 | Scalisi et al. |
| 5,069,263 | A | 12/1991 | Edwards |
| 5,069,506 | A | 12/1991 | Wieland |
| 5,070,666 | A | 12/1991 | Looman |
| 5,071,204 | A | 12/1991 | Price |
| 5,074,422 | A | 12/1991 | Holtz |
| 5,078,055 | A | 1/1992 | Bellini |
| 5,080,238 | A | 1/1992 | Hochman |
| 5,080,438 | A | 1/1992 | Moyer |
| 5,082,120 | A | 1/1992 | Vega |
| 5,083,512 | A | 1/1992 | Newhouse |
| 5,085,153 | A | 2/1992 | McKee |
| 5,086,195 | A | 2/1992 | Claisse |
| 5,086,606 | A | 2/1992 | Finses |
| 5,086,958 | A | 2/1992 | Nagy |
| 5,094,174 | A | 3/1992 | Grund |
| 5,101,989 | A | 4/1992 | Jones |
| 5,103,741 | A | 4/1992 | Grund |
| 5,104,080 | A | 4/1992 | Berger |
| 5,109,992 | A | 5/1992 | Miller |
| 5,121,974 | A | 6/1992 | Monson |
| 5,123,549 | A | 6/1992 | Finses |
| 5,125,518 | A | 6/1992 | Ward |
| 5,129,202 | A | 7/1992 | Payne |
| 5,130,494 | A | 7/1992 | Simonton |
| 5,131,620 | A | 7/1992 | Boundy |
| 5,134,826 | A | 8/1992 | La Roche |
| D329,875 | S | 9/1992 | Stern et al. |
| 5,144,888 | A | 9/1992 | Heine |
| 5,144,896 | A | 9/1992 | Fortsch |
| 5,148,646 | A | 9/1992 | Lutostanski |
| 5,154,126 | A | 10/1992 | Newhouse |
| 5,155,955 | A | 10/1992 | Ball |
| 5,158,472 | A | 10/1992 | Juhlin |
| 5,165,614 | A | 11/1992 | Fourche |
| 5,168,889 | A | 12/1992 | Diestel |
| 5,172,641 | A | 12/1992 | Auer |
| 5,174,225 | A | 12/1992 | Reise |
| 5,174,532 | A | 12/1992 | Huang |
| 5,177,899 | A | 1/1993 | Powell |
| 5,177,912 | A | 1/1993 | Ball |
| 5,183,319 | A | 2/1993 | Pearson |
| 5,184,441 | A | 2/1993 | Balfanz, Jr. |
| 5,185,972 | A | 2/1993 | Markiewicz |
| 5,186,425 | A | 2/1993 | Keusch |
| 5,187,641 | A | 2/1993 | Muskatello |
| 5,197,614 | A | 3/1993 | Dalton |
| 5,203,135 | A | 4/1993 | Bastian |
| 5,206,972 | A | 5/1993 | Nudelmont |
| D336,185 | S | 6/1993 | Deinen et al. |
| 5,215,108 | A | 6/1993 | Sprague |
| 5,217,124 | A | 6/1993 | Stone |
| 5,220,871 | A | 6/1993 | Grund |
| D337,219 | S | 7/1993 | Dokoupil et al. |
| D337,450 | S | 7/1993 | Dettinger |
| 5,224,610 | A | 7/1993 | Veazey |
| 5,226,179 | A | 7/1993 | Choi |
| 5,228,579 | A | 7/1993 | Kaufman |
| 5,230,492 | A | 7/1993 | Zwart |
| 5,231,562 | A | 7/1993 | Pierce |
| D337,911 | S | 8/1993 | Gibson |
| 5,233,707 | A | 8/1993 | Perkins |
| 5,237,935 | A | 8/1993 | Newhouse |
| 5,241,717 | A | 9/1993 | Ward |
| 5,241,796 | A | 9/1993 | Hellwig |
| 5,241,914 | A | 9/1993 | Korb |
| 5,242,048 | A | 9/1993 | Ellingsworth |
| 5,252,086 | A | 10/1993 | Russell |
| 5,255,478 | A | 10/1993 | Baranowski |
| 5,255,966 | A | 10/1993 | Newhouse et al. |
| 5,263,772 | A | 11/1993 | Ritzow |
| 5,267,715 | A | 12/1993 | Owen |
| 5,272,988 | A | 12/1993 | Kelley |
| D342,837 | S | 1/1994 | Forcolini |
| 5,277,007 | A | 1/1994 | Hellwig |
| 5,277,132 | A | 1/1994 | Korb |
| 5,285,900 | A | 2/1994 | Swingler |
| 5,287,666 | A | 2/1994 | Frascaroli |
| 5,295,594 | A | 3/1994 | Melzian |
| 5,297,486 | A | 3/1994 | Herrmann |
| 5,305,883 | A | 4/1994 | Gage |
| 5,308,031 | A | 5/1994 | Evenson |
| D347,622 | S | 6/1994 | Flasz |
| 5,317,977 | A | 6/1994 | Omessi |
| 5,321,579 | A | 6/1994 | Brown |
| 5,322,022 | A | 6/1994 | Burkholder |
| D348,432 | S | 7/1994 | Dubruco |
| 5,327,838 | A | 7/1994 | Beltman |
| 5,333,744 | A | 8/1994 | LoCicero |
| 5,339,747 | A | 8/1994 | Epps |
| 5,340,326 | A | 8/1994 | LeMaster |
| 5,341,615 | A | 8/1994 | Hodges |
| 5,341,749 | A | 8/1994 | Noakes |
| 5,346,296 | A | 9/1994 | Kelley |
| 5,353,566 | A | 10/1994 | Boon et al. |
| 5,354,025 | A | 10/1994 | McCaffrey |
| 5,354,027 | A | 10/1994 | Cox |
| 5,357,874 | A | 10/1994 | Palmer |
| 5,359,826 | A | 11/1994 | Grearson |
| 5,360,121 | A | 11/1994 | Sothman |
| 5,362,923 | A | 11/1994 | Newhouse |
| 5,380,034 | A | 1/1995 | Wilson |
| 5,381,908 | A | 1/1995 | Hepp |
| 5,386,787 | A | 2/1995 | Hall |
| 5,392,934 | A | 2/1995 | Fox |
| 5,394,658 | A | 3/1995 | Schreiner et al. |
| 5,394,809 | A | 3/1995 | Feldpausch |
| 5,400,719 | A | 3/1995 | Santapa |
| 5,403,082 | A | 4/1995 | Kramer |
| 5,406,894 | A | 4/1995 | Herrmann |
| 5,415,454 | A | 5/1995 | Fu-Tsung |
| 5,415,461 | A | 5/1995 | Sakamoto |
| D359,161 | S | 6/1995 | Byrne |

(56) References Cited

U.S. PATENT DOCUMENTS

D359,631 S 6/1995 Bubb
D360,310 S 7/1995 Stamberg et al.
5,428,928 A 7/1995 Hellwig
5,429,431 A 7/1995 Olson
5,433,152 A 7/1995 Henry
5,437,235 A 8/1995 Randolph
5,437,426 A 8/1995 MacDonald
5,438,937 A 8/1995 Ball
5,441,151 A 8/1995 Billingham
5,441,338 A 8/1995 Kane
5,451,101 A 9/1995 Ellison
5,454,638 A 10/1995 Bird
5,469,794 A 11/1995 Laderoute
5,472,164 A 12/1995 Contee, Jr.
5,473,994 A 12/1995 Foley
5,479,733 A 1/1996 Kusina
5,483,904 A 1/1996 Kelly
5,486,042 A 1/1996 Heisler
D366,978 S 2/1996 Mariol
D367,364 S 2/1996 Lewis
5,490,357 A 2/1996 Lin
D368,177 S 3/1996 Mourgue
D368,314 S 3/1996 Lin
5,499,868 A 3/1996 Schainholz
5,511,348 A 4/1996 Cornell
5,516,298 A 5/1996 Smith
5,522,324 A 6/1996 van Gelder
D371,703 S 7/1996 Muller-Deisig et al.
5,535,972 A 7/1996 Fallago
5,537,290 A 7/1996 Brown
5,542,553 A 8/1996 Penniman
5,544,593 A 8/1996 Canfield
5,546,873 A 8/1996 Conner
5,547,080 A 8/1996 Klimas
5,549,055 A 8/1996 Kusch
5,553,551 A 9/1996 Crombie
5,556,067 A 9/1996 Konig
5,556,181 A 9/1996 Bertrand
5,560,302 A 10/1996 Diffrient
5,560,303 A 10/1996 Severin
5,564,784 A 10/1996 Felling
5,568,773 A 10/1996 Hung
D375,845 S 11/1996 Mourgue
5,572,751 A 11/1996 Brandt
5,573,320 A 11/1996 Shearer
5,588,376 A 12/1996 Seidl
5,592,884 A 1/1997 Glick
D378,028 S 2/1997 Schefcik
5,598,678 A 2/1997 Reynolds
5,603,405 A 2/1997 Smith
5,606,920 A 3/1997 Meyer
5,609,112 A 3/1997 Meyer
5,609,402 A 3/1997 Kemp
5,611,608 A 3/1997 Clausen
5,615,783 A 4/1997 Warnken
5,622,197 A 4/1997 Valaire
5,623,880 A 4/1997 Kuntz
5,623,882 A 4/1997 Price
5,628,257 A 5/1997 Conner
5,628,759 A 5/1997 McCool
D379,987 S 6/1997 Scheid et al.
D380,095 S 6/1997 Diaz-Azcuy
5,634,300 A 6/1997 Huebner
5,638,759 A * 6/1997 Klugkist ..... 108/50.02
D381,216 S 7/1997 Paus
5,644,995 A 7/1997 Gurwell
5,649,742 A 7/1997 Liu
D382,123 S 8/1997 Pimental et al.
D382,736 S 8/1997 Kopish
5,662,132 A 9/1997 Larsen
5,662,298 A 9/1997 Collins
5,666,713 A 9/1997 Kubota
5,669,498 A 9/1997 Fierek
5,673,632 A 10/1997 Sykes
5,678,491 A 10/1997 Price
5,678,907 A 10/1997 Schainholz
5,683,154 A 11/1997 Chang
D387,583 S 12/1997 Shear
5,697,686 A 12/1997 Miller
5,698,759 A 12/1997 Fray
5,704,683 A 1/1998 Cooper
5,709,156 A 1/1998 Gevaert
5,715,761 A 2/1998 Frattini
5,718,179 A 2/1998 Johnson
D392,470 S 3/1998 Smith
D392,775 S 3/1998 McMahon
5,724,778 A 3/1998 Cornell
5,738,422 A 4/1998 Welborn, Jr. et al.
5,738,462 A 4/1998 Petersen
5,740,743 A 4/1998 Schairbaum
5,746,488 A 5/1998 LaCour
5,752,449 A 5/1998 Simon
5,752,450 A 5/1998 Roesner
5,754,995 A 5/1998 Behrendt
5,755,321 A 5/1998 Wang
5,756,539 A 5/1998 Skrumsager
5,771,954 A 6/1998 Benner
5,775,778 A 7/1998 Riley
5,778,804 A 7/1998 Read
5,791,259 A 8/1998 Mansfield
5,791,751 A 8/1998 Meyer et al.
5,794,545 A 8/1998 McDaniel
5,794,902 A 8/1998 Henry
5,795,028 A 8/1998 Dussia, Jr.
5,802,672 A 9/1998 Rohder
5,802,778 A 9/1998 Thorp
5,802,789 A 9/1998 Goodman
5,803,561 A 9/1998 Puehlhorn
5,806,258 A 9/1998 Miedema
5,809,708 A 9/1998 Greer
D399,661 S 10/1998 Smith
5,816,001 A 10/1998 Goodman
5,823,624 A 10/1998 Dahlbacka
5,826,955 A 10/1998 Sanders
5,831,211 A 11/1998 Gartung
5,833,065 A 11/1998 Burgess
5,833,332 A 11/1998 Marshall
5,836,112 A 11/1998 Lindale
5,839,240 A 11/1998 Elsholz
5,839,462 A 11/1998 Randall
5,857,415 A 1/1999 Richard
5,860,713 A 1/1999 Richardson
D405,976 S 2/1999 Beall
D405,979 S 2/1999 Kramer et al.
5,865,409 A 2/1999 Nimer
5,867,955 A 2/1999 Russell
5,876,002 A 3/1999 White
5,881,500 A 3/1999 Latino
5,886,295 A 3/1999 Carino
5,890,325 A 4/1999 Corcorran
5,890,614 A 4/1999 Dancyger
5,890,782 A 4/1999 Alberts
5,893,606 A 4/1999 Chiang
5,894,614 A 4/1999 Stroud
5,896,817 A 4/1999 Hancock
5,896,995 A 4/1999 Murray
5,897,178 A 4/1999 Ohara
5,901,513 A 5/1999 Mollenkopf
5,904,104 A 5/1999 Yu
5,906,035 A 5/1999 Atkins
5,906,420 A 5/1999 Rozier, Jr.
D410,800 S 6/1999 Gomez
5,908,002 A 6/1999 Alexander
5,911,178 A 6/1999 Alexander
5,921,042 A 7/1999 Ashton
5,921,052 A 7/1999 Kemp
5,921,411 A 7/1999 Merl
5,927,311 A 7/1999 Jager
D413,306 S 8/1999 Scherer et al.
5,934,201 A 8/1999 Diffrient
5,934,203 A 8/1999 Glass
5,937,924 A 8/1999 Cooper
5,941,397 A 8/1999 Buchanan
5,943,834 A 8/1999 Jeffers

(56) References Cited

U.S. PATENT DOCUMENTS

| | | | |
|---|---|---|---|
| 5,943,966 | A | 8/1999 | Machado |
| 5,947,307 | A | 9/1999 | Battaglia |
| 5,950,371 | A | 9/1999 | Rives |
| 5,950,649 | A | 9/1999 | Gerig |
| 5,954,409 | A | 9/1999 | LaCour |
| 5,957,556 | A | 9/1999 | Singer |
| 5,967,631 | A | 10/1999 | Ko |
| 5,970,662 | A | 10/1999 | Corcorran |
| 5,971,508 | A | 10/1999 | Deimen |
| 5,971,509 | A | 10/1999 | Deimen |
| D415,901 | S | 11/1999 | Arko et al. |
| 5,974,985 | A | 11/1999 | Flototto |
| 5,975,657 | A | 11/1999 | LaCour |
| 5,976,663 | A | 11/1999 | Davis |
| 5,979,988 | A | 11/1999 | Heidmann |
| 5,986,212 | A | 11/1999 | Lhota |
| 5,988,076 | A | 11/1999 | Vander Park |
| 5,988,383 | A | 11/1999 | Armstrong |
| 5,988,755 | A | 11/1999 | Fastelli |
| 5,993,216 | A | 11/1999 | Stogner |
| 5,994,644 | A | 11/1999 | Rindoks |
| 5,996,145 | A | 12/1999 | Taylor |
| 6,000,179 | A | 12/1999 | Musculus |
| 6,000,343 | A | 12/1999 | Laney |
| 6,000,750 | A | 12/1999 | Rossman |
| 6,003,446 | A | 12/1999 | Leibowitz |
| 6,003,447 | A | 12/1999 | Cox |
| 6,004,065 | A | 12/1999 | Higdon |
| D418,611 | S | 1/2000 | Montague, III |
| 6,012,690 | A | 1/2000 | Cohen |
| 6,024,024 | A | 2/2000 | Favaretto |
| 6,024,599 | A | 2/2000 | Stathis |
| 6,029,580 | A | 2/2000 | Alfonso |
| 6,036,150 | A | 3/2000 | Lehrman |
| 6,036,516 | A | 3/2000 | Byrne |
| 6,037,538 | A | 3/2000 | Brooks |
| 6,041,722 | A | 3/2000 | Baker |
| 6,050,426 | A | 4/2000 | Leurdijk |
| 6,050,659 | A | 4/2000 | LaCour |
| D423,808 | S | 5/2000 | Natuzzi et al. |
| 6,055,912 | A | 5/2000 | Doud |
| 6,059,109 | A | 5/2000 | Stein |
| 6,061,972 | A | 5/2000 | Thorp |
| 5,816,001 | B1 | 6/2000 | Goodman |
| 6,070,956 | A | 6/2000 | Yates |
| 6,076,308 | A | 6/2000 | Lyon |
| 6,076,317 | A | 6/2000 | Hellwig |
| 6,076,474 | A | 6/2000 | Grabowski |
| 6,076,903 | A | 6/2000 | Vander Park |
| 6,079,803 | A | 6/2000 | West |
| D427,783 | S | 7/2000 | Luedke |
| 6,082,838 | A | 7/2000 | Bissu Palombo |
| 6,082,840 | A | 7/2000 | Chau |
| 6,086,028 | A | 7/2000 | Pfister |
| D429,081 | S | 8/2000 | Gomez |
| 6,098,349 | A | 8/2000 | Zheng |
| 6,098,821 | A | 8/2000 | Dube |
| 6,107,576 | A | 8/2000 | Morton |
| 6,109,280 | A | 8/2000 | Custer |
| D430,543 | S | 9/2000 | Rohder |
| 6,119,317 | A | 9/2000 | Pfister |
| 6,119,878 | A | 9/2000 | Zen |
| 6,119,989 | A | 9/2000 | Hollington |
| 6,120,207 | A | 9/2000 | Goto |
| D432,807 | S | 10/2000 | Gollinucci |
| 6,125,600 | A | 10/2000 | Bastian |
| 6,135,545 | A | 10/2000 | Liao |
| 6,135,583 | A | 10/2000 | Simon |
| 6,138,827 | A | 10/2000 | Marshall |
| 6,138,841 | A | 10/2000 | Klein |
| 5,802,789 | B1 | 11/2000 | Goodman |
| 5,867,955 | B1 | 11/2000 | Russell |
| 6,148,958 | A | 11/2000 | Ahl et al. |
| 6,152,047 | A | 11/2000 | Mac Namara |
| 6,152,048 | A | 11/2000 | Vander Park |
| 6,152,312 | A | 11/2000 | Nava |
| 6,161,486 | A | 12/2000 | Boots |
| 6,164,467 | A | 12/2000 | DePottey |
| 6,167,579 | B1 | 1/2001 | Kopish |
| 6,167,676 | B1 | 1/2001 | Shipman |
| 6,170,200 | B1 | 1/2001 | Cornell |
| 6,170,410 | B1 | 1/2001 | Gioacchini |
| 6,176,561 | B1 | 1/2001 | Roels |
| 6,180,884 | B1 | 1/2001 | Tokunaga |
| 6,182,579 | B1 | 2/2001 | Chang |
| 6,182,580 | B1 | 2/2001 | Barrett |
| 6,183,280 | B1 | 2/2001 | Laukhuf |
| 6,189,268 | B1 | 2/2001 | Carr |
| D438,402 | S | 3/2001 | Walsh |
| D439,624 | S | 3/2001 | Webb |
| 6,196,648 | B1 | 3/2001 | Henriott |
| 6,199,321 | B1 | 3/2001 | Ginzel |
| 6,202,567 | B1 | 3/2001 | Funk |
| 6,205,716 | B1 | 3/2001 | Peltz |
| 6,206,206 | B1 | 3/2001 | Saylor |
| D440,448 | S | 4/2001 | Horsten |
| 6,213,191 | B1 | 4/2001 | Nitzsche |
| 6,213,919 | B1 | 4/2001 | Wang |
| 6,216,397 | B1 | 4/2001 | Chang |
| 6,220,186 | B1 | 4/2001 | Scharer |
| 5,836,112 | C1 | 5/2001 | Lindale |
| 6,224,029 | B1 | 5/2001 | Marble |
| 6,234,385 | B1 | 5/2001 | Espinoza |
| D443,157 | S | 6/2001 | Linder |
| 6,240,587 | B1 | 6/2001 | Meichtry et al. |
| 6,240,687 | B1 | 6/2001 | Chong |
| 6,241,317 | B1 | 6/2001 | Wu |
| 6,250,020 | B1 | 6/2001 | Shipman |
| 6,254,206 | B1 | 7/2001 | Petrick |
| 6,254,427 | B1 | 7/2001 | Stathis |
| 6,267,064 | B1 | 7/2001 | Ostertag |
| 6,267,338 | B1 | 7/2001 | Saylor |
| D446,039 | S | 8/2001 | Gomez |
| 6,270,162 | B1 | 8/2001 | Jeny |
| 6,276,382 | B1 | 8/2001 | Bindschatel et al. |
| 6,282,854 | B1 | 9/2001 | Vos |
| 6,283,043 | B1 | 9/2001 | Stern |
| 6,283,564 | B1 | 9/2001 | Corson |
| 6,285,544 | B1 | 9/2001 | Chandramohan |
| 6,286,192 | B2 | 9/2001 | Pfister |
| 6,289,826 | B1 | 9/2001 | Waisbrod |
| 6,293,506 | B1 | 9/2001 | Gutgsell |
| D448,946 | S | 10/2001 | Goetz |
| 6,296,002 | B1 | 10/2001 | Tashchyan |
| 6,302,035 | B1 | 10/2001 | Frenkler |
| 6,302,053 | B1 | 10/2001 | Tomczak et al. |
| 6,302,366 | B1 | 10/2001 | Saylor |
| 6,308,641 | B1 | 10/2001 | Kingbury |
| D450,959 | S | 11/2001 | Birsel et al. |
| 6,318,276 | B1 | 11/2001 | Reinecke |
| 6,324,997 | B1 | 12/2001 | Baker |
| 6,327,983 | B1 | 12/2001 | Cronk |
| 6,329,960 | B1 | 12/2001 | Andrew |
| 6,330,773 | B1 | 12/2001 | MacDonald |
| 6,336,414 | B1 | 1/2002 | Stewart |
| 6,338,172 | B1 | 1/2002 | Taylor |
| 6,338,226 | B1 | 1/2002 | Gauthier |
| 6,340,145 | B1 | 1/2002 | Tagami |
| 6,341,666 | B1 | 1/2002 | Allen |
| 6,347,591 | B1 | 2/2002 | Karpa |
| 6,347,592 | B1 | 2/2002 | Gessert |
| 6,349,507 | B1 | 2/2002 | Muellerleile |
| 6,354,043 | B1 | 3/2002 | Simon |
| 6,357,616 | B1 | 3/2002 | Harris |
| 6,363,414 | B1 | 3/2002 | Nicholls |
| D455,302 | S | 4/2002 | Minami |
| D456,293 | S | 4/2002 | Tsumura et al. |
| 6,364,128 | B1 | 4/2002 | Wohlford |
| 6,367,874 | B2 | 4/2002 | Casini |
| 6,367,880 | B1 | 4/2002 | Niederman |
| 6,371,309 | B1 | 4/2002 | Smith |
| 6,372,560 | B1 | 4/2002 | Jen |
| 6,374,548 | B1 | 4/2002 | Ruedinger et al. |
| D457,017 | S | 5/2002 | Muller |

(56) References Cited

U.S. PATENT DOCUMENTS

| | | | |
|---|---|---|---|
| D457,736 | S | 5/2002 | Simons, Jr. et al. |
| 5,609,402 | C1 | 5/2002 | Kemp |
| 6,382,747 | B1 | 5/2002 | Catta |
| 6,384,329 | B2 | 5/2002 | Buard |
| 6,394,001 | B1 | 5/2002 | Giesey |
| 6,397,762 | B1 | 6/2002 | Goldberg |
| 6,398,326 | B1 | 6/2002 | Wang |
| 6,401,862 | B1 | 6/2002 | Caron |
| 6,402,111 | B1 | 6/2002 | Stewart |
| 6,402,233 | B1 | 6/2002 | Tseng |
| 6,410,855 | B1 | 6/2002 | Berkowitz |
| 6,422,398 | B2 | 7/2002 | LaFontaine |
| 6,425,219 | B1 | 7/2002 | Barmak |
| 6,427,608 | B1 | 8/2002 | Crinion |
| 6,427,609 | B1 | 8/2002 | Grant |
| 6,431,436 | B1 | 8/2002 | Evers |
| 6,435,106 | B2 | 8/2002 | Funk |
| 6,435,461 | B1 | 8/2002 | Saylor |
| 6,446,981 | B1 | 9/2002 | Wise |
| 6,447,080 | B1 | 9/2002 | Rheault |
| 6,454,358 | B1 | 9/2002 | Benincasa |
| 6,457,422 | B1 | 10/2002 | Saul |
| 6,463,701 | B1 | 10/2002 | Baloga |
| 6,469,747 | B1 | 10/2002 | Rai |
| D465,201 | S | 11/2002 | Gershfeld |
| 6,474,025 | B1 | 11/2002 | Faiks |
| 6,480,243 | B2 | 11/2002 | Yamamoto |
| 6,481,177 | B1 | 11/2002 | Wood |
| 6,481,678 | B1 | 11/2002 | Chong |
| 6,483,027 | B1 | 11/2002 | Howard |
| 6,484,360 | B1 | 11/2002 | DeBartolo, Jr. |
| D467,092 | S | 12/2002 | Vu |
| 6,488,347 | B1 | 12/2002 | Bienick |
| 6,490,829 | B1 | 12/2002 | Schreiner |
| 6,490,981 | B2 | 12/2002 | Isensee |
| 6,497,184 | B1 | 12/2002 | Whitesitt |
| 6,499,608 | B1 | 12/2002 | Sterling |
| D468,837 | S | 1/2003 | Shilling et al. |
| 6,510,663 | B2 | 1/2003 | Jourden |
| 6,520,353 | B2 | 2/2003 | Fulbright |
| 6,523,795 | B2 | 2/2003 | Gutgsell |
| 6,527,235 | B1 | 3/2003 | Cotterill |
| 6,530,181 | B1 | 3/2003 | Seiber |
| 6,533,019 | B1 | 3/2003 | King |
| 6,536,858 | B1 | 3/2003 | Heidmann |
| D473,723 | S | 4/2003 | Pesso |
| D473,850 | S | 4/2003 | Rouleau et al. |
| 6,540,549 | B2 | 4/2003 | Rupert |
| 6,547,086 | B1 | 4/2003 | Harvey |
| 6,550,875 | B1 | 4/2003 | Compton |
| 6,553,731 | B2 | 4/2003 | Hsueh |
| 6,553,919 | B1 | 4/2003 | Nevin |
| D474,287 | S | 5/2003 | Gresham et al. |
| 6,557,191 | B2 | 5/2003 | Bellows |
| 6,557,310 | B2 | 5/2003 | Marshall |
| 6,559,829 | B1 | 5/2003 | Matsuo |
| 6,560,094 | B2 | 5/2003 | Schmidt |
| 6,564,941 | B2 | 5/2003 | Hedges |
| 6,568,335 | B2 | 5/2003 | Hamilton |
| 6,578,498 | B1 | 6/2003 | Draudt |
| 6,581,344 | B1 | 6/2003 | Niewiadomski |
| 6,588,346 | B1 | 7/2003 | Bockheim |
| 6,595,227 | B2 | 7/2003 | Le Gette |
| 6,609,465 | B2 | 8/2003 | Kolavo |
| 6,615,550 | B2 | 9/2003 | Reuschel |
| 6,617,676 | B1 | 9/2003 | Oddou |
| D480,883 | S | 10/2003 | Williams et al. |
| 6,629,505 | B1 | 10/2003 | Cronk |
| D482,535 | S | 11/2003 | Williams et al. |
| 6,644,329 | B2 | 11/2003 | Tomason |
| 6,659,023 | B2 | 12/2003 | Saltzman et al. |
| 6,659,546 | B2 | 12/2003 | Schmeing et al. |
| 6,662,731 | B2 | 12/2003 | Teppo |
| 6,662,732 | B2 | 12/2003 | Birsel |
| 6,663,201 | B2 | 12/2003 | Herron, III |
| 6,666,342 | B1 | 12/2003 | House |
| D484,709 | S | 1/2004 | Cronk et al. |
| D485,086 | S | 1/2004 | Gomez |
| 6,672,011 | B2 | 1/2004 | Garner |
| 6,676,231 | B1 | 1/2004 | Kelley et al. |
| 6,687,930 | B1 | 2/2004 | Eads |
| 6,712,008 | B1 | 3/2004 | Habenicht |
| 6,712,433 | B2 | 3/2004 | Hellwig |
| 6,715,837 | B2 | 4/2004 | Niederman |
| 6,725,784 | B2 | 4/2004 | Crinion |
| 6,726,277 | B1 | 4/2004 | Samaha |
| 6,729,085 | B2 | 5/2004 | Newhouse |
| 6,736,076 | B2 | 5/2004 | Kaltenmark |
| 6,739,096 | B2 | 5/2004 | Feldpausch |
| 6,742,307 | B2 | 6/2004 | Briskman |
| 6,742,461 | B1 | 6/2004 | Sen |
| 6,748,710 | B2 | 6/2004 | Gresham |
| 6,749,074 | B1 | 6/2004 | Hileman |
| 6,749,161 | B1 | 6/2004 | Will |
| 6,751,914 | B2 | 6/2004 | Zeh |
| 6,758,355 | B2 | 7/2004 | Zidek |
| 6,764,245 | B2 | 7/2004 | Popovski |
| 6,766,748 | B2 | 7/2004 | Insalaco |
| 6,769,747 | B2 | 8/2004 | Chan |
| D495,514 | S | 9/2004 | Ricci |
| D495,518 | S | 9/2004 | Ricci |
| 6,786,161 | B2 | 9/2004 | Fischer |
| 6,786,340 | B2 | 9/2004 | Ford |
| 6,792,876 | B2 | 9/2004 | Lin |
| 6,796,443 | B2 | 9/2004 | Lippman |
| 6,802,264 | B2 | 10/2004 | Kasak |
| 6,802,715 | B1 | 10/2004 | Wotton |
| 6,805,060 | B2 | 10/2004 | Nicoletti |
| 6,807,776 | B2 | 10/2004 | Girdwood |
| D498,074 | S | 11/2004 | Gomez |
| 6,818,305 | B2 | 11/2004 | Murar |
| 6,820,388 | B2 | 11/2004 | Newhouse |
| 6,827,028 | B1 | 12/2004 | Callaway |
| 6,827,320 | B2 | 12/2004 | Yeh |
| 6,829,792 | B2 | 12/2004 | Braly |
| 6,837,384 | B2 | 1/2005 | Secondino |
| 6,845,723 | B2 | 1/2005 | Kottman |
| D501,330 | S | 2/2005 | Gomez |
| 6,851,140 | B2 | 2/2005 | Polevoy |
| 6,851,226 | B2 | 2/2005 | MacGregor |
| 6,854,217 | B2 | 2/2005 | Bockheim et al. |
| 6,857,712 | B1 | 2/2005 | Haberman |
| 6,866,890 | B2 | 3/2005 | Kiryu |
| 6,877,731 | B1 | 4/2005 | Corley, Sr. |
| 6,877,824 | B2 | 4/2005 | Winkless |
| 6,880,185 | B1 | 4/2005 | McAdams |
| D505,456 | S | 5/2005 | Green |
| 6,886,890 | B2 | 5/2005 | Rowland |
| 6,895,869 | B2 | 5/2005 | Lai |
| 6,899,404 | B1 | 5/2005 | King |
| 6,901,940 | B2 | 6/2005 | Zheng |
| 6,904,719 | B2 | 6/2005 | Braun |
| 6,908,148 | B2 | 6/2005 | Wang et al. |
| 6,912,960 | B2 | 7/2005 | Tsai |
| D508,455 | S | 8/2005 | Oakley et al. |
| 6,928,785 | B2 | 8/2005 | Shipman |
| 6,931,795 | B1 | 8/2005 | Baloga |
| 6,935,247 | B2 | 8/2005 | Schaefers |
| 6,935,517 | B1 | 8/2005 | Reed |
| 6,942,306 | B2 | 9/2005 | Youngs |
| 6,951,085 | B2 | 10/2005 | Hodges |
| 6,957,878 | B2 | 10/2005 | Greenwald |
| 6,968,957 | B2 | 11/2005 | Fynn |
| 6,972,367 | B2 | 12/2005 | Federspiel |
| 6,976,732 | B2 | 12/2005 | Thomas |
| 6,980,259 | B2 | 12/2005 | Strollo |
| 6,986,491 | B2 | 1/2006 | Anderson |
| 6,986,556 | B2 | 1/2006 | Haberman |
| 6,990,909 | B2 | 1/2006 | Gosling |
| D516,101 | S | 2/2006 | Vardon |
| D516,227 | S | 2/2006 | Price |
| 7,004,081 | B2 | 2/2006 | Chang |
| 7,007,903 | B2 | 3/2006 | Turner |
| 7,008,031 | B2 | 3/2006 | Doerflinger |

(56) References Cited

U.S. PATENT DOCUMENTS

| | | | |
|---|---|---|---|
| 7,014,052 | B2 | 3/2006 | Dettorre |
| 7,020,911 | B2 | 4/2006 | Oldham |
| 7,032,523 | B2 | 4/2006 | Forslund, III |
| D520,263 | S | 5/2006 | Nobles et al. |
| 7,036,438 | B2 | 5/2006 | Okamoto |
| 7,040,700 | B2 | 5/2006 | Duncan |
| 7,048,333 | B2 | 5/2006 | Martinez |
| 7,048,346 | B2 | 5/2006 | Saravis |
| 7,066,098 | B2 | 6/2006 | Blasen |
| 7,066,435 | B2 | 6/2006 | Oddsen, Jr. |
| 7,070,156 | B2 | 7/2006 | Liao |
| 7,075,101 | B2 | 7/2006 | Iiyama |
| 7,077,068 | B1 | 7/2006 | Agee |
| 7,096,560 | B2 | 8/2006 | Oddsen, Jr. |
| D530,929 | S | 10/2006 | Resterhouse et al. |
| D531,225 | S | 10/2006 | Kent et al. |
| 7,117,802 | B2 | 10/2006 | Hoke, Jr. |
| 7,125,088 | B2 | 10/2006 | Haberman |
| 7,140,134 | B1 | 11/2006 | Flagg |
| D533,365 | S | 12/2006 | Martin |
| 7,152,918 | B2 | 12/2006 | Berkes |
| 7,159,053 | B1 | 1/2007 | Lakin |
| D537,532 | S | 2/2007 | Takeuchi et al. |
| 7,172,166 | B2 | 2/2007 | Wang |
| 7,175,152 | B2 | 2/2007 | Dittmer |
| 7,182,415 | B2 | 2/2007 | Yamada |
| D538,054 | S | 3/2007 | Lissoni |
| D539,047 | S | 3/2007 | Auberger |
| 7,185,767 | B2 | 3/2007 | Phillips |
| 7,191,713 | B2 | 3/2007 | Gayhart |
| 7,195,119 | B2 | 3/2007 | Lungo |
| 7,201,107 | B1 | 4/2007 | Ruiter |
| D543,404 | S | 5/2007 | Watkins et al. |
| 7,210,593 | B2 | 5/2007 | Stull |
| D544,062 | S | 6/2007 | Baker |
| 7,225,822 | B1 | 6/2007 | Zheng |
| 7,228,977 | B2 | 6/2007 | Perkins |
| 7,237,855 | B2 | 7/2007 | Vardon |
| 7,241,981 | B2 | 7/2007 | Hofmann |
| 7,249,624 | B2 | 7/2007 | Zeh |
| D549,470 | S | 8/2007 | Hutton |
| 7,252,339 | B2 | 8/2007 | Owens |
| 7,270,309 | B2 | 9/2007 | Burns |
| 7,273,203 | B2 | 9/2007 | Carnevali |
| 7,278,360 | B2 | 10/2007 | Griepentrog |
| D554,387 | S | 11/2007 | Nicoletti |
| 7,290,651 | B2 | 11/2007 | Irwin |
| 7,300,029 | B2 | 11/2007 | Petrick |
| 7,303,417 | B2 | 12/2007 | Lubkert |
| 7,325,343 | B2 | 2/2008 | Seiber |
| 7,334,762 | B2 | 2/2008 | Dittmer |
| D564,764 | S | 3/2008 | Springer et al. |
| 7,343,864 | B2 | 3/2008 | Canin |
| D565,849 | S | 4/2008 | Newhouse |
| 6,857,712 | C1 | 4/2008 | Haberman |
| 7,357,086 | B2 | 4/2008 | Petrick |
| D568,344 | S | 5/2008 | Baacke et al. |
| D569,105 | S | 5/2008 | Van Hoorn |
| D569,142 | S | 5/2008 | Burak |
| 7,369,401 | B1 | 5/2008 | Floersch |
| 7,370,907 | B2 | 5/2008 | Leong |
| 7,377,078 | B2 | 5/2008 | Golino |
| 7,389,564 | B2 | 6/2008 | Lautenschläger |
| D573,820 | S | 7/2008 | Burak |
| 7,406,803 | B2 | 8/2008 | Haberman |
| 7,408,114 | B2 | 8/2008 | VanderVelde |
| 7,411,126 | B2 | 8/2008 | Herzog |
| 7,428,872 | B2 | 9/2008 | Strong |
| 7,433,618 | B2 | 10/2008 | Bartley |
| 7,434,304 | B2 | 10/2008 | Owens |
| 7,441,739 | B2 | 10/2008 | Huang |
| 7,461,484 | B2 | 12/2008 | Battey |
| 7,469,090 | B2 | 12/2008 | Ferris |
| D584,524 | S | 1/2009 | Ricci |
| D584,900 | S | 1/2009 | Hackethal et al. |
| D585,218 | S | 1/2009 | Hamilton et al. |
| 7,472,656 | B2 | 1/2009 | Riach |
| 7,481,502 | B2 | 1/2009 | Ortiz |
| 7,513,470 | B2 | 4/2009 | Lomberk |
| 7,516,708 | B2 | 4/2009 | Willy |
| 7,516,854 | B2 | 4/2009 | Brown |
| 7,516,929 | B2 | 4/2009 | Brustein |
| 7,517,029 | B2 | 4/2009 | Cvek |
| 7,520,076 | B2 | 4/2009 | Flagg |
| 7,523,903 | B1 | 4/2009 | Rindoks |
| 7,527,331 | B2 | 5/2009 | Fargason, III |
| 7,530,651 | B2 | 5/2009 | Ho |
| 7,544,893 | B2 | 6/2009 | Wallgren |
| D595,865 | S | 7/2009 | Magnusson |
| D596,876 | S | 7/2009 | Oshinomi et al. |
| D596,878 | S | 7/2009 | Oshinomi |
| D597,345 | S | 8/2009 | Oshinomi et al. |
| 7,575,011 | B2 | 8/2009 | Zheng |
| 7,578,399 | B1 | 8/2009 | Mulaw |
| 7,586,041 | B2 | 9/2009 | VanderVelde |
| 7,591,385 | B2 | 9/2009 | Brooks |
| 7,594,700 | B2 | 9/2009 | Stumpf |
| 7,594,823 | B2 | 9/2009 | Moscovitch |
| D602,706 | S | 10/2009 | Cramer et al. |
| D603,065 | S | 10/2009 | Hamilton et al. |
| 7,607,625 | B2 | 10/2009 | Wang |
| D603,617 | S | 11/2009 | Weiss |
| 7,614,350 | B2 | 11/2009 | Tuttle |
| 7,621,421 | B2 | 11/2009 | Ohayon |
| 7,621,489 | B2 | 11/2009 | Cvek |
| 7,621,500 | B2 | 11/2009 | Ishizaki |
| 7,624,959 | B2 | 12/2009 | Dozier |
| D608,407 | S | 1/2010 | Medlock |
| 7,641,056 | B2 | 1/2010 | Schulman |
| 7,644,456 | B2 | 1/2010 | Polevoy |
| 7,658,199 | B2 | 2/2010 | Ayers |
| 7,665,255 | B2 | 2/2010 | Dressendorfer |
| 7,665,709 | B2 | 2/2010 | Cvek |
| 7,673,838 | B2 | 3/2010 | Oddsen, Jr. |
| 7,676,992 | B2 | 3/2010 | Burns |
| 7,677,182 | B2 | 3/2010 | Mueller |
| 7,686,172 | B2 | 3/2010 | Wisnoski |
| 7,694,925 | B2 | 4/2010 | Kokenge |
| 7,697,268 | B2 | 4/2010 | Johnson |
| 7,703,398 | B2 * | 4/2010 | Brauning et al. ..... 108/50.02 |
| 7,703,469 | B2 | 4/2010 | Danziger |
| D614,844 | S | 5/2010 | Trunfio |
| D615,308 | S | 5/2010 | Serra Sola et al. |
| 7,721,361 | B1 | 5/2010 | Shubert |
| D616,663 | S | 6/2010 | Natuzzi |
| D617,112 | S | 6/2010 | Tsai |
| 7,726,617 | B2 | 6/2010 | Zambelli |
| 7,735,167 | B2 | 6/2010 | Kline |
| 7,740,310 | B1 | 6/2010 | Forster |
| 7,753,063 | B1 | 7/2010 | Laws |
| 7,757,869 | B2 | 7/2010 | Lawson |
| 7,765,651 | B2 | 8/2010 | Seth |
| D624,084 | S | 9/2010 | Scheper et al. |
| 7,798,463 | B2 | 9/2010 | Morgenroth |
| 7,802,407 | B2 | 9/2010 | Haberman |
| 7,810,654 | B1 | 10/2010 | Wang |
| 7,827,920 | B2 | 11/2010 | Beck |
| 7,832,147 | B2 | 11/2010 | Weast |
| D628,403 | S | 12/2010 | Starck |
| 7,856,756 | B1 | 12/2010 | Caruso |
| 7,871,048 | B2 | 1/2011 | Sculler |
| 7,871,131 | B2 | 1/2011 | Rowland |
| 7,878,476 | B2 | 2/2011 | Carson |
| 7,891,617 | B2 | 2/2011 | Tisbo |
| 7,896,015 | B2 | 3/2011 | Milano, Jr. |
| 7,900,781 | B2 | 3/2011 | Baine |
| 7,900,783 | B2 | 3/2011 | Fernandez |
| 7,905,242 | B2 | 3/2011 | Kline |
| 7,909,400 | B1 | 3/2011 | Delaney |
| 7,921,615 | B2 | 4/2011 | Picchio |
| 7,942,100 | B2 | 5/2011 | Grove |
| 8,015,765 | B2 | 9/2011 | Stackenwalt |
| D649,807 | S | 12/2011 | Stoepker |
| 8,109,215 | B2 | 2/2012 | Kitada et al. |

(56) References Cited

U.S. PATENT DOCUMENTS

| | | | | |
|---|---|---|---|---|
| D655,541 | S | 3/2012 | Zemel | |
| 8,276,523 | B2 | 10/2012 | Miller et al. | |
| 2001/0013305 | A1* | 8/2001 | Funk et al. | 108/50.02 |
| 2002/0062933 | A1 | 5/2002 | Insalaco et al. | |
| 2002/0069794 | A1 | 6/2002 | Dame et al. | |
| 2002/0189170 | A1 | 12/2002 | Reuschel et al. | |
| 2003/0005863 | A1 | 1/2003 | Chen | |
| 2003/0056817 | A1 | 3/2003 | Miller et al. | |
| 2003/0070595 | A1 | 4/2003 | Crinion | |
| 2003/0089283 | A1 | 5/2003 | Okamoto et al. | |
| 2003/0136313 | A1 | 7/2003 | Griepentrog | |
| 2003/0140985 | A1 | 7/2003 | Wang | |
| 2003/0213415 | A1 | 11/2003 | Ross et al. | |
| 2004/0060485 | A1 | 4/2004 | Chang | |
| 2004/0149177 | A1 | 8/2004 | Gayhart et al. | |
| 2004/0194669 | A1 | 10/2004 | Forslund, III et al. | |
| 2004/0231570 | A1 | 11/2004 | Landa | |
| 2004/0239217 | A1 | 12/2004 | Patel | |
| 2004/0250480 | A1 | 12/2004 | Matthai | |
| 2004/0250739 | A1 | 12/2004 | Yang | |
| 2005/0028272 | A1 | 2/2005 | Kanthasamy | |
| 2005/0045073 | A1 | 3/2005 | Wasley | |
| 2005/0056308 | A1 | 3/2005 | Birchenough | |
| 2005/0126447 | A1 | 6/2005 | Smith et al. | |
| 2005/0263041 | A1 | 12/2005 | Mueller et al. | |
| 2005/0268823 | A1 | 12/2005 | Bakker et al. | |
| 2005/0284341 | A1 | 12/2005 | Klassy et al. | |
| 2006/0042520 | A1 | 3/2006 | Stevens et al. | |
| 2006/0096506 | A1 | 5/2006 | Brauning et al. | |
| 2006/0108299 | A1 | 5/2006 | Menard | |
| 2006/0162065 | A1 | 7/2006 | Glattstein et al. | |
| 2006/0162626 | A1 | 7/2006 | Brauning et al. | |
| 2006/0163003 | A1 | 7/2006 | Wigstrom, Sr. | |
| 2006/0179792 | A1 | 8/2006 | Shaw et al. | |
| 2006/0266900 | A1 | 11/2006 | May et al. | |
| 2006/0278777 | A1 | 12/2006 | Atkinson et al. | |
| 2007/0017888 | A1 | 1/2007 | Falvey et al. | |
| 2007/0018486 | A1 | 1/2007 | Ayers et al. | |
| 2007/0018543 | A1 | 1/2007 | Cribbs | |
| 2007/0039150 | A1 | 2/2007 | Thomas et al. | |
| 2007/0057000 | A1 | 3/2007 | Webster | |
| 2007/0062992 | A1 | 3/2007 | Hepworth et al. | |
| 2007/0095374 | A1 | 5/2007 | Gendriesch et al. | |
| 2007/0114350 | A1 | 5/2007 | Sorci | |
| 2007/0114892 | A1 | 5/2007 | Boxenbaum et al. | |
| 2007/0170823 | A1 | 7/2007 | Stannis et al. | |
| 2007/0204537 | A1 | 9/2007 | Bastian et al. | |
| 2007/0221795 | A1 | 9/2007 | Cutty | |
| 2007/0251428 | A1 | 11/2007 | Mead et al. | |
| 2007/0277710 | A1 | 12/2007 | Gray et al. | |
| 2007/0277711 | A1 | 12/2007 | Grant | |
| 2007/0283631 | A1 | 12/2007 | Grandin et al. | |
| 2008/0010935 | A1 | 1/2008 | Nagel et al. | |
| 2008/0035031 | A1 | 2/2008 | Yamanishi et al. | |
| 2008/0041281 | A1 | 2/2008 | Griepentrog | |
| 2008/0050173 | A1 | 2/2008 | Bruder et al. | |
| 2008/0053931 | A1 | 3/2008 | Newbould et al. | |
| 2008/0074014 | A1 | 3/2008 | Ho | |
| 2008/0099279 | A1 | 5/2008 | Griswold et al. | |
| 2008/0149001 | A1* | 6/2008 | Hodges et al. | 108/6 |
| 2008/0223658 | A1 | 9/2008 | Michalec | |
| 2008/0224580 | A1* | 9/2008 | Gibbs et al. | 312/195 |
| 2008/0276841 | A1 | 11/2008 | Brauning et al. | |
| 2008/0290768 | A1 | 11/2008 | Haberman | |
| 2008/0295745 | A1 | 12/2008 | Hamilton et al. | |
| 2008/0296245 | A1 | 12/2008 | Punzel et al. | |
| 2008/0296457 | A1 | 12/2008 | Hager et al. | |
| 2009/0001859 | A1 | 1/2009 | Compton et al. | |
| 2009/0013908 | A1 | 1/2009 | Grove et al. | |
| 2009/0014401 | A1 | 1/2009 | Tallman | |
| 2009/0039685 | A1 | 2/2009 | Zernov | |
| 2009/0042428 | A1 | 2/2009 | Henriott et al. | |
| 2009/0051254 | A1 | 2/2009 | Grove | |
| 2009/0133609 | A1 | 5/2009 | Nethken et al. | |
| 2009/0165680 | A1 | 7/2009 | Bakker et al. | |
| 2009/0260547 | A1 | 10/2009 | Epstein et al. | |
| 2009/0273260 | A1 | 11/2009 | Kemp | |
| 2009/0282663 | A1 | 11/2009 | Martin et al. | |
| 2009/0284111 | A1 | 11/2009 | Hazzard et al. | |
| 2009/0293391 | A1 | 12/2009 | DeVore | |
| 2009/0293402 | A1 | 12/2009 | Hamilton et al. | |
| 2009/0309464 | A1 | 12/2009 | Schwartz | |
| 2009/0314913 | A1 | 12/2009 | Gillis | |
| 2010/0000449 | A1 | 1/2010 | Botkin | |
| 2010/0045081 | A1 | 2/2010 | Efthimiou | |
| 2010/0073919 | A1 | 3/2010 | Sharpe | |
| 2010/0096349 | A1 | 4/2010 | Schulman | |
| 2010/0126394 | A1 | 5/2010 | Burak et al. | |
| 2010/0212139 | A1 | 8/2010 | Oddsen, Jr. et al. | |
| 2010/0270246 | A1 | 10/2010 | Rodriguez | |
| 2010/0326930 | A1 | 12/2010 | Chiang | |
| 2010/0327134 | A1 | 12/2010 | Lundrigan et al. | |
| 2011/0297051 | A1 | 12/2011 | Martin et al. | |
| 2011/0297053 | A1 | 12/2011 | Martin et al. | |
| 2012/0103726 | A1 | 5/2012 | Morfidis et al. | |

FOREIGN PATENT DOCUMENTS

| | | | |
|---|---|---|---|
| CN | 101301147 | A | 11/2008 |
| CN | 101420882 | A | 4/2009 |
| DE | 8623882 | U1 | 11/1986 |
| DE | 3625137 | C1 | 10/1987 |
| DE | 19733435 | A1 | 2/1999 |
| DE | 19848392 | C1 | 12/1999 |
| DE | 202006016372 | U1 | 11/2007 |
| EP | 0096272 | A2 | 12/1983 |
| EP | 0145410 | A2 | 6/1985 |
| EP | 0147902 | A2 | 7/1985 |
| EP | 0164041 | A2 | 12/1985 |
| EP | 0447961 | A2 | 9/1991 |
| EP | 0462920 | A1 | 12/1991 |
| EP | 0594939 | A1 | 5/1994 |
| EP | 0791311 | A1 | 8/1997 |
| EP | 0815775 | A2 | 1/1998 |
| EP | 0830825 | A2 | 3/1998 |
| EP | 0903139 | A1 | 3/1999 |
| EP | 0949394 | A1 | 10/1999 |
| EP | 1647205 | A1 | 4/2006 |
| FR | 1232788 | A | 10/1960 |
| FR | 2636511 | A1 | 3/1990 |
| FR | 2865486 | A1 | 7/2005 |
| GB | 2048351 | A | 12/1980 |
| GB | 2100121 | A | 12/1982 |
| GB | 2246801 | A | 2/1992 |
| GB | 2323781 | A | 10/1998 |
| JP | 2004237398 | A | 8/2004 |
| JP | 2004275314 | A | 10/2004 |
| JP | 2004313251 | A | 11/2004 |
| JP | 2005087625 | A | 4/2005 |
| JP | 2008142337 | A | 6/2008 |
| JP | 2008289634 | A | 12/2008 |
| JP | 2009095360 | A | 5/2009 |
| WO | 9609782 | A1 | 4/1996 |
| WO | 9713431 | A1 | 4/1997 |
| WO | 9719617 | A2 | 6/1997 |
| WO | 9801056 | A1 | 1/1998 |
| WO | 9960889 | A2 | 12/1999 |
| WO | 03047400 | A2 | 6/2003 |
| WO | 2004021830 | A1 | 3/2004 |
| WO | 2005098159 | A2 | 10/2005 |
| WO | 2005120288 | A1 | 12/2005 |
| WO | 2006029895 | A1 | 3/2006 |
| WO | 2008041873 | A2 | 4/2008 |
| WO | 2008150717 | A2 | 12/2008 |
| WO | 2009052656 | A1 | 4/2009 |
| WO | 2009154983 | A2 | 12/2009 |

OTHER PUBLICATIONS

PCT International Search Report and Written Opinion, PCT/US2011/038899, Nov. 23, 2011.

PCT International Search Report and Written Opinion, PCT/US2011/038892, Nov. 24, 2011.

Unifor Misura St Catalog, 1986.

(56) References Cited

OTHER PUBLICATIONS

Unifor Luca Meda Catalog.

Unifor Pannelli PL Catalog.

Unifor Progetto 25.90 Catalog, 1991.

European Patent Office, Examination Report, Application No. 11726566.0, Sep. 24, 2013, 4 pages.

The State Intellectual Property Office of the People's Republic of China, First Office Action and Search Report, Application No. 201180027125.8, Jul. 30, 2014, 16 pages.

European Patent Office, Extended European Search Report, EP Application No. 14166432.6, May 26, 2014.

European Patent Office, Extended European Search Report, EP Application No. 14157546.4, May 15, 2014.

European Patent Office, Extended European Search Report, EP Application No. 14162832.1, Apr. 24, 2014.

European Patent Office, Examination Report, EP Application No. 11725579.4, Oct. 9, 2013.

Applicant, Response to Oct. 9, 2013 Examination Report, EP Application No. 11725579.4, Feb. 19, 2014.

European Patent Office, Further Examination Report, EP Application No. 11725579.4, Mar. 17, 2014.

Applicant, Response to Sep. 24, 2013 Examination Report, EP Application No. 11726566.0, Mar. 10, 2014.

European Patent Office, Further Examination Report, EP Application No. 11726566.0, Mar. 31, 2014.

* cited by examiner

FRAME TYPE TABLE ASSEMBLIES

CROSS-REFERENCE TO RELATED APPLICATIONS

This application claims priority to and adds specification to U.S. provisional patent application No. 61/350,726 which was filed on Jun. 2, 2010 and which was titled "Frame Type Table Assemblies".

STATEMENT REGARDING FEDERALLY SPONSORED RESEARCH OR DEVELOPMENT

Not applicable.

BACKGROUND OF THE INVENTION

The field of the invention is desks or tables and more specifically desk or table assemblies that include leg members, work surfaces, storage components and wire management components that can be configured and assembled to form one or a plurality of different workstation arrangements using a small number or no tools.

The office furniture industry is always evolving to meet the needs of customers. Benching systems have been developed that can be used in large open spaces to provide either temporary or permanent workstations for one or more employees. To this end, known benching systems typically include a leg structure that supports one or more desk or table top surfaces for use by one or more employees. In many cases, additional top members and leg structures can be added to an initial configuration to add additional employee workstations. Known designs often include some type of wire management system mounted to the undersurfaces of the top members for hiding power and/or data cables needed to support users at the workstations. Power receptacles are typically provided below or at the top surfaces for powering devices (e.g., computers, chargers, lighting, etc.). Storage requirements are often met by providing case goods that either mount to the undersurfaces of the top members or in some fashion to the leg structures. Other accessories such as computer shelves, screens, lighting devices, paper holders and the like are known and often are mechanically mounted to undersurfaces or edges of the top members or to the support leg structure.

While benching systems have proven particularly useful in certain applications, known benching systems have several shortcomings. First, some benching systems have been designed to have a minimal number of component parts and are supposed to be easy to assemble without the use of tools or with minimal tool use. Unfortunately, in these cases, the resulting benching assemblies are often wobbly and do not have a quality look and feel after assembly and during used.

Second, some benching systems have been developed that include a large number of components and mechanical linkages between components in order to provide a relatively high quality look and feel. Here, however, quality look and feel and accessory support typically increase expense appreciably and, because of their relative complexity, these systems typically require multi-step assembly of a large number of components and use of many specialized tools which make it difficult at best for an untrained person to assembly a configuration. Moreover, when optimal configuration requirements change (i.e., five workstations are required instead of eight), system complexity discourages reconfiguration resulting in non-optimal use of space.

Third, with the exception of adding on additional workstations to an existing configuration, known benching systems are not particularly reconfigurable for purposes other than workstation use. Thus, for instance, where a benching assembly currently includes eight workstations in a four facing four configuration and only five workstations are required, it may be advantageous to be able to reconfigure the configuration so that two of the stations could be used as general seating in the area and a third of the stations could be eliminated. Known benching systems cannot be reconfigured in this manner.

Fourth, no known benching system allows the components of a single workstation assembly to be used in their entirely in a face to face two person workstation assembly which is a particularly useful capability as it enables the useful face to face arrangement while still allowing odd numbers of workstations to be configured together for optimally supporting any number of users.

BRIEF SUMMARY OF THE INVENTION

It has been recognized that a reconfigurable benching system can be provided that includes a simplified core frame structure and an additional small number of components that can be assembled in many different ways to suit optimal configuration requirements and that can be disassembled just as easily to reconfigure when desired. Assembly components have been designed specifically so that assembly thereof is intuitive, easy, and requires few (e.g., one), if any, tools. The core frame structure is assembled first and thereafter other components are added one at a time until an entire desired configuration is completed. As additional components are added to the core frame structure, the additional components and core frame structure cooperate to increase rigidity of the overall assembly until an extremely sturdy assembly results. The components together act as a web to increase rigidity.

The core frame structure includes first and second leg members and a rigid channel or rail member that extends between and mounts to the first and second leg members. Each leg member includes a horizontal support surface or rail lip that has a length dimension. The channel or rail member can be mounted to each leg member at more than one location along the rail lip. For instance, the channel/rail member can be mounted centrally along each rail lip to divide a frame space between facing surfaces of the leg members into front and rear spaces and different furniture assemblies can be mounted at least partially within the front and rear spaces or the channel/rail member can be mounted at rear ends of the lip members so that the frame space between the leg members resides to a front side of the rail lips and a single furniture assembly can be mounted within the frame space. The channel/rail members is mounted to the legs for sliding movement along the length dimension of the legs so that channel position can be modified quickly.

The components in addition to the leg members and the channel/rail member include support or bracket members, trough members and table top members that can all be mounted within the frame space or generally within a space defined by facing surfaces of the leg members. In some embodiments different table top sizes are optional and a seating or lounge subassembly may also optionally be positioned within a frame space.

For shipping, the assembly components can be disassembled and shipped in relatively small and flat boxes to save costs. To this end, at their base level, most of the assembly components break down into elongated members that can easily stack up into compact spaces.

In at least some embodiments each of the leg members includes oppositely facing lateral surfaces where each of the lateral surfaces forms at least one mounting slot and/or lip members for mounting table top members, trough members, a channel member, etc. Here, a single leg member can be used to support tables, troughs, etc., on either side so that several workstations can be configured in a side-by-side fashion if desired.

Some embodiments include a table assembly comprising at least a first leg member that forms a leg opening and a first support surface and a rigid elongated channel member that forms a channel that extends between first and second ends, at least the first end forming a wire passing opening suitable to pass wires into and out of the channel, the first end supportable by the first support surface in at least first and second different locations, wherein, when the channel is supported by the support surface at either of the first and second different positions, the wire passing opening is aligned with the leg opening so that wires can pass through the leg opening and into the channel. Some embodiments further include a second leg member that forms a leg opening and a second support surface and wherein the second end of the rigid elongated channel member forms a wire passing opening suitable to pass wires into and out of the channel, the second end supportable by the second support surface in at least first and second different locations wherein, when the channel is supported by the second support surface at either of the first and second different positions, the wire passing opening is aligned with the leg opening so that wires can pass through the leg opening and into the channel.

Some embodiments further include at least a first table top member supported by and extending between the first and second leg members on a first side of the channel member. Some embodiments further include at least a second table top member supported by and extending between the first and second leg members on a second side of the channel member when the channel member is supported by the leg members in the second locations.

In some cases the channel member and channel are a first channel member and a first channel, respectively, the assembly further including at least a second rigid elongated channel member that forms a second channel that extends between first and second ends, at least the first end of the second channel member forming a second wire passing opening suitable to pass wires into and out of the second channel, the first end of the second channel member supportable by the first support surface in at least first and second different locations wherein the second channel is aligned with the first channel when the first and second channels are aligned at the first locations and the second channel is aligned with the first channel when the first and second channels are aligned at the second locations.

In some cases, when the first and second channel members are supported by the leg member at the first and second locations, respectively, the first and second channels are misaligned and each opens into the leg opening. In some cases the channel member is supported by the support surface for sliding movement between the first and second locations. In some cases the support surface forms a leg lip and the channel member includes a channel lip that mates with the leg lip to attach the first end of the channel member to the first leg member.

In some cases the channel member further includes a coupler pair located at the first end of the channel member, the coupler pair including a stationary finger located on one side of the wire passing opening and a moveable finger located on an opposite side of the wire passing opening and a mechanical activator for moving the moveable finger toward and away from the stationary finger, the leg member forming first and second spaced apart coupling members wherein the stationary finger engages the first coupling member and the mechanical activator is adjusted to move the moveable finger into engagement with the second coupling member to secure the channel member to the leg member in either of the first and second locations.

In some cases the leg member includes first and second spaced apart rails that form the first and second coupling members. In some cases the first and second coupling members include first and second lip members that extend toward each other and wherein the stationary finger and the moveable finger include finger extensions that extend generally in opposite directions, the fingers engaging the lip members. In some cases the mechanical activator is located within the channel when the moveable finger is moved away from the stationary finger. In some cases the moveable finger member forms a threaded aperture and the mechanical activator includes a bolt that is threadably received in the aperture.

Other embodiments include a table assembly comprising first and second legs, each leg forming a first substantially horizontal elongated surface, support rail forming a support surface and extending between first and second ends, the first and second ends of the rail supported by the first and second legs, respectively, the support rail positionable at different locations along the elongated surfaces and a table top supported by the support surface between the first and second legs and positionable with the support rail at different positions adjacent the legs.

In some cases the support rail forms a wire management channel. In some cases the support surface is formed along a first edge of the wire management channel and wherein the table top includes a rear edge that is supported by the support surface so that the channel is located rearward of the table top. Some embodiments further include a power receptacle located in the wire management channel. Some embodiments further include first and second couplers located at the first and second ends of the wire management channel for releasably securing the wire management channel at different positions along the first elongated surfaces. In some cases each first surface forms a leg lip and wherein the wire management channel includes a stationary finger member at each end that mate with the leg lips to support the wire management channel between the legs for sliding motion along the leg lips.

In some cases each of the first elongated surfaces is an upper elongated surface and each leg member further includes a second lower elongated surface that is spaced vertically below and substantially parallel to the upper elongated surface. some cases each upper elongated surface forms an upper leg lip, each second elongated surface forms a lower leg lip, the wire management channel including first and second couplers at first and second ends, respectively, each coupler includes a stationary finger member and a moveable finger member that engage the lower and upper leg lips on an adjacent leg member, respectively, to secure the channel member to the leg members.

In some cases the upper and lower leg lips on the first leg extend toward each other and wherein the upper and lower leg lips on the second leg extend toward each other. In some cases the wire management channel forms first and second channel openings at the first and second ends and the first and second channel openings are aligned with the space between the upper and lower elongated surfaces of the first and second legs.

In some cases the first and second legs include facing surfaces and wherein the rail and that table top are located between the facing surfaces of the first and second legs. In some cases the support surface is formed along a first side of the wire management channel and wherein the rail forms a second support surface along a second side of the wire management channel, the table top being a first table top, the assembly further including a second table top supported by the second support surface. In some cases the support rail has a length dimension between the first and second ends, the assembly further including first and second brackets supported by the first and second leg members that support the table top between the legs. In some cases the first and second brackets extend in a direction substantially perpendicular to the length of the support rail.

Still other embodiments include an assembly including a leg member forming a substantially vertical side surface and having front and rear ends wherein a forward direction is from the rear toward the front of the leg member, an elongated support member extending between a connecting end and a distal end and including a connecting portion proximate the connecting end and a distal portion proximate the distal end, the support member forming a support surface, the connecting portion secured to the leg member with the connecting portion adjacent the vertical side surface and the distal portion extending away from the connecting portion in the forward direction and a table top supported by the support surface.

In some cases the leg member includes a front surface and wherein the distal end of the support member extends past the front surface of the leg member. In some cases the vertical side surface forms a slot and the connecting portion includes a lip that is receivable within the slot to secure the support member adjacent the vertical side surface. In some cases wherein the lip member extends along substantially the entire length of the connecting portion and the connecting portion includes substantially half the bracket member. In some cases the leg member includes a substantially horizontal beam member that forms the slot and wherein the slot is formed along at least a portion of the length of the horizontal beam member. In some cases the bracket member can be slid along the slot to be in different positions with respect to the leg member.

In some cases the slot is formed along substantially the entire length of the beam member. In some cases the support member is secured to the leg member for sliding motion there along between at least first and second positions. In some cases the leg member includes a front surface and wherein the distal end of the support member extends past the front surface of the leg member when in the second position.

In some cases the distal end of the support member is rearward of the front surface of the leg member when the support member is in the first position. In some cases the distal portion extends from the connecting portion along a trajectory that forms an angle of less than sixty degrees with the vertical side surface. In some cases the distal portion extends from the connecting portion along a trajectory that forms an angle between five degrees and twenty degrees with the vertical side surface.

In some cases the distal portion is longer than the connecting portion. In some cases the leg member forms a top surface and wherein a top surface of the table top is substantially flush with the top surface of the leg member.

In some cases the leg member and the support member are a first leg member and a first support member, respectively, the assembly further including a second leg member including a second vertical side surface and a second elongated support member extending between a connecting end and a distal end and including a connecting portion proximate the connecting end and a distal portion proximate the distal end, the second support member forming a second support surface, the connecting portion secured to the leg member with the connecting portion adjacent the vertical side surface of the second leg member and the distal portion extending away from the connecting portion in the forward direction where the table top member is also supported by the second support surface. In some cases the first and second support members are securable to the first and second leg members in at least first and second different positions along length dimensions of the vertical support surfaces. In some cases a frame space is formed between facing surfaces of the leg members and wherein, when the support members are in the first positions, the distal ends are within the frame space and when the support members are in the second positions, the distal ends are located forward of the frame space.

Some embodiments include a table assembly comprising first and second leg members that form first and second facing surfaces, respectively, an elongated channel member extending between the first and second leg members and connected at opposite ends between the first and second facing surfaces, the channel member forming a wire management channel along a length dimension and forming at least a substantially horizontal channel support surface along at least a portion of the length dimension, first and second support members mounted to and extending from the first and second facing surfaces, respectively, each support member forming a substantially horizontal support member support surface and a table top assembly supported by the channel support surface and the support member support surfaces.

In some cases the table top assembly includes a table top member having a rear edge and an undersurface wherein a portion of the undersurface adjacent the rear edge is supported by the channel support surface. In some cases the table top assembly includes a table top member and a trough member, the trough member extending between the facing surfaces of the leg members and including a rear edge that is supported by the channel support surface, the trough member forming a front edge that forms a trough support surface, the table top having a rear edge and an undersurface, a portion of the undersurface adjacent the rear edge supported by the trough support surface. In some cases the trough member and the table top member are both supported by the support member support surfaces. In some cases the channel member and the support members are mounted to the leg members for substantially horizontal sliding motion along the facing surfaces of the leg members.

In some cases the leg members each have a front surface and wherein, in at least one position, distal ends of the bracket members extends past the front surfaces of the leg members. In some cases each leg member includes a top surface and wherein a top surface of the table top assembly is flush with the top surfaces of the leg members.

Some embodiments include a table assembly comprising first and second leg members that form first and second facing surfaces, respectively, a frame space located between the facing surfaces of the leg members, each leg member forming a leg member top surface, an elongated channel member connected at opposite ends to the first and second facing surfaces and located within the frame space, the channel member forming a wire management channel along its length, a table top member forming a table top surface and supported by the leg members wherein the table top member is located entirely within the frame space and the table top surface is substantially flush with the leg member top surfaces.

Yet other embodiments include a table assembly comprising a plurality of leg members, each leg member having first and second oppositely facing lateral side surfaces, the leg members spaced apart to define frame spaces between adjacent pairs of the leg members, the frame spaces including at least a first frame space, the leg members including at least a first leg member and a last leg member wherein each of the first and last leg members are only adjacent one other leg member and pairs of table top members including at least a first table top member pair, each table top member pair including first and second table top members supported at least in part within one of the frame spaces and extending between the leg member pair that defines the frame space in which the table pair is supported, the first and second table top members in each pair forming first and second table top surfaces, respectively, where the first and second table top surfaces at the same height.

Some embodiments further include a first end table member supported by the first leg member on a side of the first leg member opposite the one leg member that is adjacent the first leg member, the first end table member forming a top surface that is at the same height as the first and second table top members. In some cases the first end table member forms a semicircular top surface. Some embodiments further include a second end table member supported by the last leg member on a side of the last leg member opposite the one leg member that is adjacent the last leg member, the second end table member forming a top surface that is at the same height as the first and second table top members. In some cases each of the first and second end table members form a semicircular top surface. In some cases each of the leg members forms a top surface and wherein each of the top surfaces of the leg members are at the same height as the top surfaces of the first and second table top members.

Some embodiments further include at least a first trough member mounted in each frame space, each trough member mounted at opposite ends to the leg members that define the frame space in which the trough member is mounted, each trough member including a bottom wall member having a top surface located at a height below the height of the first and second table top members. Some embodiments further include a separate channel member for each of the frame spaces, each channel member mounted at opposite ends to the leg members that define the frame space in which the channel member is mounted, each channel member forming a wire management channel along a length dimension where a top opening opens into the wire management channel. In some cases the assembly includes at least three leg members that define two frame spaces and at least two table top pairs wherein each pair is supported in a separate one of the frame spaces.

Some embodiments include a screen assembly to be used with a table assembly wherein the table assembly includes a channel member having a top surface forming an upwardly open elongated opening having an opening width dimension, the screen assembly comprising at least a first block member including a body member having oppositely facing top and bottom surfaces and oppositely facing first and second side surfaces, the body portion forming a first slot in an upper surface, the first and second oppositely facing side surfaces defining a body width dimension that is less than the opening width dimension, the block member further including first and second flanges that extend laterally from the first and second side surfaces of the body at locations spaced from the bottom surface so that when a portion of the body member adjacent the bottom surface is received in the elongated opening, undersurfaces of the flanges rest on a top surface of the channel and a privacy screen including a rigid member forming an edge wherein the edge is dimensioned to be received within the first slot to form an interference fit with the first block member.

In some cases the top surfaces of the flanges are flush with the top surface of the block member and the top surface of the block member is flat. In some cased the screen assembly is further usable separate from the table assembly with a supporting surface and wherein the bottom surface of the body member forms a second slot, the block member may be inverted so that the top surface rests on the supporting surface with the second slot opening upward and the screen may be mounted in the second slot to support the screen in an upright position. In some cased the second slot member is perpendicular to the first slot. Some cases further include a second block member having characteristics similar to the characteristics of the first block member, the second block member positionable within the channel opening with the first slots of the first and second block members aligned and the screen edge received within each of the aligned slots.

Some embodiments include a support to be used to support a privacy screen in an upright position wherein the screen includes a rigid substantially flat member that forms an edge, the support comprising a block member including top and bottom oppositely facing surfaces and first and second oppositely facing side surfaces, the block member forming a first slot in the top surface that is substantially parallel to the first and second side surfaces and the bottom surface forming a second slot that is substantially perpendicular to the first and second side surfaces wherein the each of the first and second slots has a width dimension such that when the edge of the screen is received therein, the edge forms an interference fit with the slot and flanges which extend in opposite directions from each of the first and second side surfaces of the block member, wherein the block member may be used in either of first and second positions to support the screen including a first position with the top surface resting on a support surface and the screen edge received in the second slot and a second position with the flanges resting on edges of a channel member and the screen edge received in the first slot.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE INVENTION

One or more specific embodiments of the present invention will be described below. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
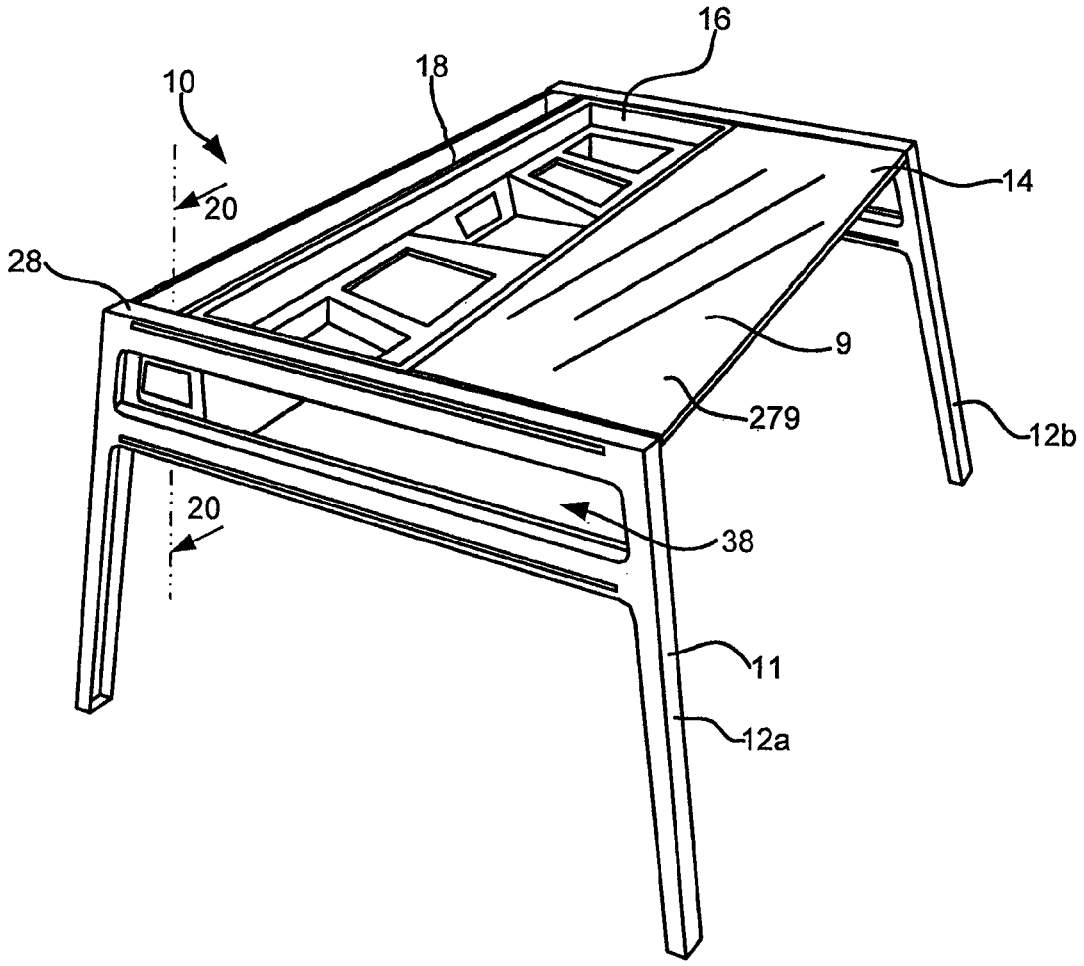
FIG. 1 is a perspective view of the a table/desk assembly that is consistent with at least some aspects of the present invention.
Figure 2:
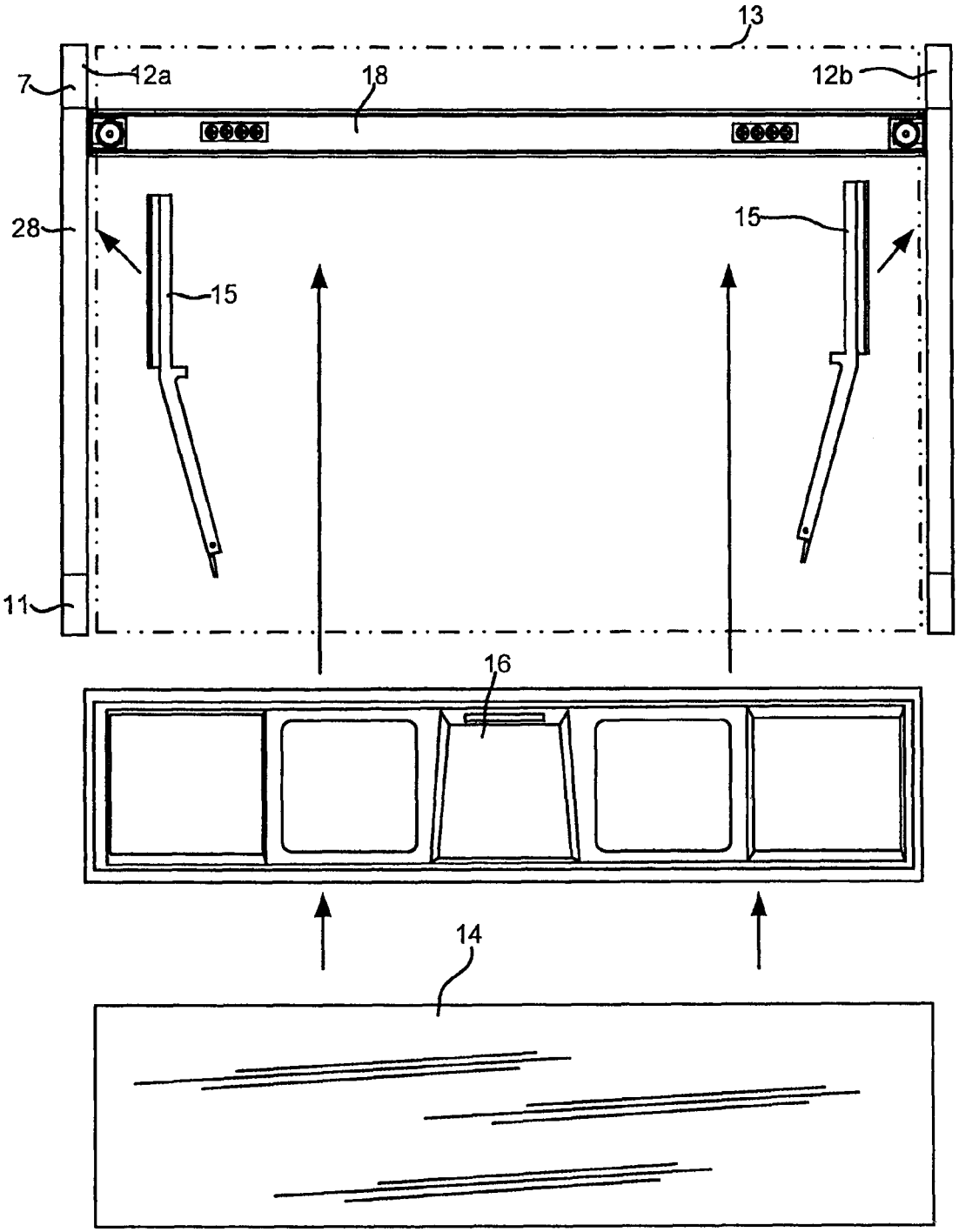
FIG. 2 is a partially exploded top plan view of the assembly shown in FIG. 1.

Referring now to the drawings wherein like reference numerals correspond to similar elements throughout the several views and, more specifically, referring to FIG. 1, the present invention will initially be described in the context of an exemplary single workstation desk/table configuration 10 that includes a small number of basic components. Referring also to FIG. 2, configuration 10 includes first and second leg assemblies 12*a* and 12*b* (also referred to as leg members hereafter), a table top assembly 14, a trough member 16, a wire management channel assembly or member 18 and first and second arm support members 15. In general, the leg assemblies 12*a* and 12*b* are spaced apart such that a frame space 13 (see phantom in FIG. 2) is formed there between. Channel assembly 18 is mounted at opposite ends between the leg assemblies 12*a* and 12*b* and near back or rear portions thereof to form a rigid frame construction. Arm members 15 are mounted to facing surfaces of leg assemblies 12*a* and 12*b* with distal ends thereof extending generally in a direction away from channel assembly 18 (i.e., members 15 extend in a forward direction). Trough member 16 is mounted between leg members 12*a* and 12*b* within frame space 13 and is supported by an adjacent front edge of channel assembly 18 as well as top support surfaces of arm support members 15. Table top member 14 is supported along a rear edge by an adjacent support surface formed by trough member 16 as well as by the distal ends of arm members 15 within frame space 13. Thus, in general all of the configuration 10 components in addition to leg assemblies 12*a* and 12*b* are located within frame space 13 between facing surfaces of assemblies 12*a* and 12*b* after assembly.

Figure 3:
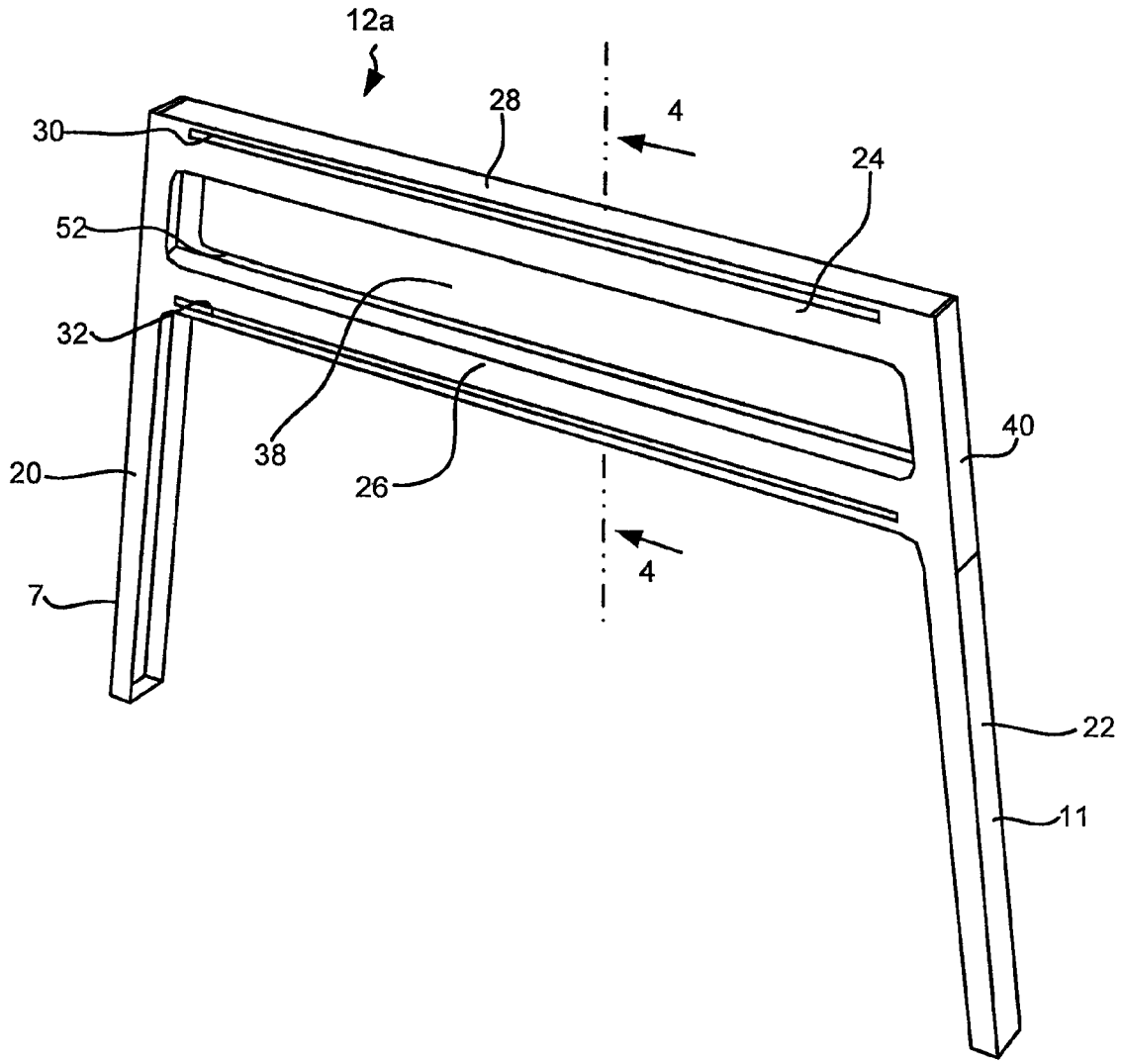
FIG. 3 is a perspective view of one of the leg assemblies shown in FIG. 1.
Figure 4:
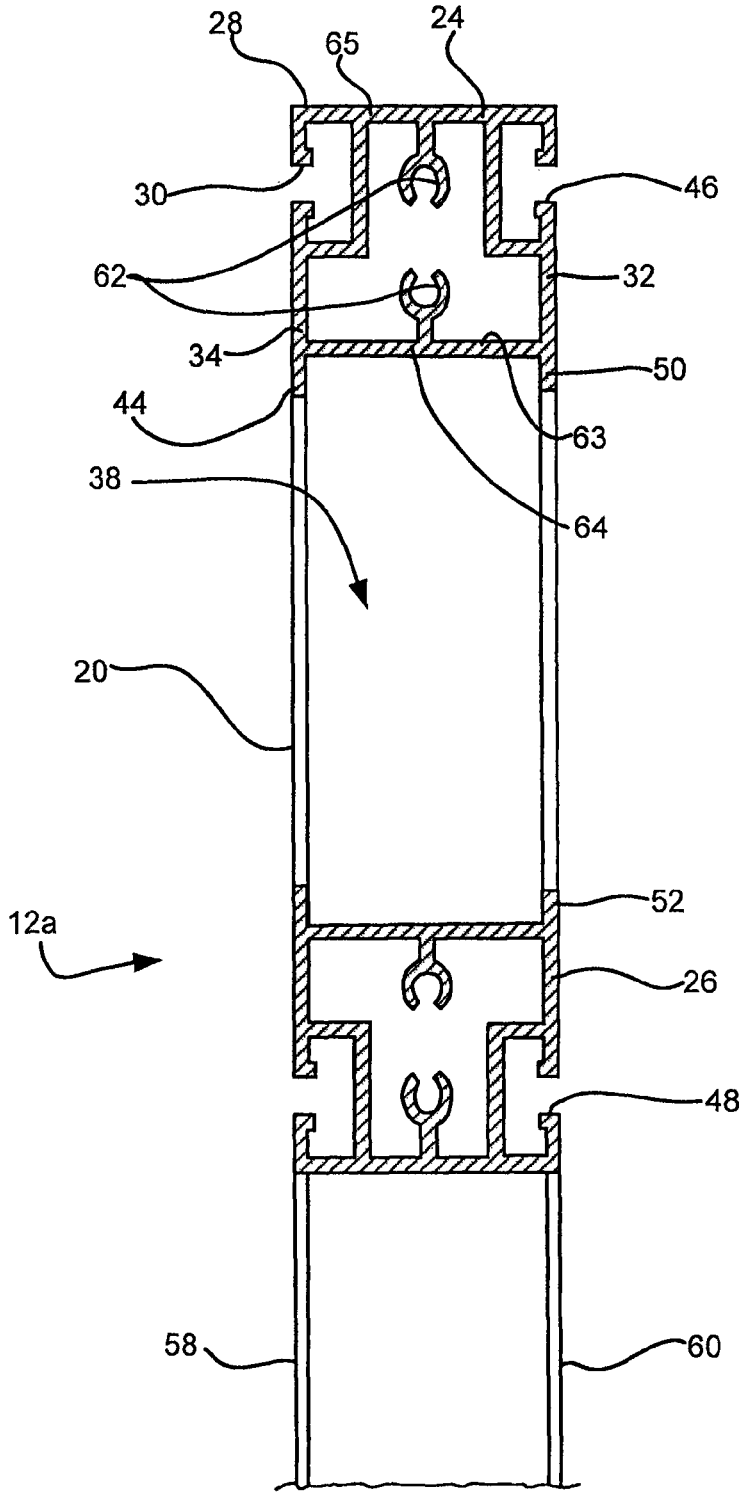
FIG. 4 is a cross-sectional view taken along the line 4-4 in FIG. 3.

Referring again to FIG. 1, each of leg assemblies 12*a* and 12*b* is similarly constructed and operates in a similar fashion and therefore, in the interest of simplifying this explanation, only leg assembly 12*a* will be described here in detail. Referring also to FIGS. 3 and 4, exemplary leg assembly 12*a* includes four elongated members as well as two cover assemblies 40 (only one shown in FIG. 3). The elongated members include first and second generally vertical members 20 and 22, respectively, an upper horizontal rail member 24 and a lower horizontal rail member 26.

Each of the vertical members 20 and 22 is similarly constructed and operates in a similar fashion and therefore, only member 20 is described here in detail. Member 20 has a lower end and an upper end and, referring also to FIG. 5, forms an upper rail mounting plate 70 near the upper end and a lower rail mounting plate 72. The plates 70 and 72 have cross-sections that are similar in shape to the cross-sections of rail members 24 and 26, respectively, and include features that facilitate alignment and connection of the rails to the plates. To this end, plate 70 includes four alignment ribs 74 that extend from the face of the plate 70 and that are received within a slot 63 formed by rail 24 as shown in FIG. 4. Similarly, four ribs 74 are formed on the surface of plate 72 for alignment with a slot (not labeled) formed by rail 26 (see again FIG. 4). A pair of apertures are formed through each of the plates 70 and 72 that align with screw channels (see 62 in FIG. 4) formed by rails 24 and 26, respectively, when the rails 24 and 26 are mounted to the plates 70 and 72.

Figure 5:
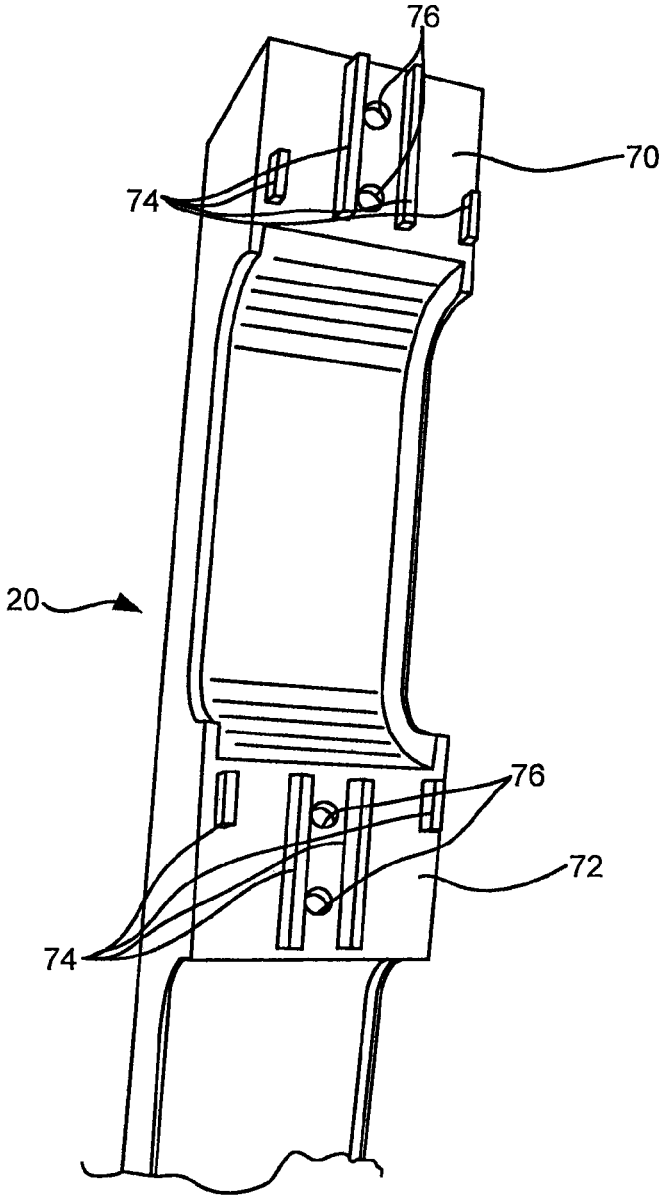
FIG. 5 is a partial perspective view of a top end of one of the vertical members that forms part of the leg assembly shown in FIG. 3.
Figure 6:
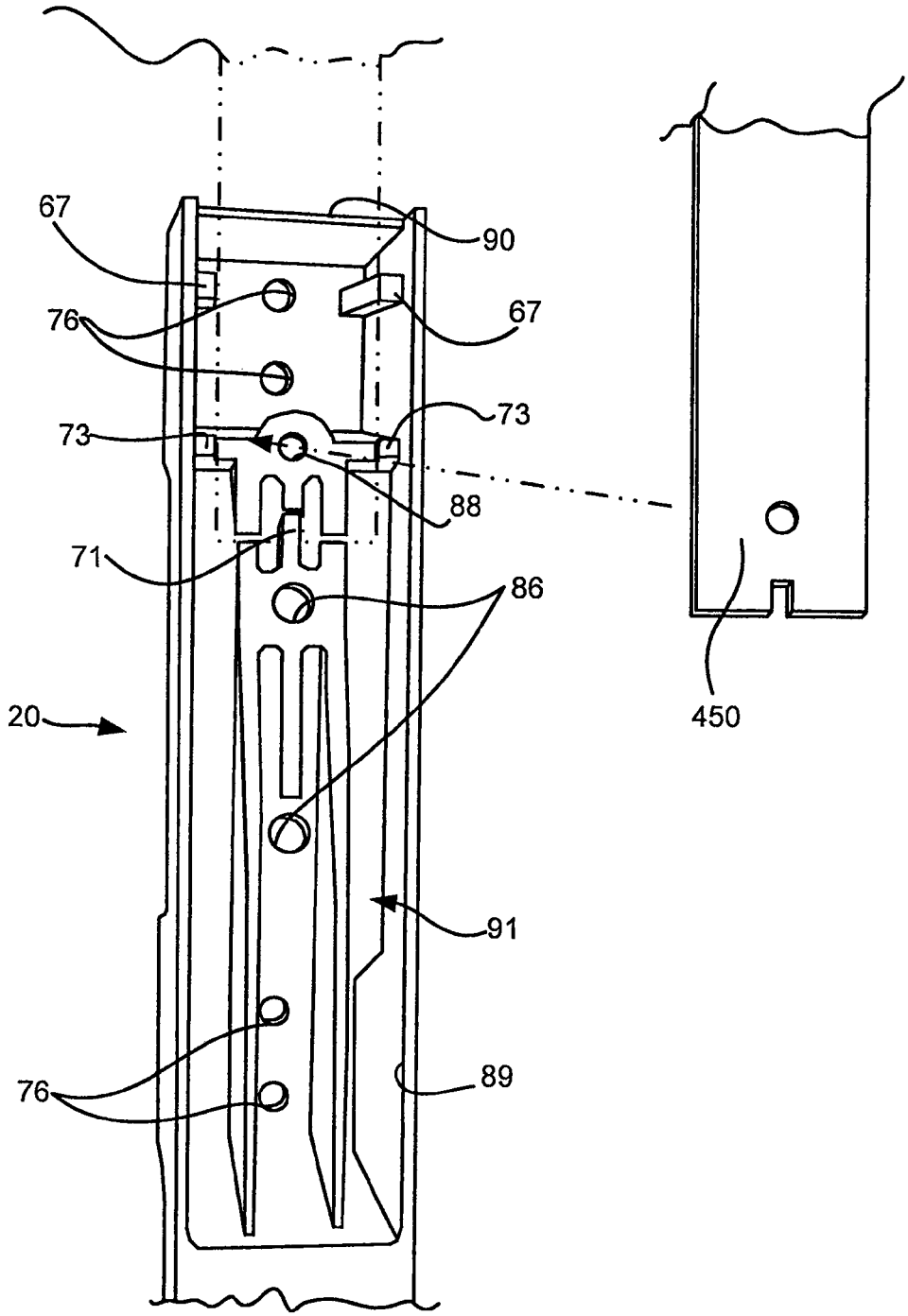
FIG. 6 is a view similar to FIG. 5, albeit showing an opposite side view of the top of the vertical member in FIG. 5.

Referring still to FIGS. 3 through 5 and also to FIG. 6, on a side of member 20 opposite plates 70 and 72, member 20 forms an opening 89 into a recessed space 91 where bolt heads associated with bolts that extend through openings 76 can be recessed. Opening 89 wraps around a top surface of member 20 to form an upper surface open slot 90 useful for attaching additional components (e.g., an arch) above leg assembly 12*a* (see FIGS. 49 and 50 described below). The structure within the recess also forms two additional openings 86 for securing one of the covers 40 (see again FIG. 3) via screws (see FIG. 7) to member 20 to close off the recessed space 91 and provide a finished look to member 20.

Figure 7:
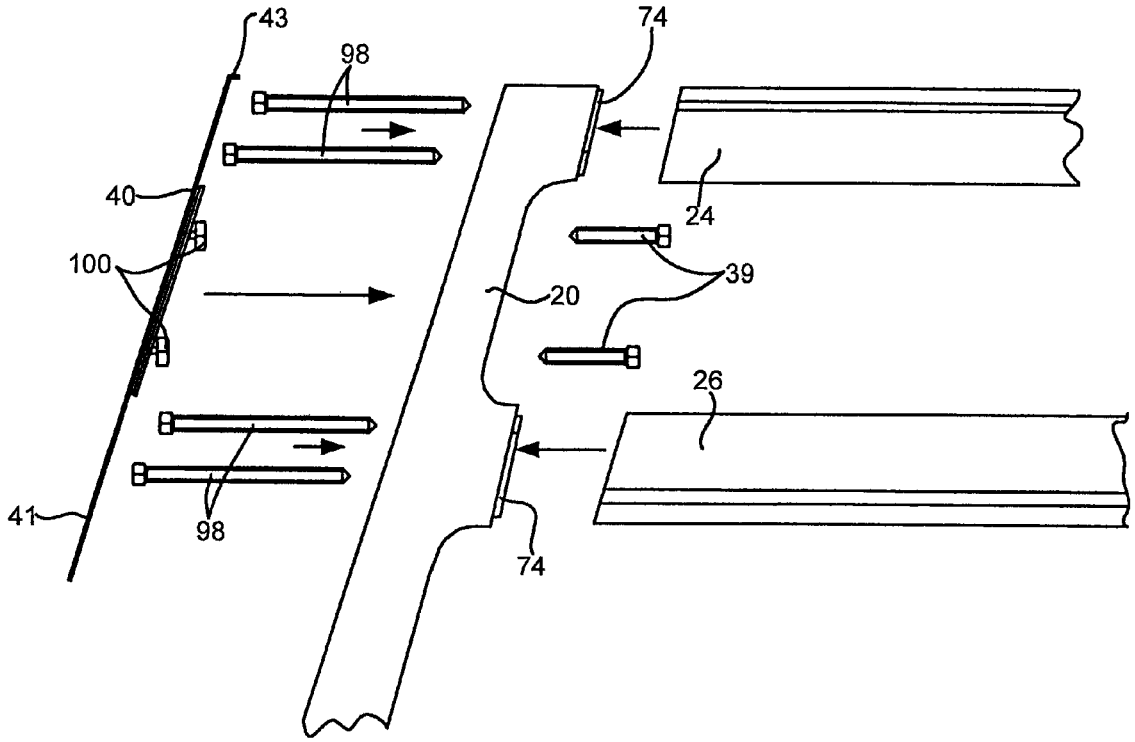
FIG. 7 is a partially exploded view showing various components that form part of the leg assembly shown in FIG. 3.

Referring to FIG. 7, cover assembly 40 includes a generally flat metal cover plate 41 with a lip 43 at a top end as well as two metal posts 100 that form threaded apertures at distal ends where the posts 100 extend from an internal surface of plate 41. Cover 40 is installed by aligning the post 100 apertures with openings 86 and using two screws 39 to secure cover 40 via holes 86. Once installed cover plate 41 is flush with an external surface of vertical member 20.

Referring to FIG. 4, rails 24 and 26 are shown in cross-section. Each of rails 24 and 26 comprises an extruded aluminum member and, as shown in FIG. 4, the rails 24 and 26 have identical cross-sections. When leg assembly 12*a* is assembled, if rail 24 is considered to be upright, rail 26 is inverted with respect to rail 24. Because the rails 24 and 26 have similar cross-sections, only rail 24 will be described here in detail in order to simplify this explanation.

Referring still to FIG. 4, rail 24 is generally square in cross-section and includes a top wall member 65, a bottom wall member 64, and first and second lateral or side wall members 34 and 32, respectively. Rail 24 has a number of interesting characteristics. First, a top surface 28 of top wall member 65 is substantially flat. Second, rail 24 forms T-slots 30 and 46 in opposite side wall members 34 and 32, respectively. Third, rail 24 forms an inverted internal "T" shaped slot 63 that cooperates with ribs 74 (see again FIG. 5) that extend from plate 70 for aligning rail 24 with plate 70 during assembly. Fourth, rail 24 forms two screw channels 62 within internal slot 63 that align with the screw holes 76 formed by member 20 when ribs 74 are received in slot 63. Fifth, side wall members 34 and 32 extend downward past an external surface of lower wall member 64 and thereby form rail lip members or coupling members or fingers 44 and 50, respectively. In FIG. 4, one of the side wall slots 48 and one of the rail lips 52 formed by lower rail member 26 are labeled so those features can be distinguished hereafter.

Referring now to FIGS. 3 and 7, to assemble the rail members 24 and 26 and leg members 20 and 22 to form the leg assembly 12*a*, rails 24 and 26 are aligned with plates 70 and 72 and are moved toward the plates until ribs 74 are received within slots 63 (see also FIGS. 4 and 5) formed by rail members 24 and 26. When ribs 74 are aligned with slots 63, the holes 76 formed by members 20 and 22 are aligned with screw channels 62 formed by rail members 24 and 26. Bolts 98 are slid through holes 76 and are threadably received within channels 62 to secure rail members 24 and 26 to vertical members 20 and 22. Referring again to FIG. 6, upon installation of bolts 98, the bolt heads are received within recesses space 91 adjacent holes 76 and therefore are located within the top ends of members 20 and 22.

Next, covers 40 are aligned with openings 89 at the top ends of members 20 and 22 and are attached by pressing sphere members 100 into openings 86 so that sphere members 100 are frictionally received therein. Referring again to FIGS. 2 through 4, leg assembly 12*a* forms a top surface 28, a front surface 11, a rear surface 7, leg opening 38 and first and second side surfaces 58 and 60 after assembly.

Once rails 24 and 26 are secured to the vertical members 20 and 22, the lips 50 and 52 formed by the bottom walls of the rail members extend toward each other. For example, as shown in FIG. 4, lip member 50 formed by rail 24 is aligned with and extends toward lip member 52 formed by rail member 26. A frame or leg opening 38 is formed between rails 24 and 26.

Referring now to FIGS. 8 through 11, channel assembly 18 includes an elongated rigid housing member 110, a plurality of receptacles 112 and 113 and first and second clamping coupler assemblies or expansion jaw assemblies 114 and 116. Housing member 110 is generally formed of bent sheet metal and extends between first and second opposite ends 121 and 123, respectively. The housing member 110 forms an upper channel or cavity 126 and a lower channel or cavity 132. To form the channels, housing member 110 includes first and second side walls 118 and 120 on front and rear sides, respectively, a bottom wall 122 and an intermediate dividing or floor member 127. A top end of the housing 110 is open at 125 along a channel length dimension. The side walls 118 and 120 are generally vertical and angle away from each other generally from top to bottom to a small degree (e.g., a 10° angle with respect to vertical).

Each of the side wall members 118 and 120 forms openings (see 150 in FIG. 8) for passing power or data wires into and out of the upper channel 126. In addition, each of the wall members 118 and 120 forms other openings for receiving power outlet receptacles 112 that can be arranged to face the exterior of assembly 18 so that the outlets are accessible from outside assembly 18. In the illustrated embodiment shown in FIG. 8, each of the wall members 118 and 120 forms a single access opening 150 as well as a single central power receptacle opening for mounting a receptacle 112 while the openings 150 and receptacle openings may be preformed, in some embodiments knockout panels may be formed within the openings where the panels initially close the openings and can be removed by a user if desired by applying force to the panels. An exemplary knockout panel 800 is shown in phantom in FIG. 8.

Figure 10:
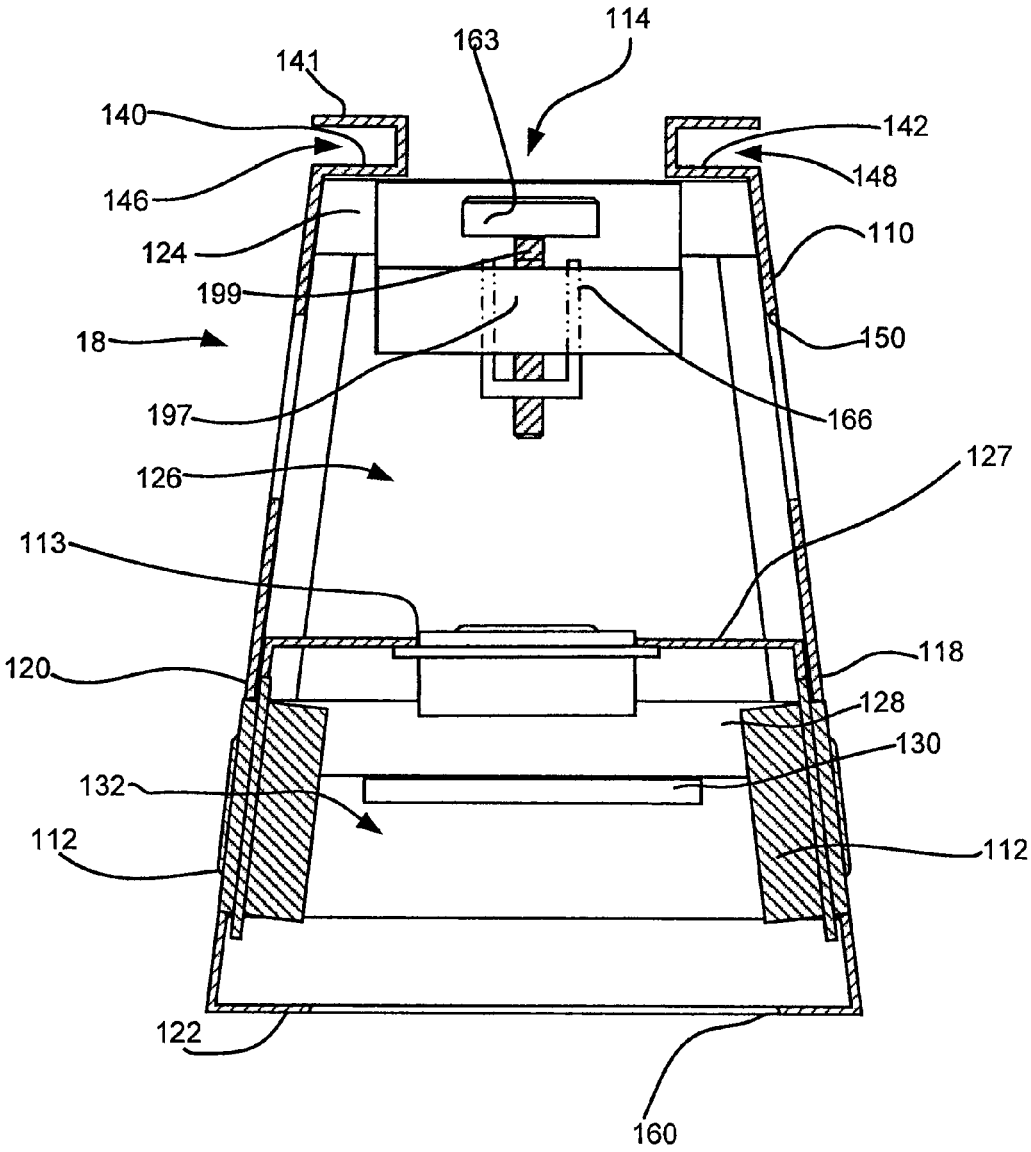
FIG. 10 is a cross-sectional view taken along the line 10-10 in FIG. 9.

Referring now to FIG. 10, at a top end wall member 118 is bent toward wall member 120, then upward and again outward thereby forming an elongated channel 148 and a channel support surface 142 along a length dimension of the housing 110 that extends between the first and second ends 121 and 123, respectively. Similarly, along a top edge, wall member 120 also forms an channel 146 and a support surface 140 along its length dimension where channel 146 opens in a direction opposite the direction in which channel 148 opens channel housing 110 forms a top surface 141 (see FIG. 10).

Referring still to FIGS. 8 through 11, bottom wall member 122 generally closes off the space between lower edges of side wall members 118 and 120 and extends between the first and second ends 121 and 123, respectively. Bottom wall member 122 forms relatively large openings 160 (see FIGS. 10) along its length for allowing power or data cables to be strung into an out of the lower channel 132 and to allow access to components mounted within housing 110 for installation, adjustment, etc.

Figure 9:
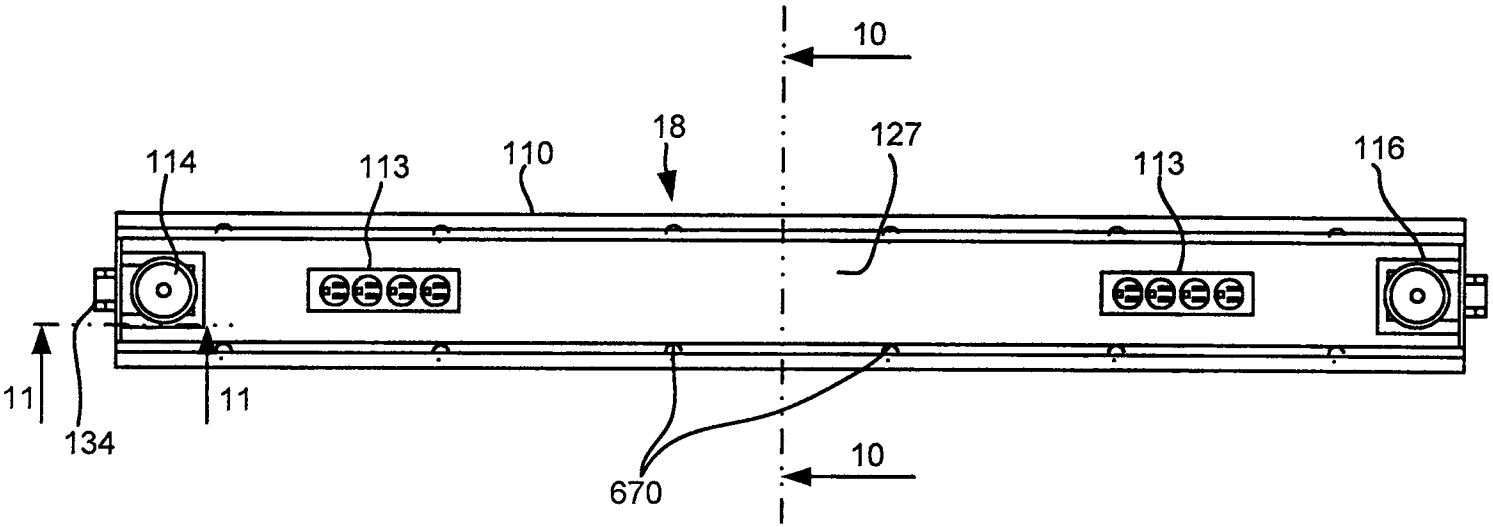
FIG. 9 is a top plan view of the channel assembly shown in FIG. 8.

Referring specifically to FIGS. 9 and 10, intermediate wall member 127 is mounted between internal surfaces of side wall members 118 and 120 and divides the space between wall member 118 and 120 essentially into the upper and lower channels 126 and 132. Intermediate member 127 forms openings in which additional power or data outlet receptacles 113 are mounted (see FIGS. 9 and 10). Lower channel 132 is used for running power/data wires. Upper channel 126 is used for plugging in cords from lights, computers, etc., and for storing excess power/data connecting cables.

Figure 8:
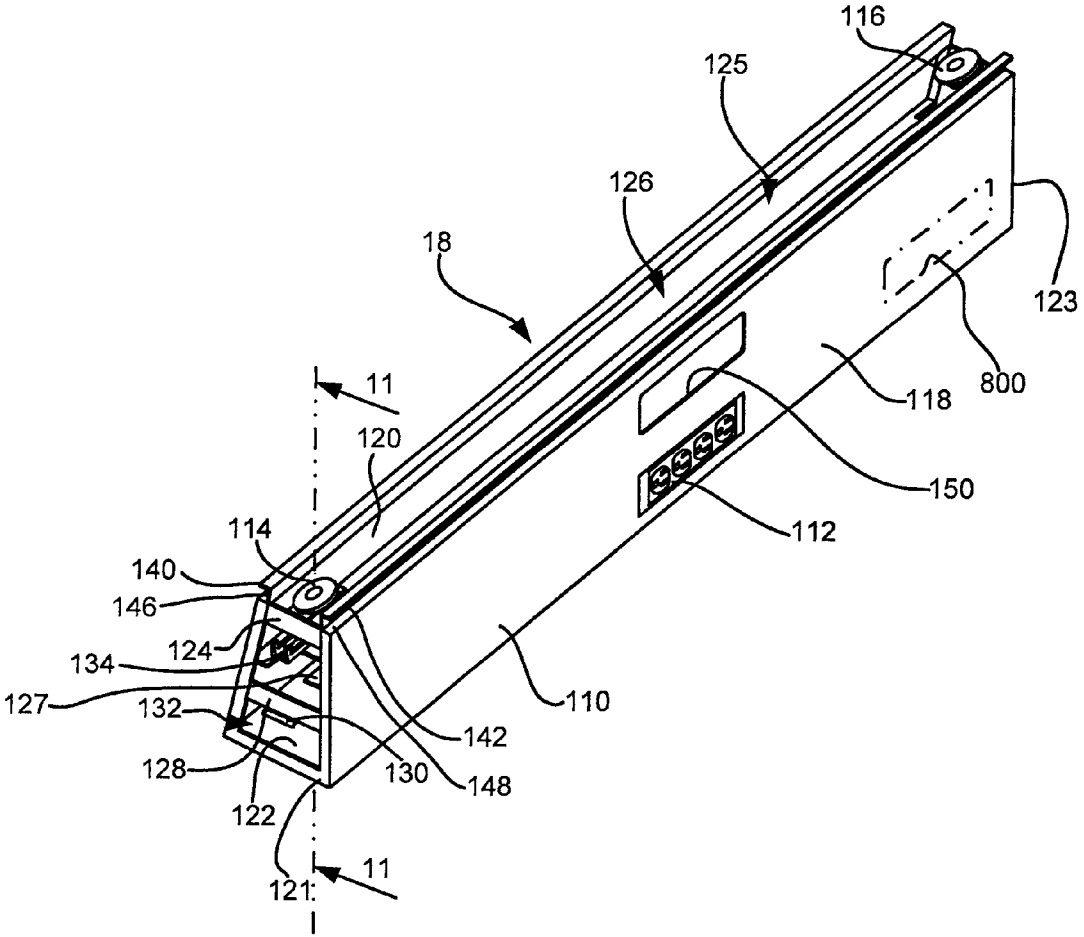
FIG. 8 is a perspective view of the channel assembly shown in FIG. 2.
Figure 11:
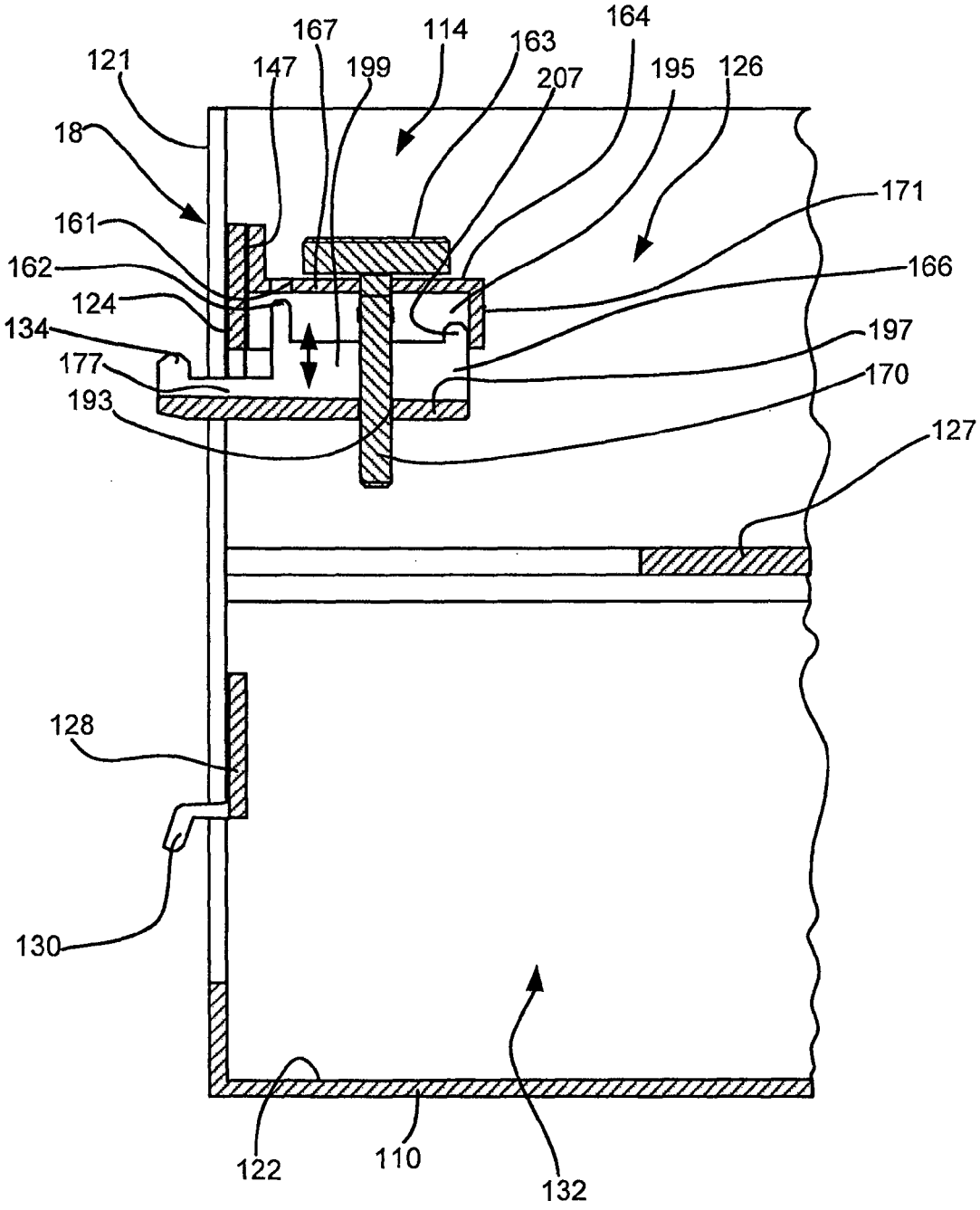
FIG. 11 is a partial cross-sectional view taken along the line 11-11 in FIG. 8.

Referring to FIGS. 8, 10 and 11, at each of the distal ends 121 and 123, assembly 18 includes a rigid metal top cross member 124 and a rigid metal intermediate cross member 128. The top cross member 124 is welded or otherwise attached between top ends of side wall members 118 and 120 and includes an internal surface 147 (see FIG. 11) to which one of the coupling assemblies 114 or 116 is welded or otherwise attached. Intermediate cross member 128 is also a rigid metal member that is welded or otherwise secured between wall members 118 and 120 and includes a lip member or stationary finger or coupler 130 along a lower edge that extends outward and downward from a distal end.

Referring once again to FIGS. 8, 10 and 11, coupling assemblies 114 and 116 are similarly constructed and operate in a similar fashion and therefore, in the interest of simplifying this explanation, only coupling assembly 114 is described in detail. Coupling assembly 114 includes a support bracket 164, a clamping bolt 163 and a coupler block or moveable jaw member 166. Bracket 164 includes an integrally formed flat support plate 167 and a plurality of wall members that extend downward from edges of the support plate 167. One of the downward extending wall members is a guide wall 166 that extends along an edge opposite the edge of plate 167 that is secured to surface 147 (see FIG. 11). Plate 167 forms an opening for passing a threaded shaft 170 of bolt 163 and also forms guide slots 162 (only one shown in FIG. 11) near the edge of plate 167 that mounts to surface 147.

Jaw member 166 is generally U-shaped in cross-section (see FIG. 10) including a flat bottom wall member 197 and first and second parallel wall members 199 that extend along opposite edges of bottom wall member 197. Bottom wall member 197 forms a threaded opening 193 for receiving shaft 170. As best seen in FIG. 11, top edges of side wall members 199 undulate to form a lip or moveable finger member 134 at one end, an intermediate guide finger extension 162 and an end finger extension 207 at a second end opposite lip 134 where lip 134 and extensions 162 and 207 all extend away from bottom wall member 197 in the same direction. The dimensions of, and spacing between, members 134, 162 and 207 are such that when an edge of member 207 contacts an internal surface of wall member 171 (see FIG. 11) with shaft 170 passing through plate 167 and threadably received in opening 193. Finger extensions 162 are aligned with openings 161 in plate 167 and lips 134 extend past an adjacent edge of plate 167.

To install assembly 114, bracket 164 is welded or otherwise secured to cross member 124. Jaw member 166 is placed with intermediate finger members 162 aligned with openings 161 and with finger members 207 adjacent the internal surface of wall member 166 and with the opening in plate 162 aligned with threaded opening 193. Shaft 170 is fed through plate 167 and into opening 193. At this point jaw member 134 extends out an end opening formed by housing 110 as shown in FIG. 11.

Referring again to FIG. 11, as bolt 163 is rotated, jaw member 166 and finger member 134 move up and down. Jaw member 166 is restricted from rotating by intermediate finger members 162 and openings 161 as well as by finger members 207 that ride along the internal surface of wall member 171. Lip 130 and lip 134 form a coupler pair and a similar coupler pair is located at the second end 123 of assembly 18. As illustrated, the bolt 163 and bracket 164 are entirely located inside channel 126.

Figure 12:
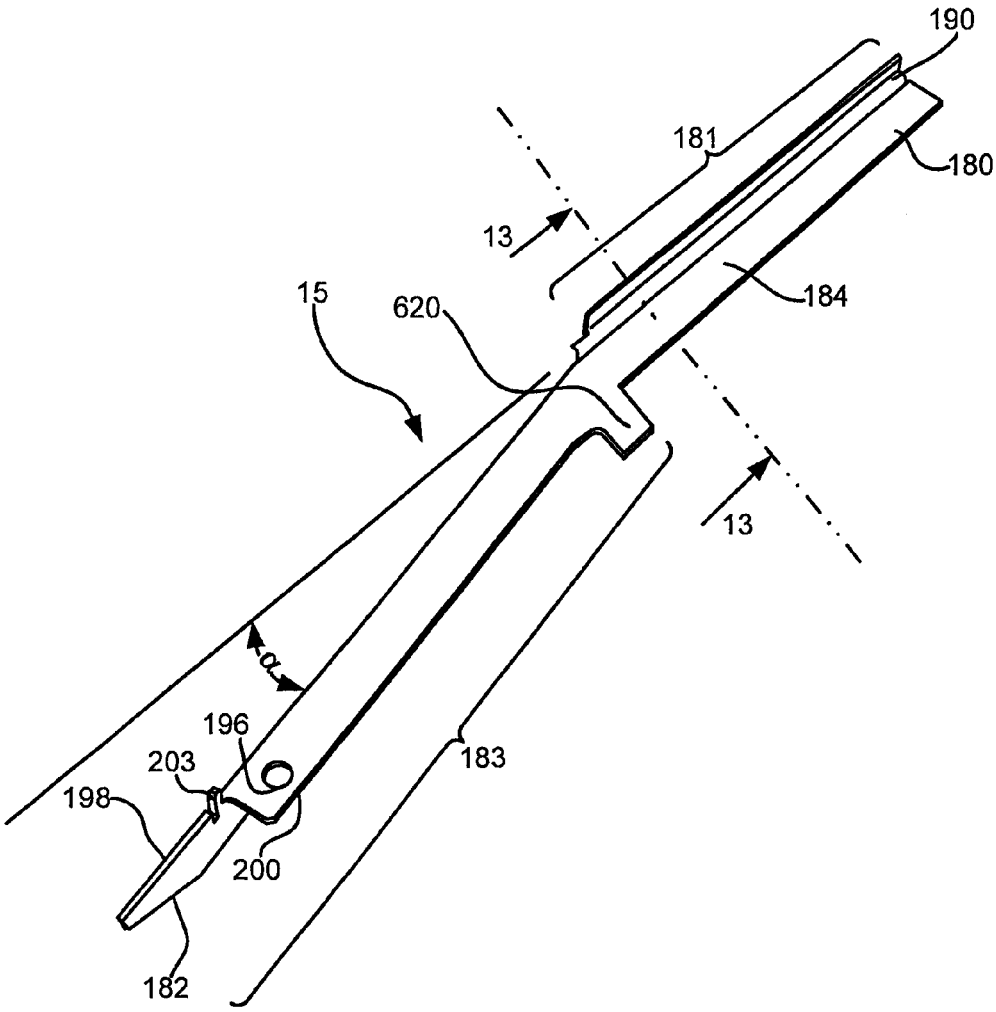
FIG. 12 is a perspective view of one of the support arm members shown in FIG. 2.
Figure 13:
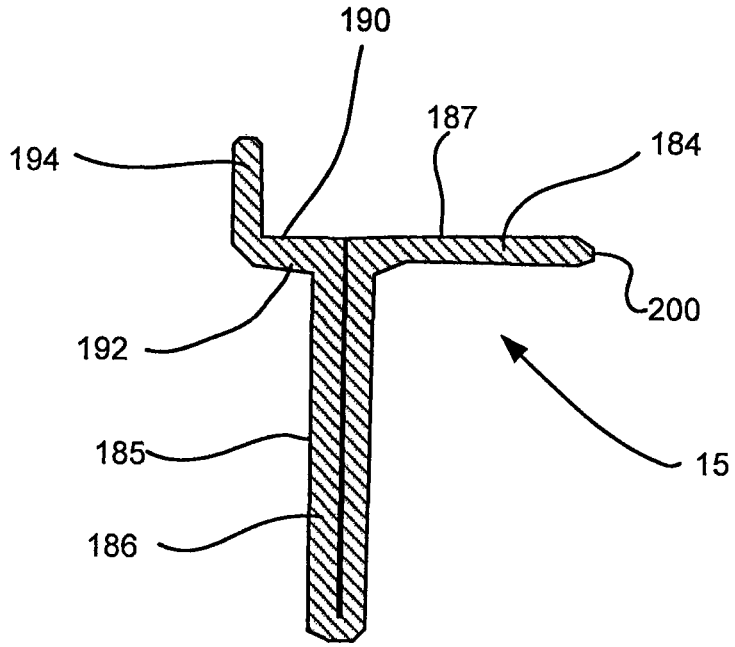
FIG. 13 is a cross-sectional view taken along the line 13-13 in FIG. 12.

Referring again to FIG. 2, each of the arm support or bracket support members 15 is similarly constructed and operates in a similar fashion and again, in the interest of simplifying this explanation, only one of the support members 15 will be described here in detail. Referring also to FIGS. 12 and 13, exemplary support member 15 is a rigid elongated metal member having a proximal or connecting end 180 and a distal end 182 where proximal and distal portions 181 and 183 are located at the proximal and distal ends 180 and 182, respectively. The proximal portion 181 has a generally uniform cross section along its length as shown in FIG. 13 that includes a vertical member 186 and a horizontal shelf member 184 that extends at a right angle from a top edge of vertical member 186. Shelf member 184 has a distal edge 200 along its length. Vertical member 186 forms a bearing surface 185 on a side opposite the side from which shelf member 184 extends.

Figure 26:
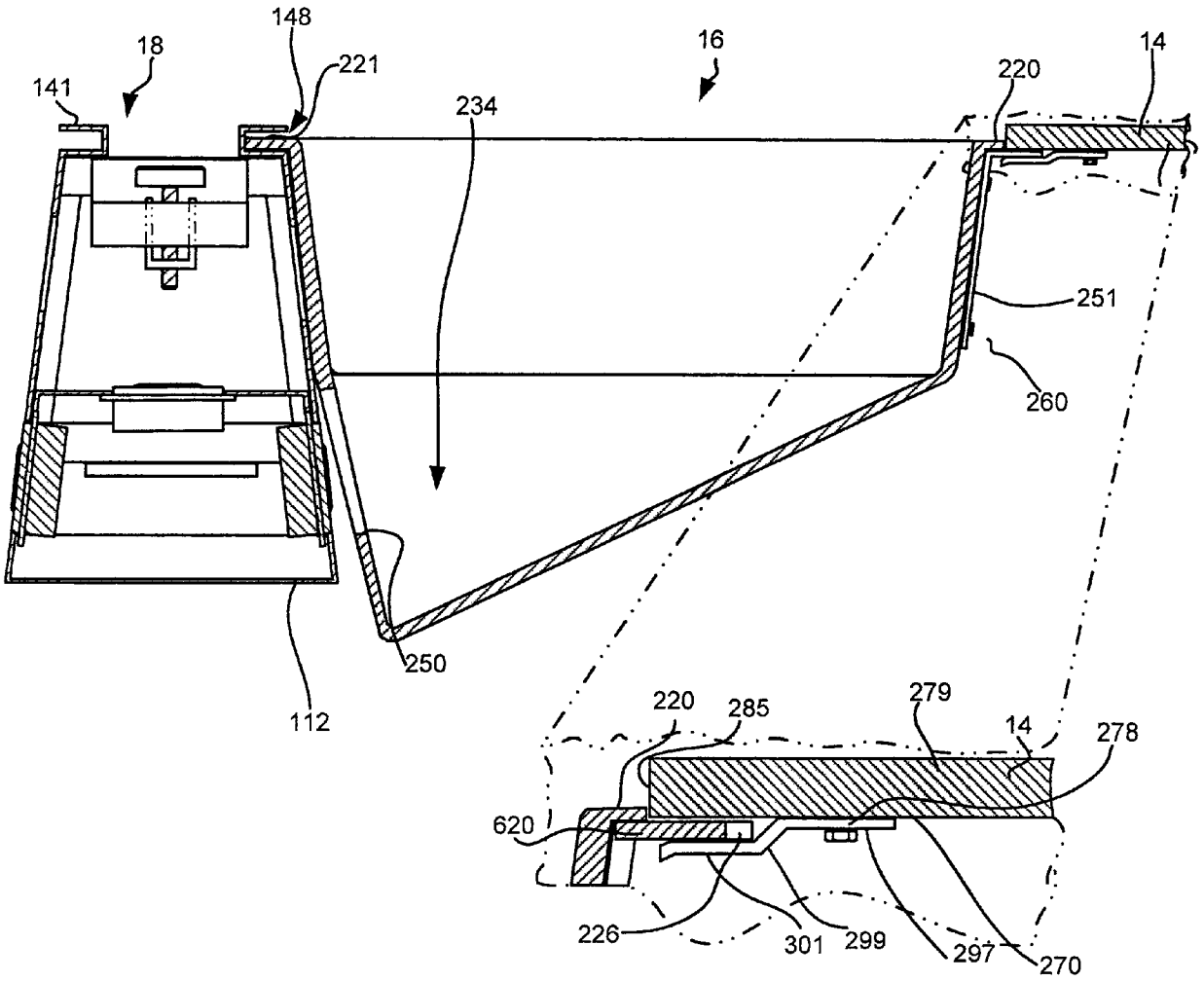
FIG. 26 is a partial cross-sectional view similar to the view of FIG. 10, albeit where a trough member 16 is mounted to a channel assembly and a table top assembly 14 is mounted to the trough member.

Shelf member 184 forms a substantially horizontal upper support surface 187. In addition to vertical member 186 and shelf member 184, proximal portion 181 also includes a lip member 190 that extends from the top end of vertical member 186 along a direction which is generally opposite the direction in which shelf member 184 extends. Lip member 190 includes an arm member 192 and a distal lip or finger member 194 that extends vertically upward from a distal end of member 192. Referring also to FIG. 26, lip member 190 is shaped and dimensioned so as to be receivable within one of the slots (e.g., 46 in FIG. 26) formed by rail member 24 such that vertical member 186 extends vertically downward therefrom and bearing surface 185 rests against the outer surface of the wall member 32 that forms the slot 46 when lip member 90 is received in the slot.

Referring to FIG. 12, the distal portion 183 has a cross section along most of its length that is similar to the cross section in FIG. 13, albeit not including lip member 190. Distal portion 183 extends at an angle $\alpha$ with respect to proximal portion 181. In at least some embodiments angle $\alpha$ is between zero and 60 degrees and in some cases angle $\alpha$ is between ten and twenty-five degrees.

At the distal end 182 member 15 only includes the vertical member 186 and does not include shelf member 184. Shelf member 184 forms an opening 196 near distal end 182 and forms a key member 203 that extends perpendicular to member 184. The distal end of member 186 is referred to hereafter as a finger member 198. Referring again to FIG. 12, a shoulder member 620 extends from an edge of and co-planar with shelf member 184 in a direction opposite lip member 190.

Referring now to FIGS. 14 through 19, exemplary trough member 16 is an elongated rigid body member that extends between first and second opposite ends 216 and 218, respectively. In at least some cases, trough member 16 is formed of rigid plastic via a vacuum forming process that is particularly suited for forming a feature rich trough member that includes a bottom wall member 225 including undulations that can define different trough depths and other interesting features useful for dividing a trough space 228 into several different trough sub-compartments particularly suitable for specific purposes. In other embodiments the trough member may be formed of bent metal.

Figure 15:
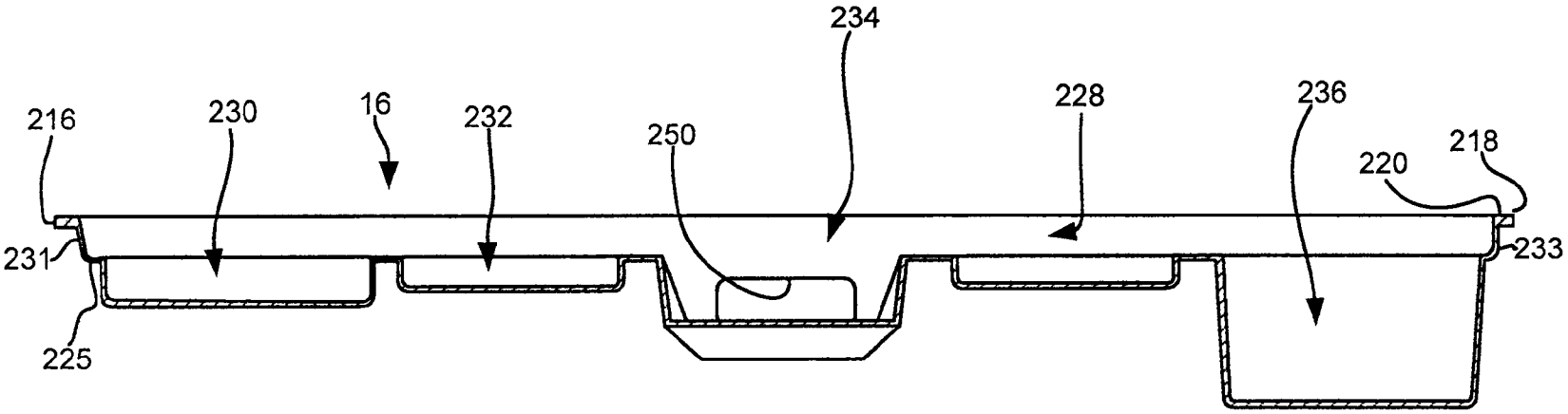
FIG. 15 is a cross-sectional view taken along the line 15-15 in FIG. 14.
Figure 16:
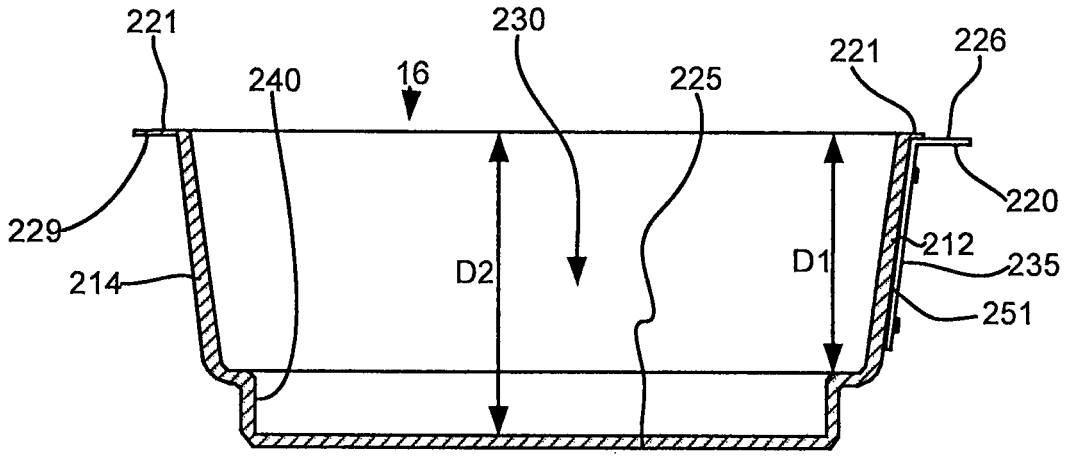
FIG. 16 is a cross-sectional view taken along the line 16-16 in FIG. 14.
Figure 17:
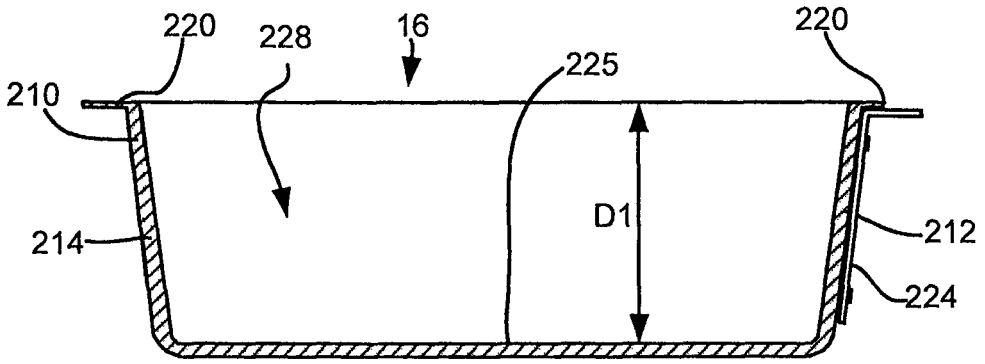
FIG. 17 is a cross-sectional view taken along the line 17-17 in FIG. 14.

Referring specifically to FIGS. 15 and 16, generally, trough member 16 includes a front wall member 212, a rear wall member 214, a first side wall member 231, a second side wall member 233 and a floor or bottom wall member 225. The front and rear wall members 212 and 214 and side wall members 231 and 233 are spaced apart to generally define a rectilinear trough space 228 and bottom wall member 225 generally closes off the bottom end of space 228 while the top end is left open to facilitate access into the trough space. At upper ends of the front and rear wall members 212 and 214 and the side wall members 231 and 233, an outwardly extending lip member 220 is formed. Lip member 220 forms an upper surface 221 as well as a lower surface 229. A trough width dimension generally between the front and rear wall members 212 and 214 is generally between three and twenty-two inches and, in some embodiments is around 18 inches.

Figure 14:
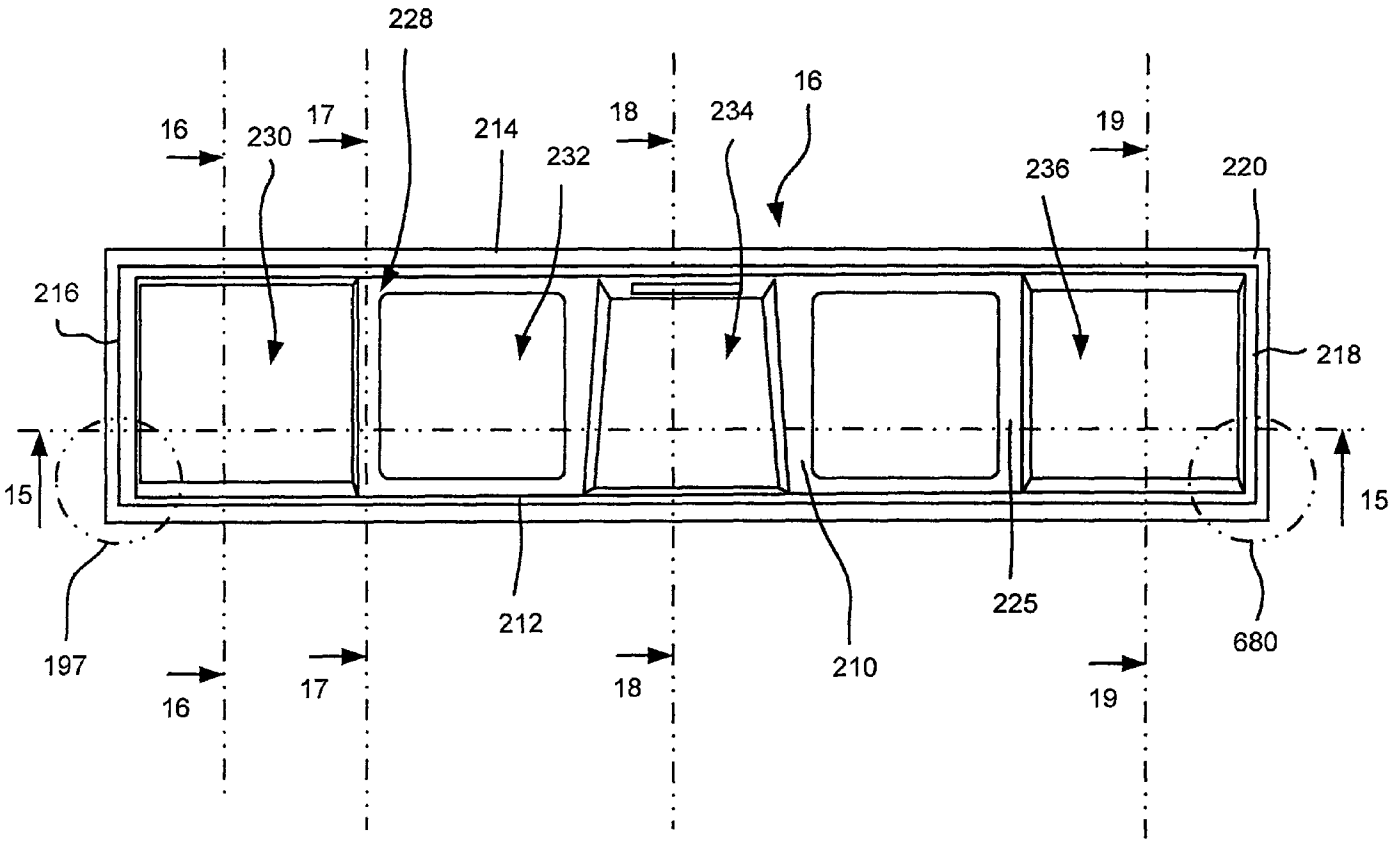
FIG. 14 is a top plan view of the trough member that forms part of the assembly shown in FIG. 1.
Figure 18:
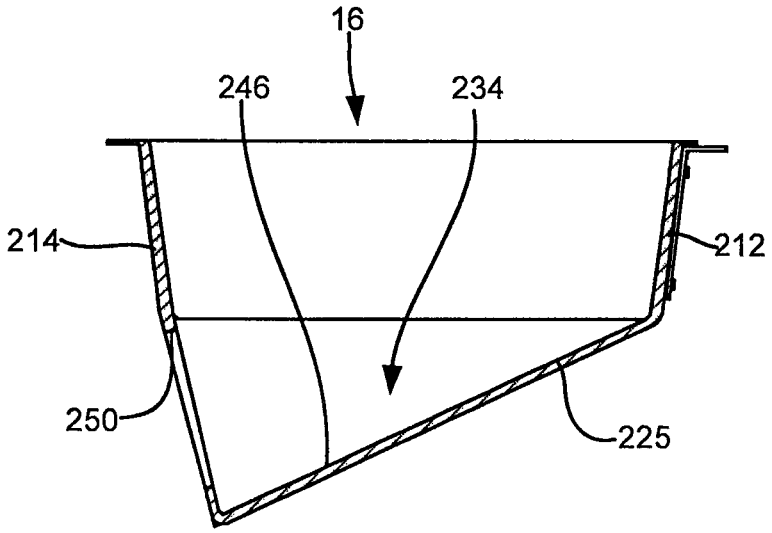
FIG. 18 is a cross-sectional view taken along the line 18-18 in FIG. 14.
Figure 19:
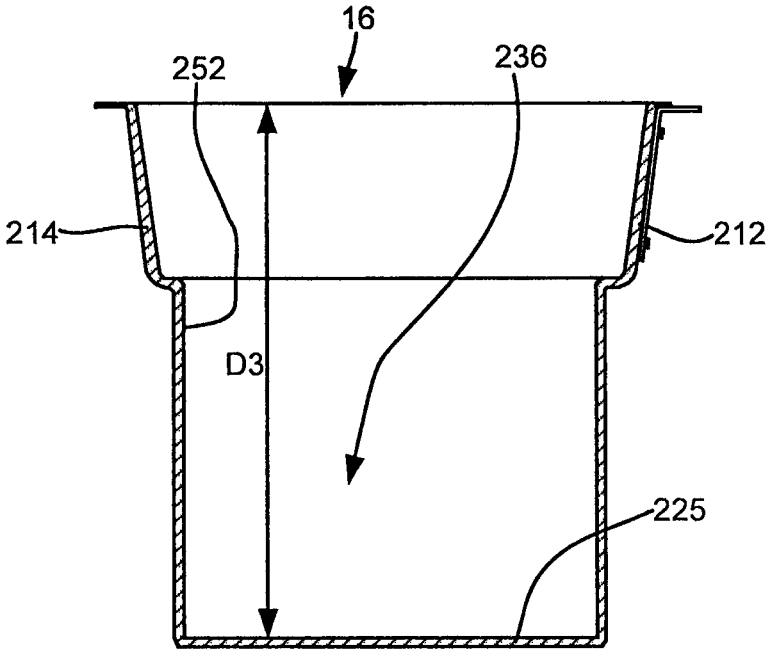
FIG. 19 is a cross-sectional view taken along the line 19-19 in FIG. 14.
Figure 20:
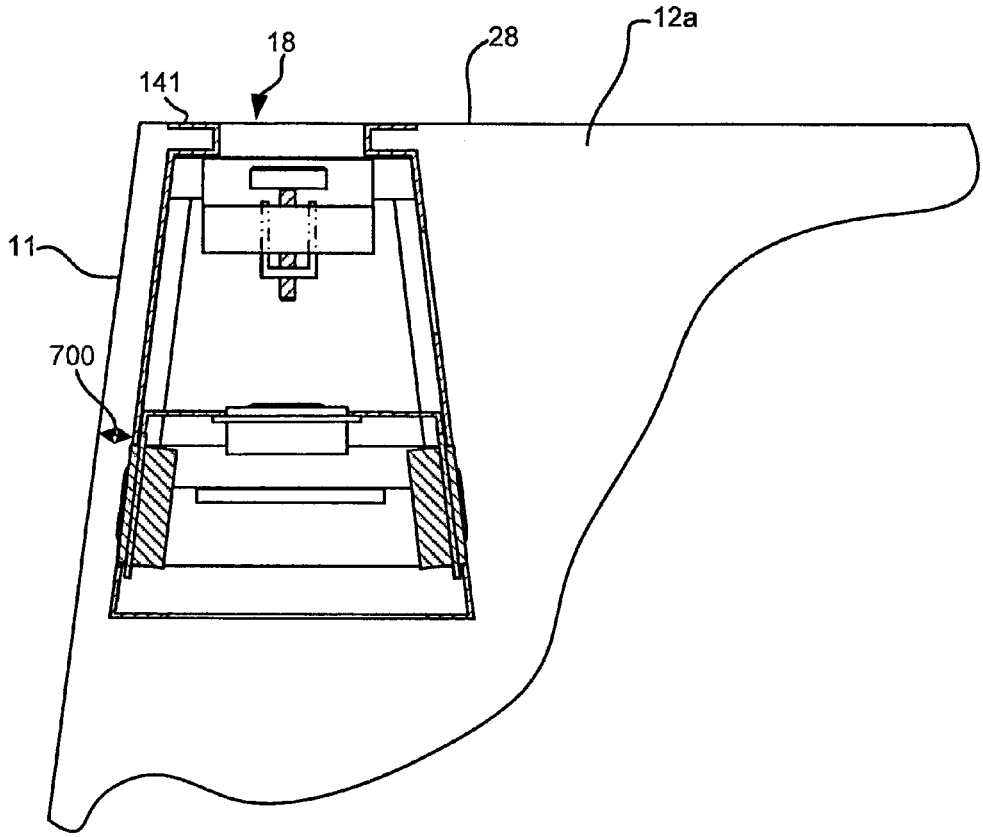
FIG. 20 is a partial cross-sectional view taken along the line 20-20 in FIG. 1.

Referring still to FIGS. 14 through 19, bottom wall member 225 has different depth portions (e.g., from three to twenty inches) along the length dimension of trough member 16. For example, referring to FIG. 17, a general depth portion of trough space 228 is illustrated where the depth is labeled D1. Referring to FIGS. 14, 15 and 16, a left most portion 230 of the trough space forms a further recessed portion 240 having a depth D2 which is greater than depth D1. Here, for instance, depth D2 may be one inch deeper than depth D1 and provide a space for storing pencils, pens, a stapler, a scissors, etc. Referring to FIGS. 14, 15 and 19, at a right most portion of the trough space as illustrated in FIGS. 14 and 15, the lower wall 225 extends to a depth D3 to form a file bin 252 portion suitable for receiving standard size office files or the like.

Figure 25:
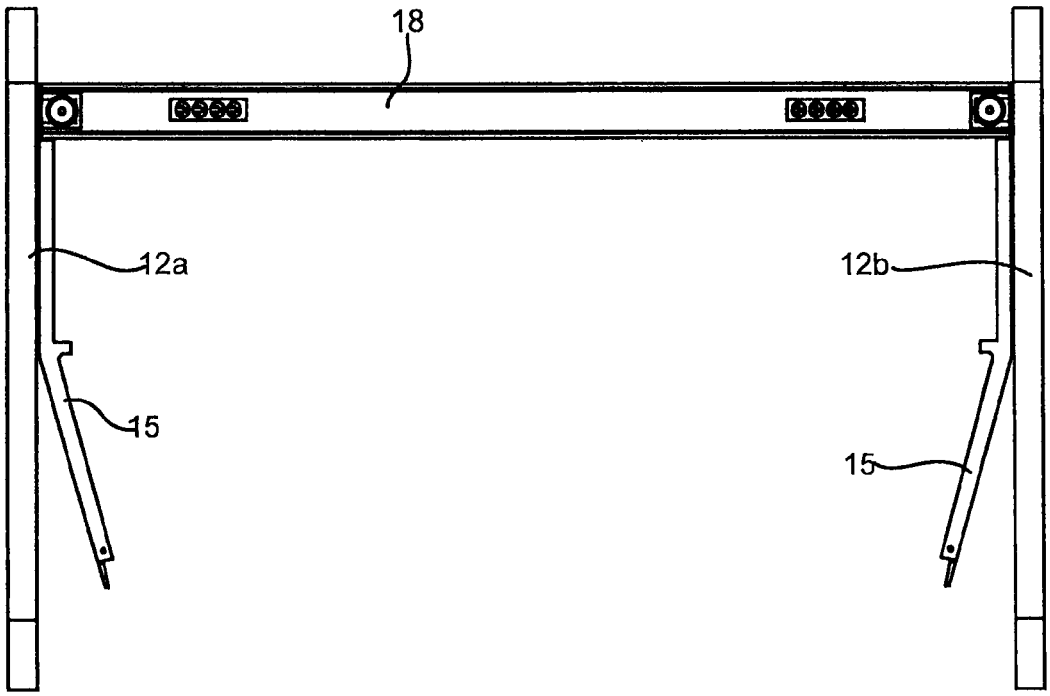
FIG. 25 is a top plan view of a subset of the components that comprise the assembly of FIG. 1 in a partially assembled condition.

Referring still to FIGS. 14 and 15 and also to FIG. 18, centrally, trough bottom wall 225 forms an internal surface 246 that slants from the bottom edge of front wall member 212 downward to a location below the bottom edge of wall member 214 to form a wire access space 234. Here, bottom wall 225 also forms an opening 250 below rear wall member 214. Referring also to FIG. 25, opening 250 is formed at a location that aligns with one of the outlet receptacles 212 mounted in the channel housing member 110 when the overall assembly shown in FIG. 1 is configured.

Because trough member 16 is formed of a plastic material, while rigid, member 16 is also relatively flimsy and therefore, while sufficient for supporting most office supplies, member 16 alone cannot withstand greater loads without potentially bending or flexing along its length dimension. After assembly, as shown in FIG. 25, the rear edge of trough member 16 is received within channel 148 formed by channel housing member 110 and therefore the rear edge of trough member 16 is additionally supported. To help support the front edge portion of trough member 16, a metal stringer member 251 is secured to the outer surface of front wall member 212 just below lip member 220 via screws, rivets, an adhesive, or some other type of mechanical fastener. Stringer member 251 extends the length of trough member 16 between ends 216 and 218 (see again FIG. 14) to provide support along the entire length dimension of trough member 16. As seen in FIG. 16, stringer member 251 is generally L-shaped including a first member 235 and a second or extending member 226 that extends along a length of dimension of member 235 and forms a slightly obtuse angle with member 235. Stringer member 251 is mounted with first member 235 mounted to the external surface of member 212 and member 226 disposed under and extending past a distal edge of lip member 220. The distal portion of extending member 226 forms a top trough support surface (i.e., a support surface associated with the trough member 16 that supports a table top as described hereafter).

Figure 21:
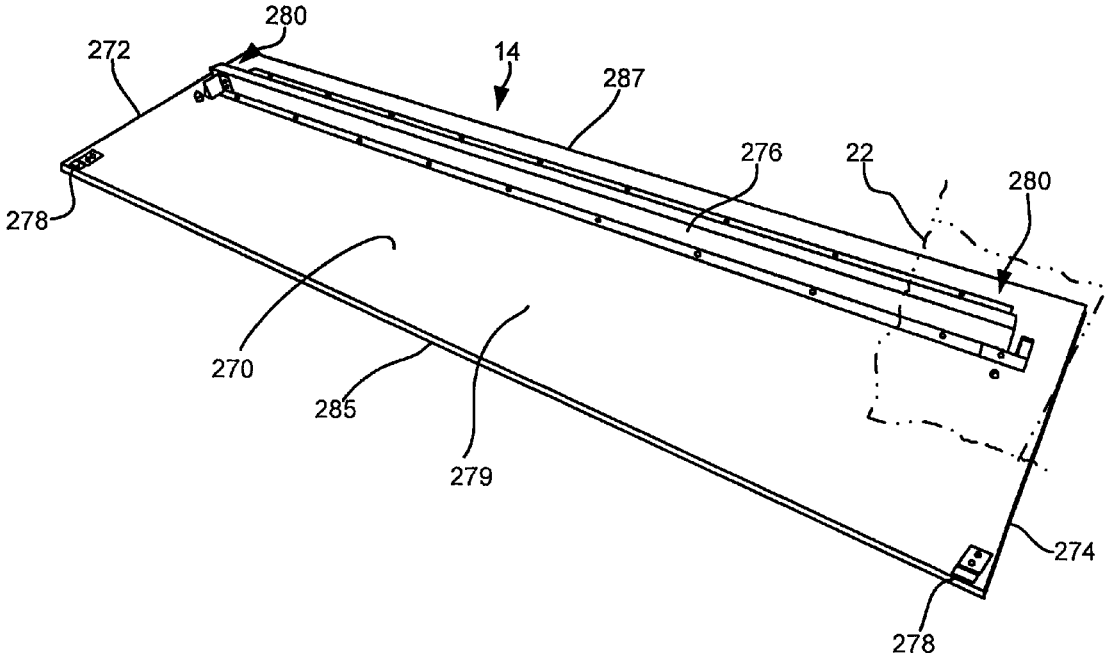
FIG. 21 is a perspective view of the table top assembly shown in FIG. 1, albeit upside down showing an undersurface and structure thereon.
Figure 22:
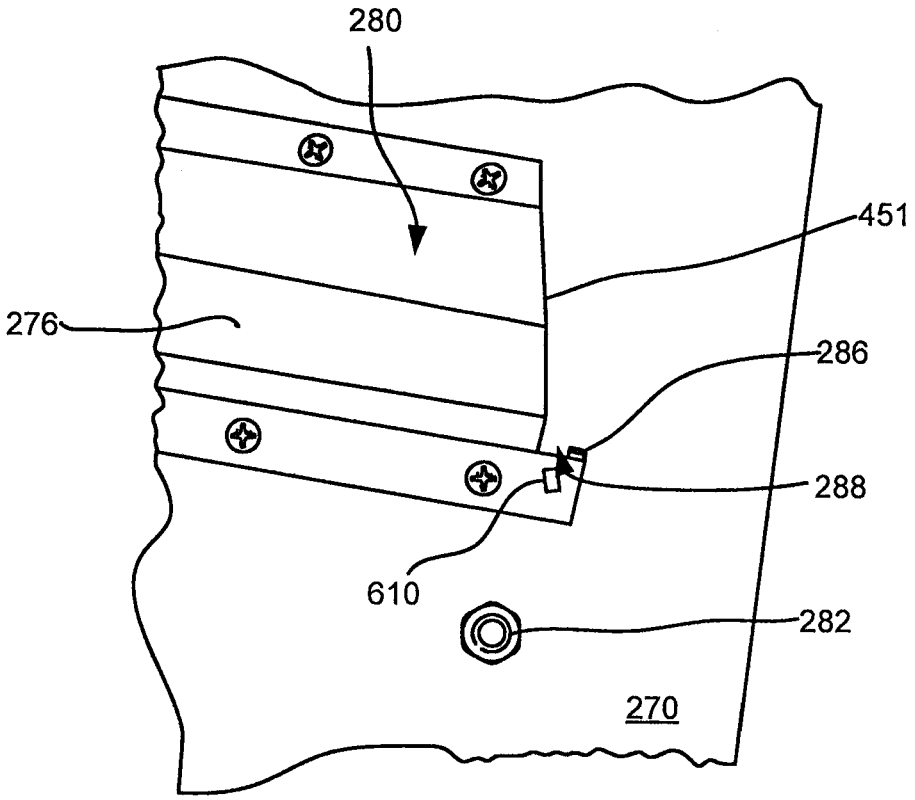
FIG. 22 is a partial perspective view of the coupling assembly at one end of the table top member shown in FIG. 21.

Referring now to FIGS. 21 and 22, table top assembly 14 includes a table top member 279, first and second edge brackets 278, a metal strengthening runner 276 and first and second coupling assemblies 280. Top member 279 is a rigid rectilinear member that extends along a length dimension between side edges 272 and 274 and that has oppositely facing front and rear edges 287 and 285, respectively. Member 279 also has a top surface (see FIG. 1) and a bottom surface 270. Brackets 278, strengthening runner 276 and coupling assemblies 280 are all mounted to bottom surface 270 of top member 279.

Referring still to FIG. 21 and also to FIG. 26, each of the edge brackets 278 has a generally flattened S-shape (best seen in FIG. 26) including a mounting plate 279, an arm plate 299 and a finger member 301. The mounting plate 297 is flat and rectilinear and mounts to the undersurface of top member 270. Arm plate 299 forms an angle with mounting plate 297 so that a distal end is spaced apart from the undersurface of top member 270 and finger member 301 extends from the distal end of arm plate 299 and is generally parallel to mounting plate 297 such that finger member 301 and the undersurface of top member 270 form a slot. The width of the slot is similar to a thickness of the runner member 236 that extends along the length of trough member 16 as shown in FIG. 26. Edge brackets 278, as best shown in FIG. 21, are mounted adjacent rear edge 285 and adjacent lateral edges 272 and 274 of top member 279.

Referring again to FIGS. 21 and 22, strengthening runner 276 is a bent sheet metal member that extends along the length dimension of, and is attached to, the undersurface 270 of top member 279 where distal ends are spaced apart from side edges 272 and 274. Member 276 is located generally along front edge 278 of top member 279. Runner 276 provides additional strength for top member 279 along the front edge thereof.

Referring specifically to FIG. 22, at each end, strengthening runner 280 forms an edge 451 that is generally perpendicular to undersurface 270. In addition, spaced apart from edge 311, runner 276 includes a relatively small finger member 286 (see also FIGS. 29 and 30) that extends generally perpendicular to bottom surface 270 such that the edge of member 286 facing strengthening runner edge 450 and edge 450 form a slot 288. Slot 288 has a width dimension that is slightly greater than the width of finger member 198 at the distal end of arm support member 15 as shown in FIG. 12. Opening 610 is sized and dimensioned to receive key member 203 on support member 15 (see again FIG. 12).

Referring still to FIG. 22, a metal stud 282 is embedded (e.g., adhered within an opening) in the undersurface 270 proximate slot 288 so that when alignment member 203 (see again FIG. 12) is received in slot 610, opening 196 is aligned with a threaded opening formed by the metal stud 282.

Figure 23:
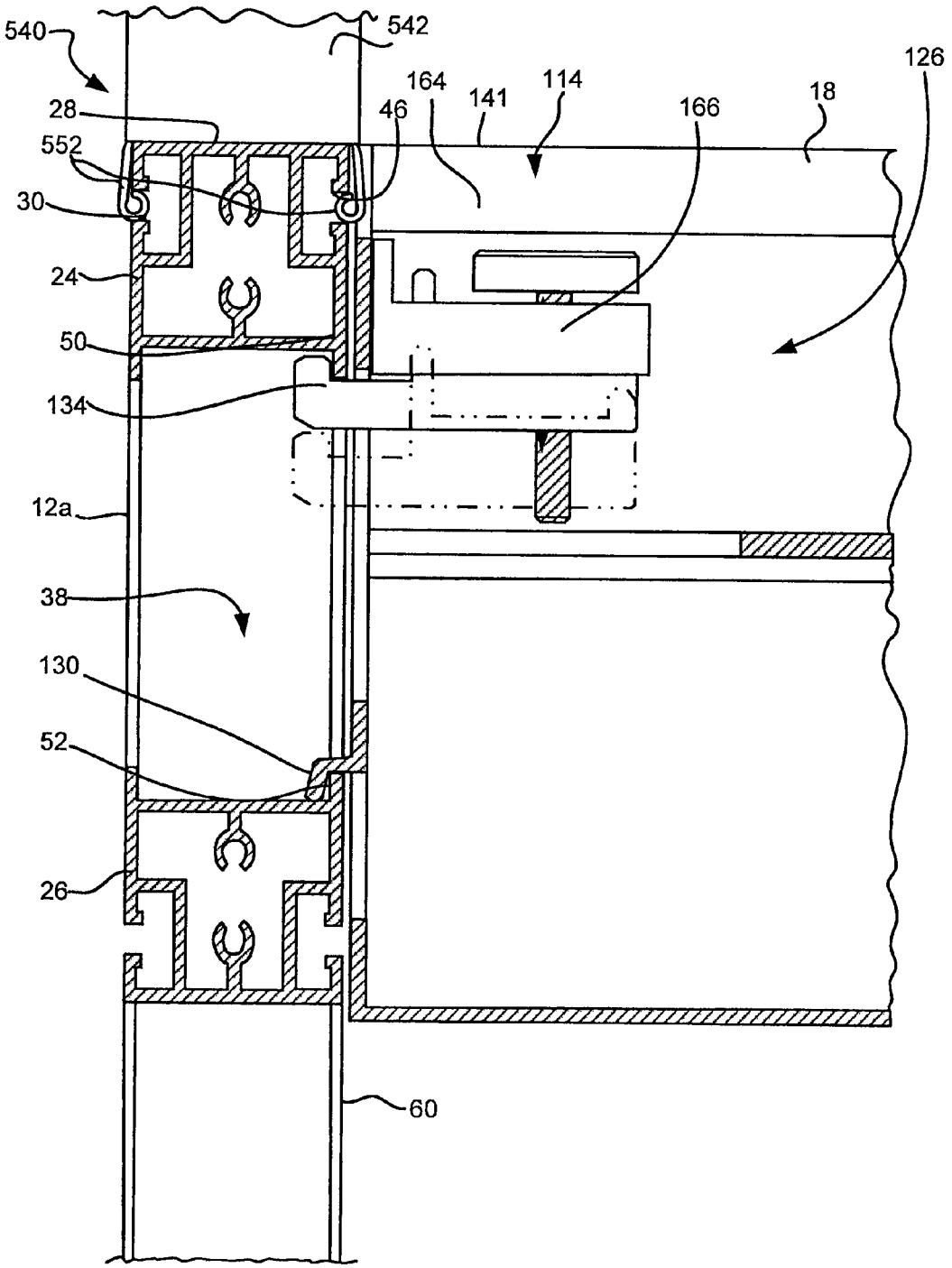
FIG. 23 is a view similar to the view shown in FIG. 4, albeit with the channel assembly of FIG. 1 attached to the leg assembly of FIG. 4.

Referring now to FIGS. 1, 2, 8 and 9, to assemble the configuration shown in FIG. 1, initially, coupling assemblies 114 and 116 are loosened so that finger members 134 are generally spaced apart from top cross members 124. Next, holding one of the leg assemblies 12*a* in an upright position as shown in FIG. 23, channel assembly 18 is aligned with the top end of the leg assembly 12*a* so that lip members 134 and 130 are generally aligned with opening 38 formed between rail members 24 and 26. Channel assembly 18 is moved toward the external surface 60 of leg assembly 12*a* until lip members 134 and 130 are located within the space between rail lip members 50 and 52 and then is moved downward until lip member 52 is received by lip member 130. The second leg member 12*a* is temporarily attached to the opposite end of channel assembly 18 in a similar fashion. To assemble the FIG. 1 configuration 10, channel assembly 18 is located at rear portions of leg assemblies 12*a* and 12*b* so that most of the frame space 13 is to a front side of assembly 18 (see FIG. 25).

Figure 29:
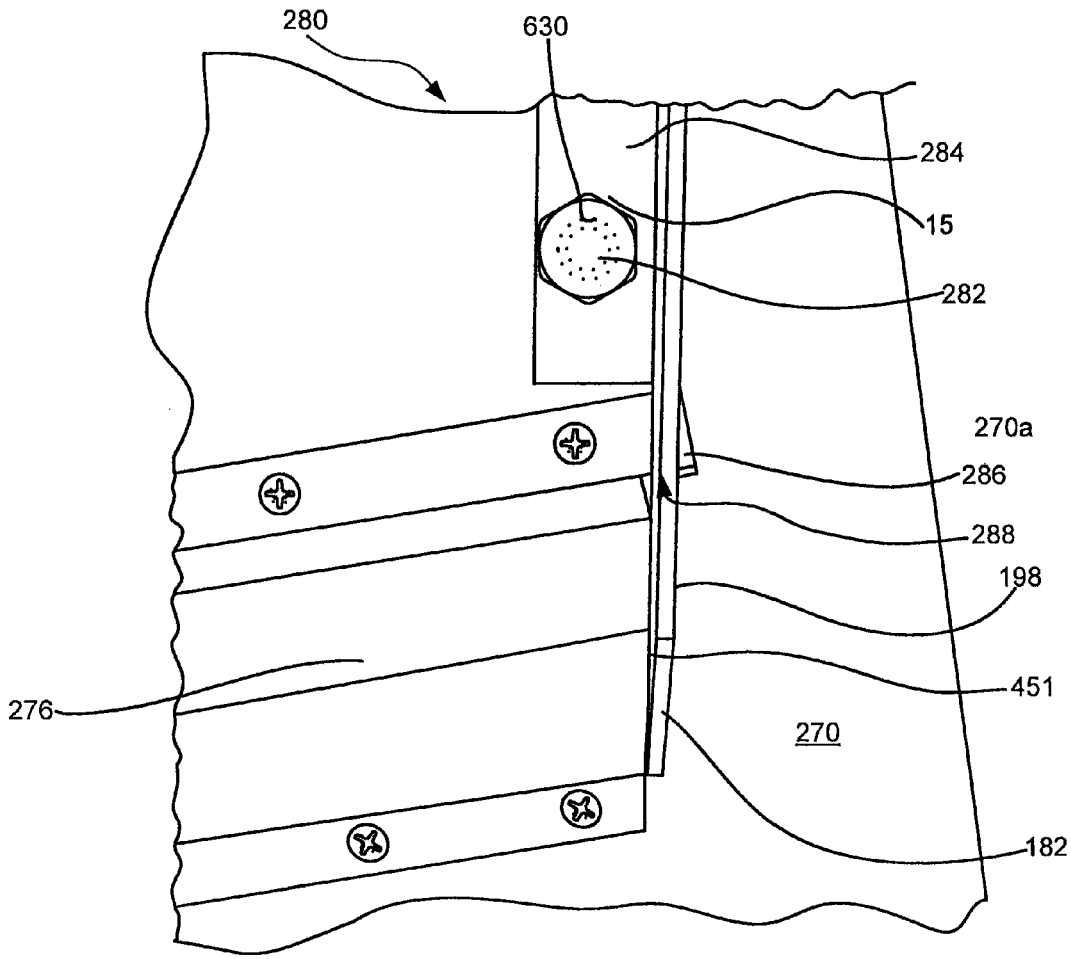
FIG. 29 is a view similar to the view shown in FIG. 22, albeit where a table top assembly is coupled to the distal end of one of the arm support members.

Referring still to FIG. 23, bolt 163 is rotated causing jaw member 164 and associated lip 134 to move upward until lip member 134 catches rail lip 50. Upon further tightening of bolt 163, channel member 18 is tightly secured to leg assembly 12*a*. The other coupling assembly 116 is similarly tightened to secure the opposite end of channel member 18 to second leg assembly 12*b*. At this point, frame space 13 is defined by the facing surfaces of leg members 12*a* and 12*b*, where the frame space has a rear edge portion adjacent channel assembly 18 and a front edge portion near leg member front surfaces 11 and an intermediate portion between the front and rear portions. Referring to FIG. 29, channel assembly 18 is spaced 700 slightly (e.g., ½ inch) from the rear surface of the leg assemblies 12*a*, 12*b* and top surface 141 is flush with the top surfaces 28 of leg members 12*a* and 12*b*.

Referring again to FIG. 23, after channel member 18 is secured to one of the leg assemblies 12*a*, the portion of the upper rail slot 46 aligned with the top opening 114 in the upper channel 126 is exposed within the opening 114. Thus, in at least some cases additional optional accessories may be mounted to upper rail 24 via the exposed portion of slot 46 (e.g., see clips 552 in FIG. 23 that help to attach a privacy screen 540 (see also FIG. 54 described below).

Figure 24:
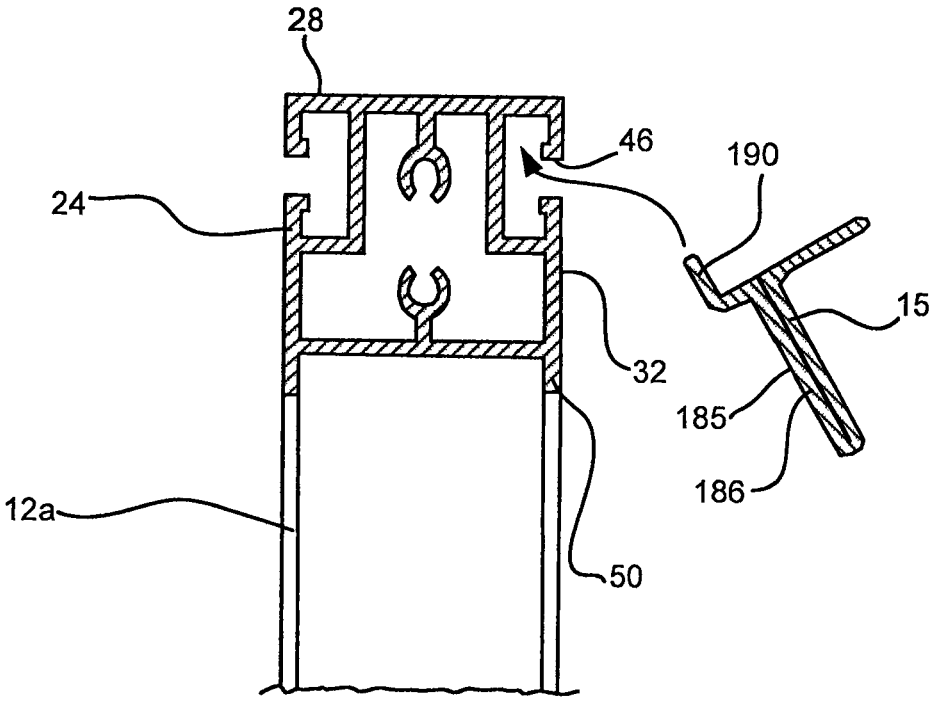
FIG. 24 is similar to the view shown in FIG. 4, albeit showing the support arm member of FIG. 12 being attached to an upper rail of one of the leg assemblies.
Figure 27:
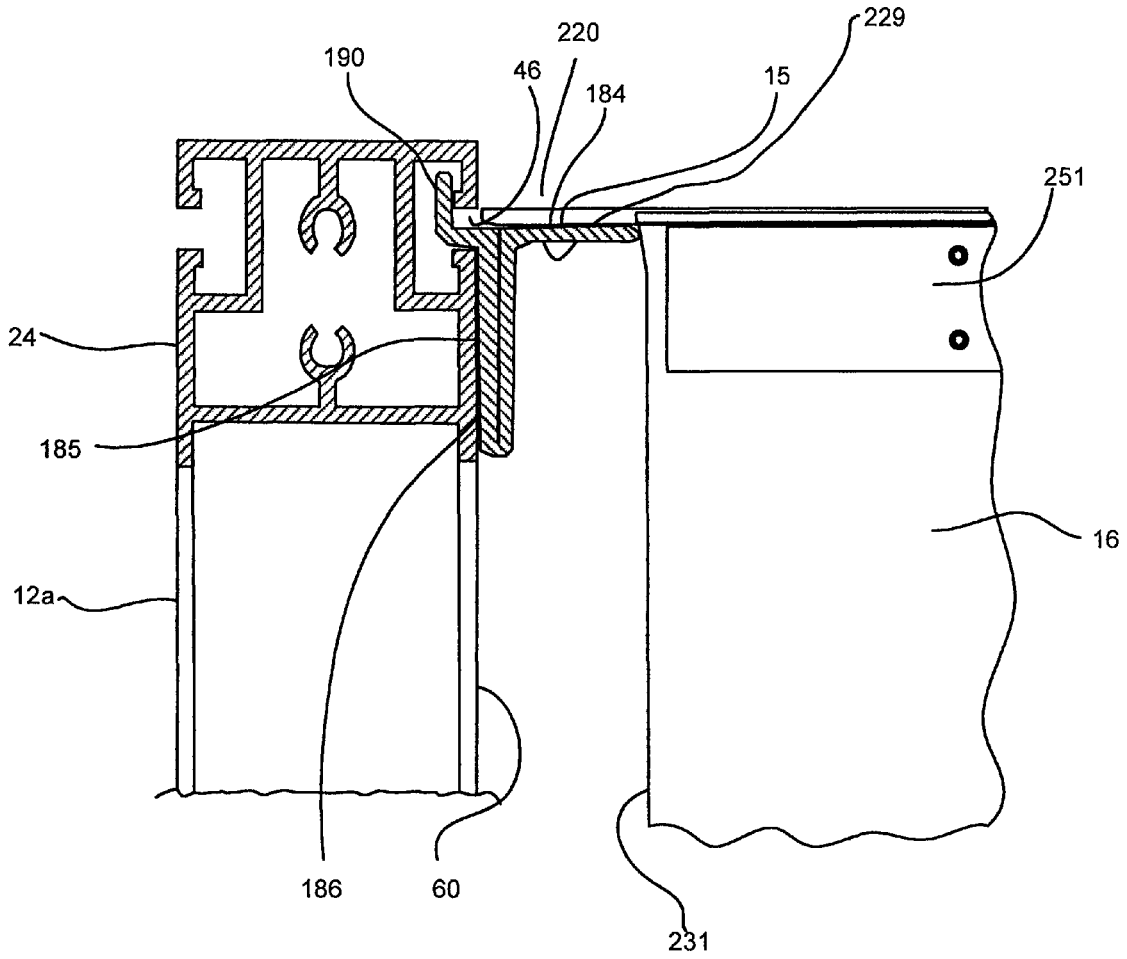
FIG. 27 is similar to FIG. 24 albeit showing the support arm member of FIG. 12 mounted to a top rail of a leg assembly and a trough member mounted to the support arm member.

Referring again to FIG. 2 and also now to FIG. 24, arm support members 15 are next attached to facing surfaces of leg assemblies 12*a* and 12*b*. To this end, the upwardly extending lip member 190 of one of the arm members 15 is aligned with the T-slot 46 formed by top rail 24 and is manipulated there into so that lip member 190 extends into the slot 46 and bearing surface 185 bears against an outer surface of wall member 32 that forms slot 46 (see also FIG. 27). The other arm member 15 is attached to the other leg assembly 12*b* in a similar fashion. At this point, the sub-assembly appears as shown in FIG. 25.

Referring again to FIG. 2 and also to FIG. 26, trough member 16 is next installed. To this end, the rear edge of lip member 220 is aligned with channel 148 formed by channel assembly housing 110 and is moved into the channel 148 while the front edge portion of the trough member is held up above the supporting surfaces of the arm members 15. Once the rear portion of lip member 220 is received within channel 148, the front edge portion of trough member 16 can be lowered until the undersurface of lip member 220 bears against the top support surfaces 184 of support members 15. At this point the sub-assembly configured has the appearance shown in FIG. 28.

Figure 28:
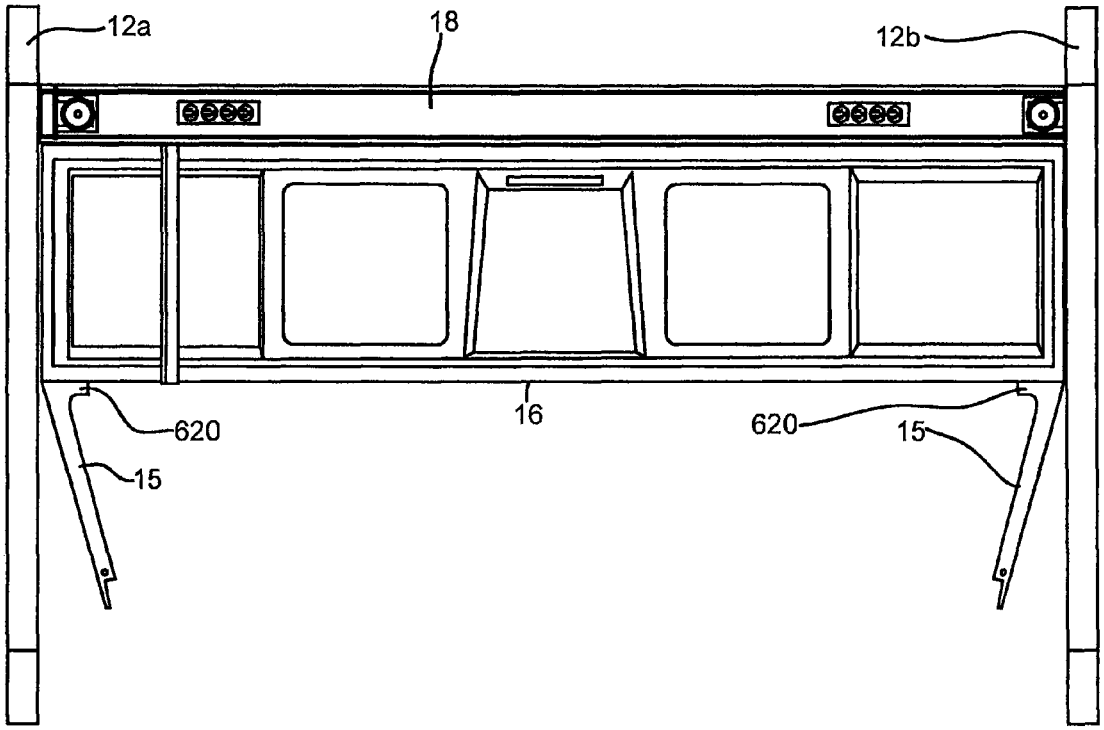
FIG. 28 shows a subset of the components of FIG. 1 in an intermediately assembled state.

Referring again to FIGS. 21 and 26, to mount table assembly 14 to the sub-assembly shown in FIG. 28, the table assembly 14 is positioned with the rear edge 285 adjacent the front edge portion 236 of runner 251 and so that brackets 278 are generally aligned with shoulder members 620 formed by support members 15 (see FIG. 12). Top assembly 14 is moved toward through member 16 until shoulder members 620 are sandwiched between the table top member undersurface 270 and clip member 301. In at least some embodiments the end portions of runner lip member 226 may also be sandwiched between undersurface 270 and clip member 301. Next, front edge 287 portion of table top assembly 14 is rotated downward above the distal ends of arm members 15 with slots 610 aligned with key members 203 (see FIGS. 12 and 22).

Figure 30:
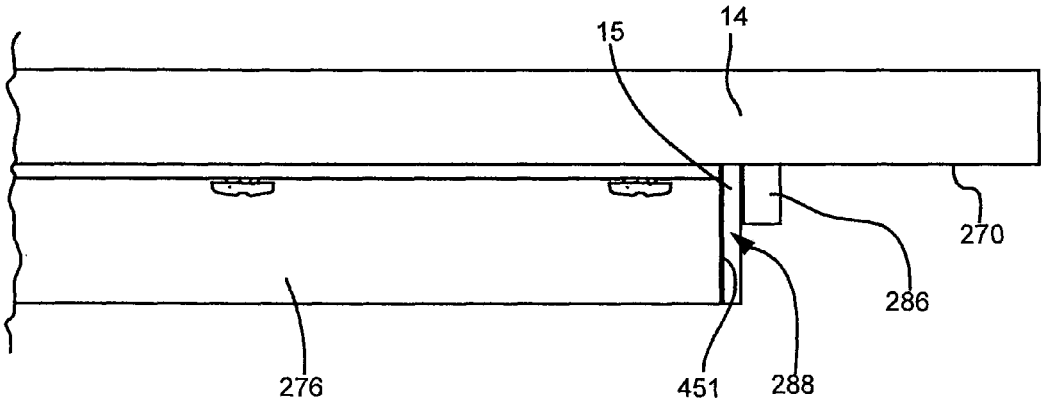
FIG. 30 is a front end view of the coupling assembly and arm support member of FIG. 29.
Figure 31:
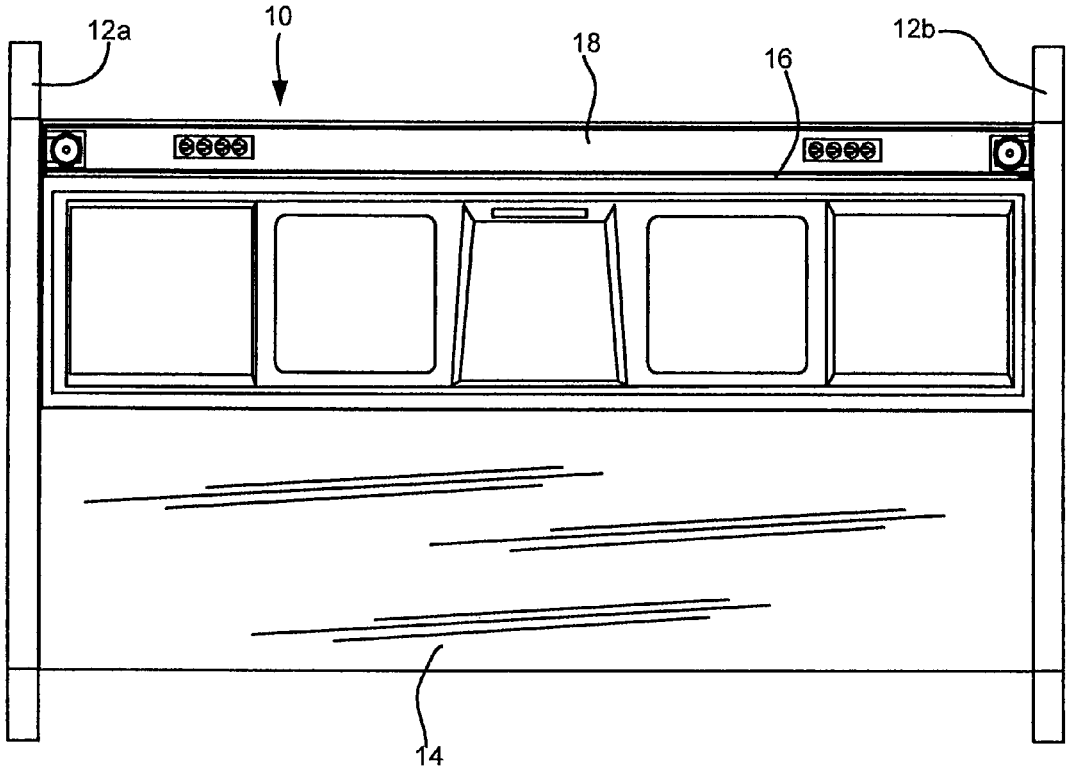
FIG. 31 is a top plan view of the assembly of FIG. 1.

While the front edge portion of the table assembly is being lowered, key members 203 slide into slots 610. In addition, finger members 198 formed at the distal ends of support arm members 15 are received within slots 288 between edge 451 of strengthening runner 176 and the facing edge of finger member 286 as shown in FIGS. 29 and 30. Finger tightenable bolts 630 are passed through openings 196 (see FIG. 12) and are threadably received in studs 282 to secure top member 297 to arm support members 15. Together, the mating between pin 282 and opening 196, the mating between finger member 198 and slot 288 and mating between bolts 630 and studs 282 securely connect top member 279 to arm members 15. Referring once again to FIG. 1, at this point the configuration shown in FIG. 1 is completely assembled. See also FIG. 31 that shows the configuration of FIG. 1 in a top plan view.

Referring again to FIG. 1, top member 279 has a thickness dimension such that after installation, top surface 9 of member 279 is at a height that is flush with the top surfaces 28 of leg assemblies 12*a* and 12*b*. Similarly, referring also to FIG. 10, the top surface 141 of channel housing 110 is at a height that is flush with top surfaces 28 of leg assemblies 12*a* and 12*b* after installation (see also FIG. 23). Referring to FIG. 26, a top surface 221 of trough lip member 220 is recessed below (e.g., one-quarter inch) the top surfaces of the leg assemblies 12*a* and 12*b*.

Figure 32:
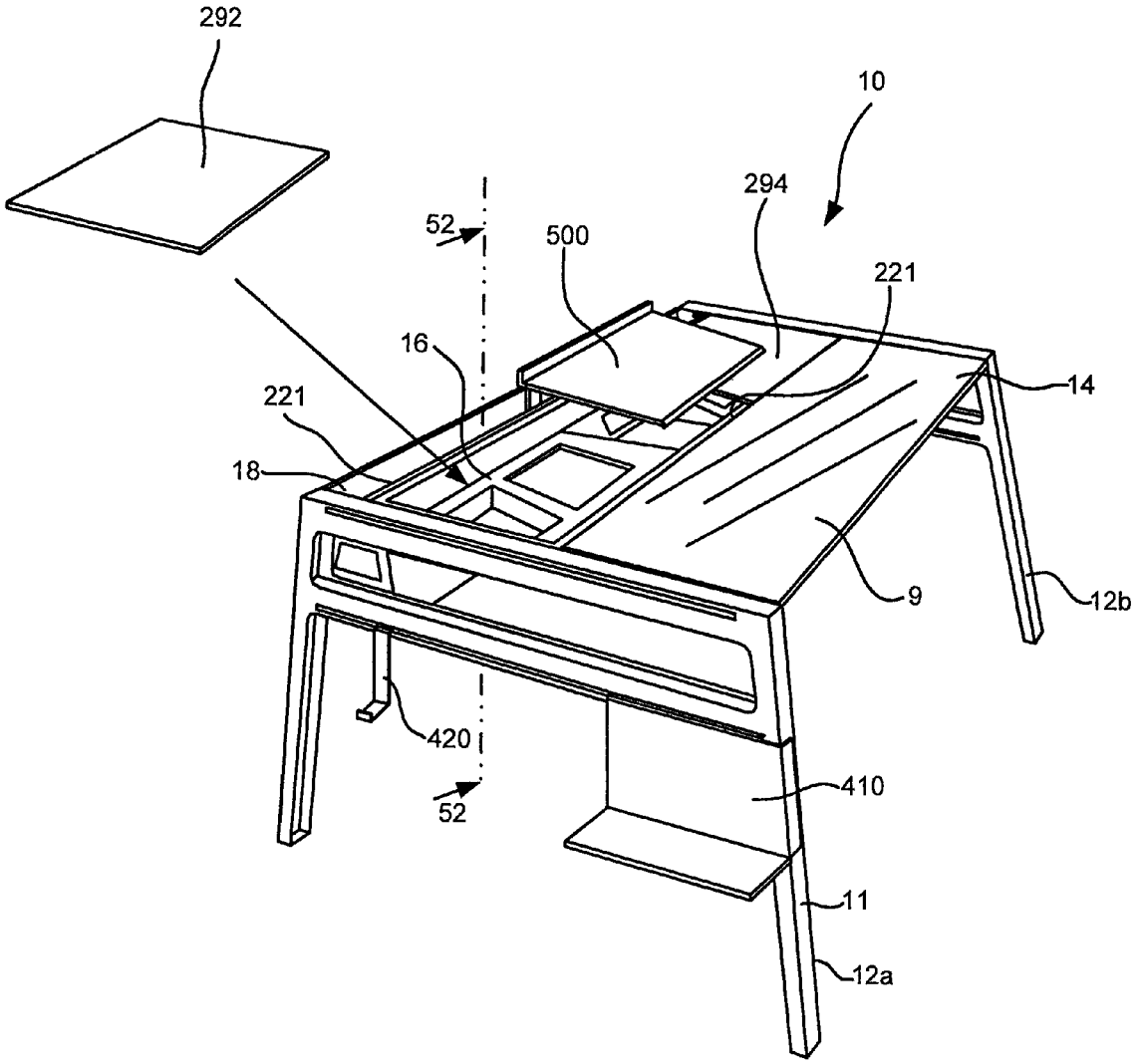
FIG. 32 is a perspective view similar to the view shown in FIG. 1, albeit including sliding board members, a shelf bracket and a purse hook or bracket.

Referring once again to FIG. 16, in at least some embodiments it is contemplated that one or more sliding board or plate members may be provided that are dimensioned to be received on the shelf support surface 221 for sliding motion along the length dimension of trough member 16. Referring also to FIG. 32, exemplary sliding board members 292 and 294 are illustrated that may be placed on the shelf support 221 as shown. Board members 292 and 294 have thicknesses such that, when supported on surface 221, top surfaces of the boards are generally at the same height as top surface 9 of table top member 279. Thus, with boards 292 and 294 installed, the top surfaces thereof operate to provide additional work surface space if desired.

Figure 33:
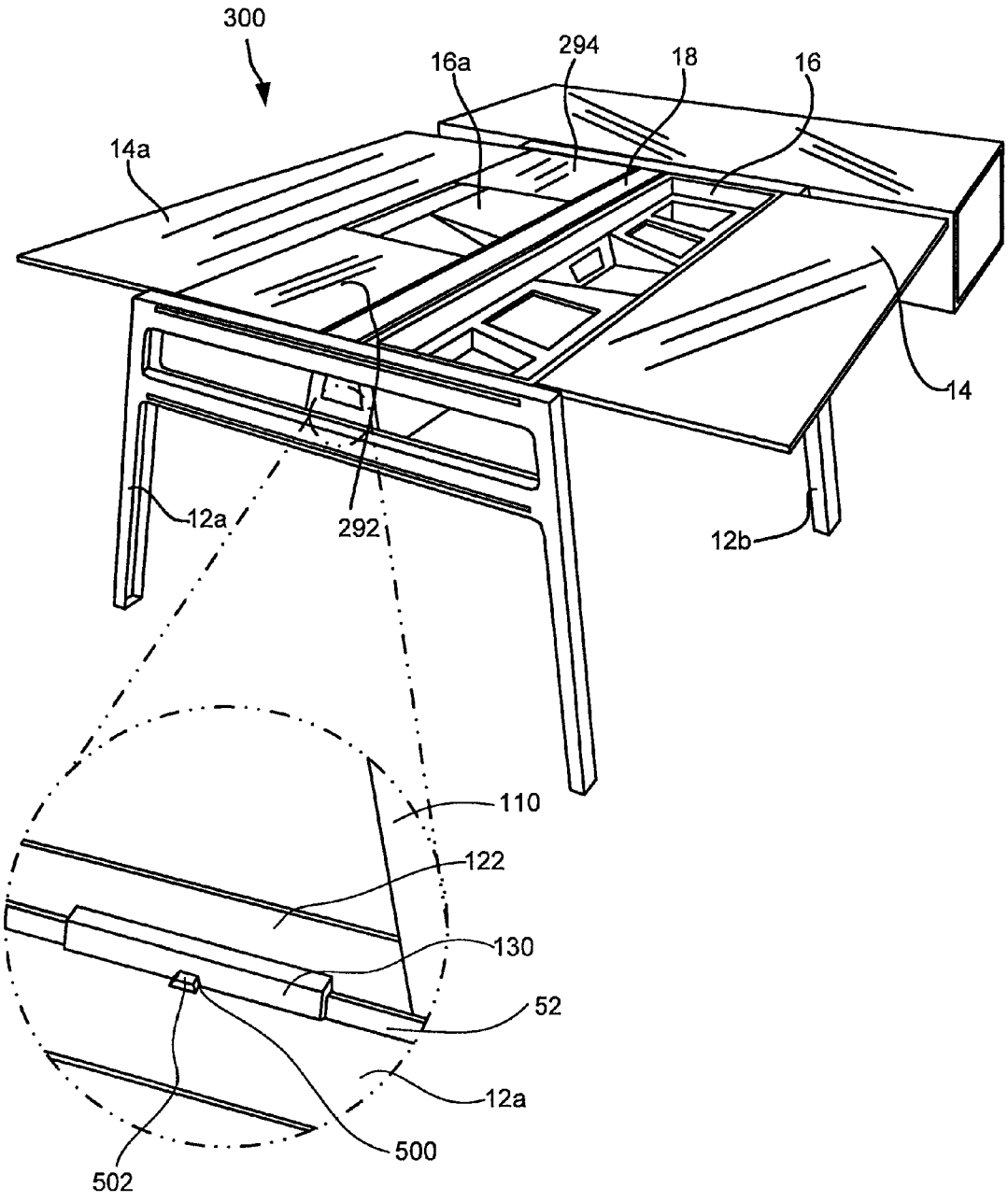
FIG. 33 is a view similar to the view shown in FIG. 1, albeit showing a second desk/table assembly that is consistent with at least some aspects of the present invention.

Referring now to FIG. 33, a second exemplary configuration 300 that is consistent with various aspects of the present invention is illustrated. This second configuration 300 includes all of the components described above with respect to the first configuration 10 as well as some additional components. To this end, configuration 300 includes first and second leg assemblies 12*a* and 12*b*, table top assembly 14, trough member 16 and channel assembly 18. In addition, second configuration 300 includes a second table top assembly 14*a* and a second trough assembly 16*a*. Configuration 300 is also shown with first and second sliding board or plate members 292 and 294 supported by the shelf surface of trough member 16*a*.

To configure the configuration 300 shown in FIG. 33, the configuration shown in FIG. 1 can simply be reconfigured. To reconfigure the configuration shown in FIG. 1, referring to FIG. 34, the coupling assemblies 114 and 116 can be loosened so that channel assembly 18 can be slid along the openings 38 (see again FIG. 1) to a central location with respect to, or to an intermediate portion of, leg assemblies 12*a* and 12*b*. When channel assembly 18 is slid, trough member 16 and table assembly 14 slide therewith into the positions shown in FIG. 34 where trough member 16 and table assembly 14 are generally adjacent front end portions of leg assemblies 12*a* and 12*b*. In addition, referring again to FIGS. 12 and 34, arm support members 15 slide to the locations shown in phantom in FIG. 34 where distal portions 183 thereof extend past the front surfaces 11 and forward of the frame space 13. Next, the coupling assemblies 114 and 116 can be tightened to secure channel assembly 18 in the central position. At this point, table assembly 14 extends past the front surfaces 15 of leg assemblies 12*a* and 12*b* but is still solidly supported by the distal ends of the support arm members 15 and the strengthening member 276 there below.

Figure 34:
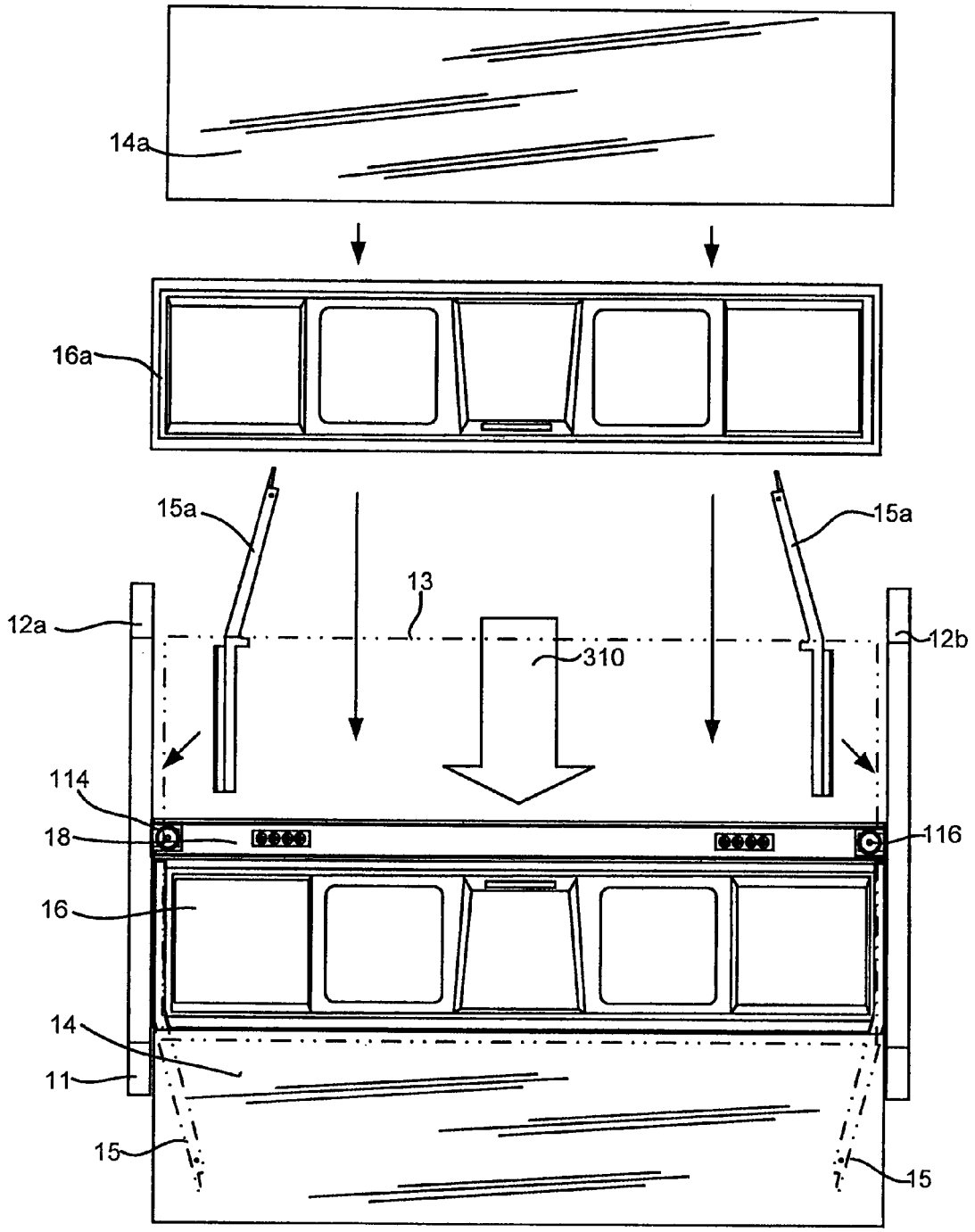
FIG. 34 is a top plan view showing the assembly of FIG. 33 in a partially assembled state.
Figure 35:
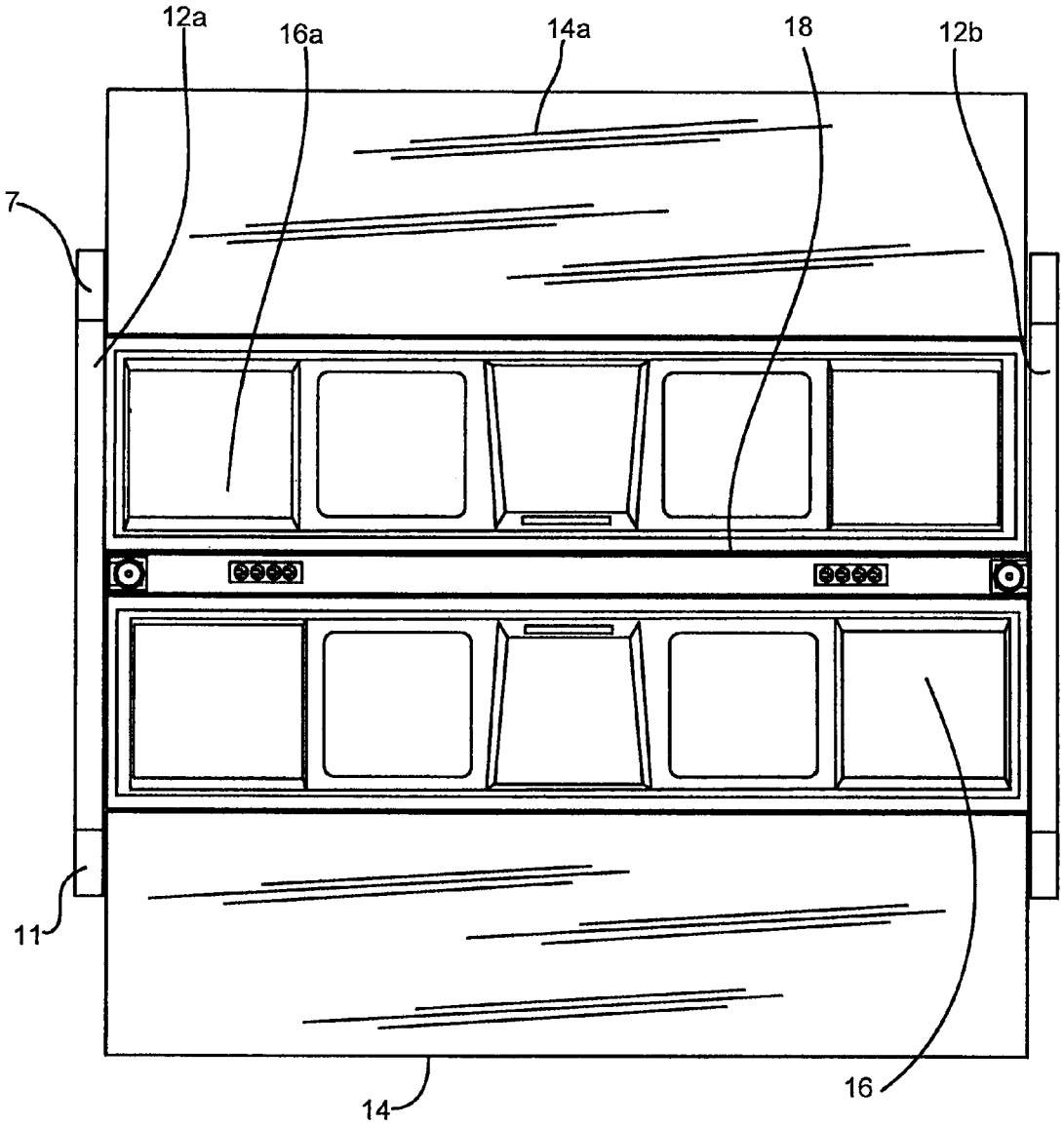
FIG. 35 is a top plan view of the assembly shown in FIG. 33.

Referring still to FIG. 34, third and fourth arm support members 15*a* are attached to the facing surfaces of leg assemblies 12*a* and 12*b* in an similar fashion to that described above with respect to members 15, albeit with the distal ends of arm members 15*a* extending in a rearward direction. Trough member 16*a* is attached with the rear edge thereof received in the second channel 146 (see again FIG. 10) formed by channel housing member 110 and side portions thereof supported by the top support surfaces formed by support arm members 15*a*. Table top assembly 14*a* is attached to the front edge of trough member 16*a* and distal portions of the top surfaces formed by arm members 15*a*. A top plan view of the resulting configuration 300 is shown in FIG. 35 where it can be seen that table assembly 14*a* and trough member 16*a* are generally adjacent rear end portions of leg assemblies 12*a* and 12*b*.

Thus, it should be appreciated that the configuration 10 in FIG. 1 can be reconfigured easily and intuitively to use all of the assembly 10 components from a single person workstation to configure a two person face-to-face workstation that includes a pair of table tops supported at least in part within the frame space formed by the facing surfaces of leg assemblies 12*a* and 12*b*. As shown, the table tops 14 and 14*a* form a split top space between facing rear edges where trough members 16 and 16*a* as well as channel assembly 18 are located in the split top space and are supported by the leg members. The sliding capability of channel assembly 18 with respect to the leg openings 39 (see again FIG. 1) enables fast and easy one-to-two station reconfiguration and vice versa.

Figure 36:
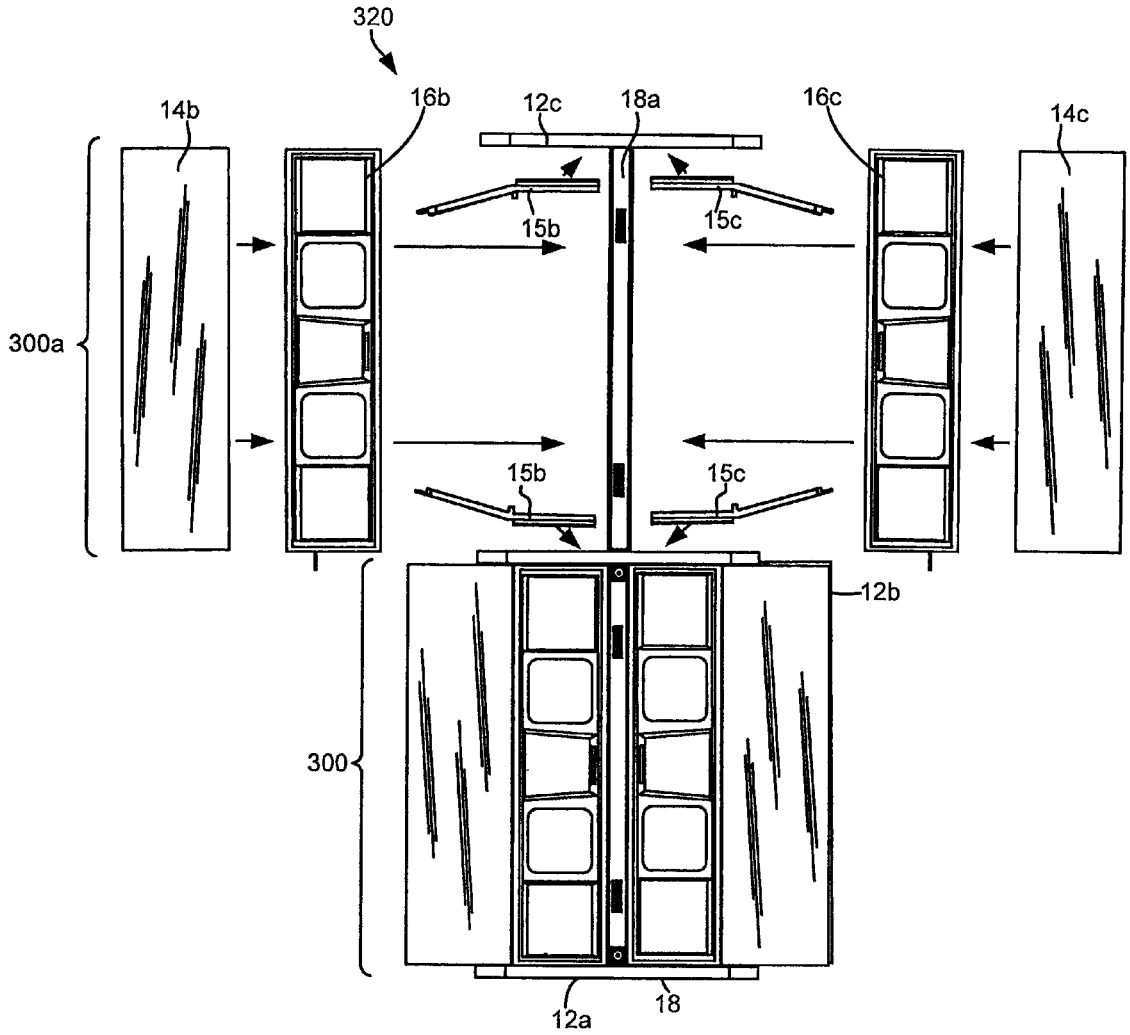
FIG. 36 is a top plan view of a partially assembled desk/table assembly for constructing four different workstations.
Figure 37:
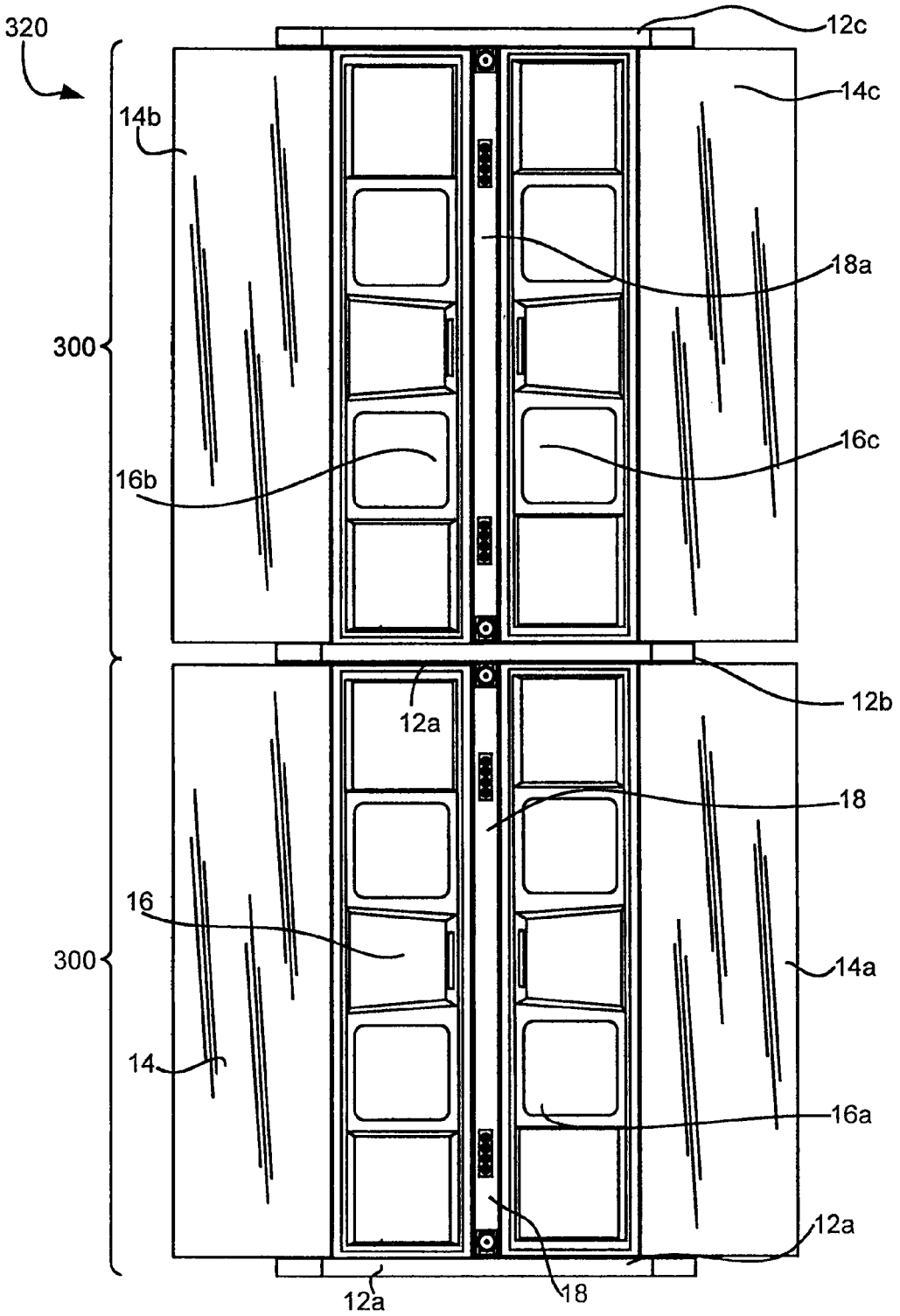
FIG. 37 is a top plan view of the assembly of FIG. 36 in a completely assembled condition.

In addition to the embodiments described above, additional components like those described above can be continually added to a configuration to configure additional work spaces for additional users. To this end, referring again to FIG. 33, after configuration 300 is configured, the outer exposed surfaces of leg assemblies 12*a* and 12*b* have slot and lip arrangements that can be used to secure additional channel assemblies 18 and support arms (see again FIG. 12) that can in turn support additional trough members 16 and table assemblies 14. In this regard, see now FIG. 36 that shows yet another partially assembled workstation configuration 320 that is consistent with at least some aspects of the present invention. As shown in FIG. 36, the configuration 320 includes an instance 300 of the configuration shown in FIG. 33 plus additional components 300*a* for forming two additional workstations. The additional components include a second channel assembly 18*a*, four additional support arm members 15*b* and 15*c*, third and fourth trough members 16*b* and 16*c*, third and fourth table top assemblies 14*b* and 14*c* and a third leg assembly 12*c*. Here, second channel assembly 18*a* is mounted to a surface of leg assembly 12*b* opposite the surface to which channel assembly 18 is mounted and extends in line with and parallel to channel assembly 18 to a second end that is securely connected to one of the side surfaces of leg assembly 12*c*. Support arm members 15*b* and 15*c* are mounted to facing surfaces of leg assemblies 12*b* and 12*c* to extend in opposite directions, trough members 16*b* and 16*c* are installed and table top assemblies 14*b* and 14*c* are installed. The resulting "four pack" of workstations 320 is illustrated in FIG. 37 in top plan view.

Referring still to FIG. 36, the components that comprise configuration 320 generally include two overlapping pairs of leg members including a first pair 12*a*, 12*b* and a second pair 12*b* and 12*c* where each pair of adjacent leg members forms a separate frame space and where a separate pair of table tops (e.g., 14*b* and 14*c*) are supported at least partially within each frame space. Although not shown, additional leg members and table top pairs can be provided to construct additional face-to-face workstations in a similar fashion. In this regard, an additional leg member may be spaced apart from an existing member to form another pair of adjacent leg members that define another frame space and a pair of table top members can then be mounted within the additional frame space.

After assembly 320 has been configured, the wire passing openings at adjacent ends of channel assemblies 18 and 18*a* are aligned and both open into the leg openings 38 (see again FIG. 1) formed by central leg assembly 12*b* so that power/data wires can be directly routed from one channel assembly 18 to the next 18*a*.

Figure 38:
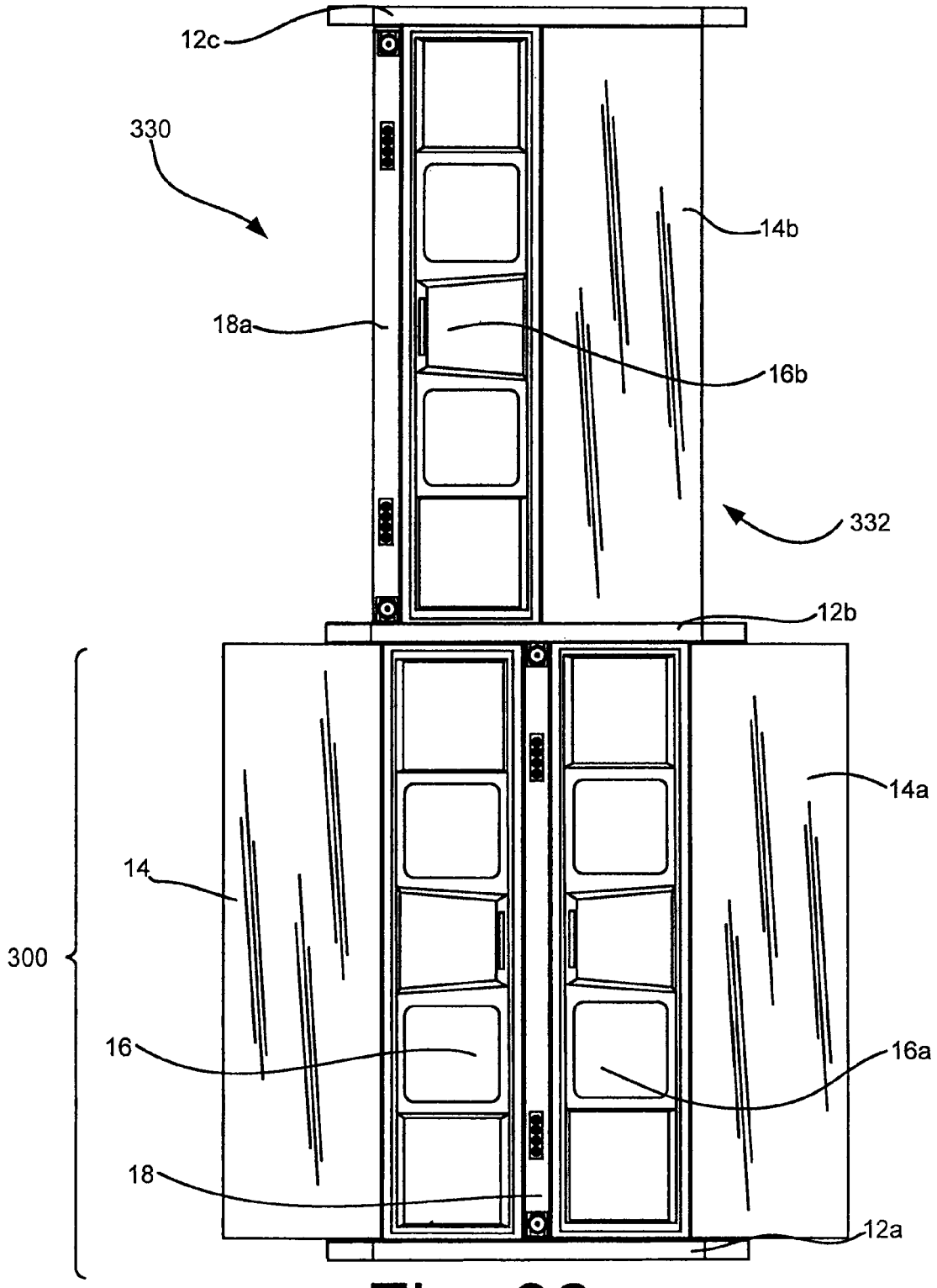
FIG. 38 is a top plan view of yet another workstation assembly.

Other configurations are contemplated. For example, referring now to FIG. 38, yet one additional configuration 330 is illustrated that is consistent with at least some aspects of the present invention. Configuration 330 includes an instance of the configuration 300 shown above in FIG. 33 as well as additional components 332 attached to configuration 300 to form a third workstation. The additional components 332 include a second channel assembly 18*a*, a third trough member 16*b*, a third table top assembly 14*b* and a third leg assembly 12*c*. Second channel assembly 18*a* is mounted to a side of leg member 12*b* opposite the side on which channel assembly 18 is mounted and extends parallel to channel assembly 18. Here, however, second channel assembly 18*a* is not directly aligned with channel assembly 18 and is instead offset to the rear portion of leg assemblies 12*b* and 12*c* in a fashion similar to that described above with respect to assembly 10 in FIG. 1. The trough member 16*b* and table top assembly 14*b* are then attached to the leg assemblies 12*b* and 12*c* and channel assembly 18*a* as described above.

In the case of configuration 330, while channel assemblies 18 and 18*a* are not aligned, both assemblies 18 and 18*a* open into the large leg opening 38 (see again FIG. 1) and therefore power/data wires can be routed from assembly 18 through the leg opening 38 and into assembly 18*a*.

Although not illustrated, many other workstations may be strung on to either side of one of the above described assemblies in a fashion similar to that described above to configure any number of desired workstations (e.g., five, eight, twenty, etc.).

All of the embodiments described above include different "inserts" or rigid furniture components or furniture assemblies that can be mounted between leg assemblies 12 to configure different overall workstation configurations. For instance, in the case of the FIG. 1 configuration 10, the "furniture assembly" that can be secured between first and second leg assemblies 12*a* and 12*b* includes channel assembly 18, trough member 16 and table top assembly 14 (i.e., a first rigid furniture component). In the case of second configuration 300 shown in FIG. 33 above, in addition to the first furniture assembly, a second furniture assembly is included that includes trough member 16*a* and second table top assembly 14*a* (i.e., a second rigid furniture component).

Figure 39:
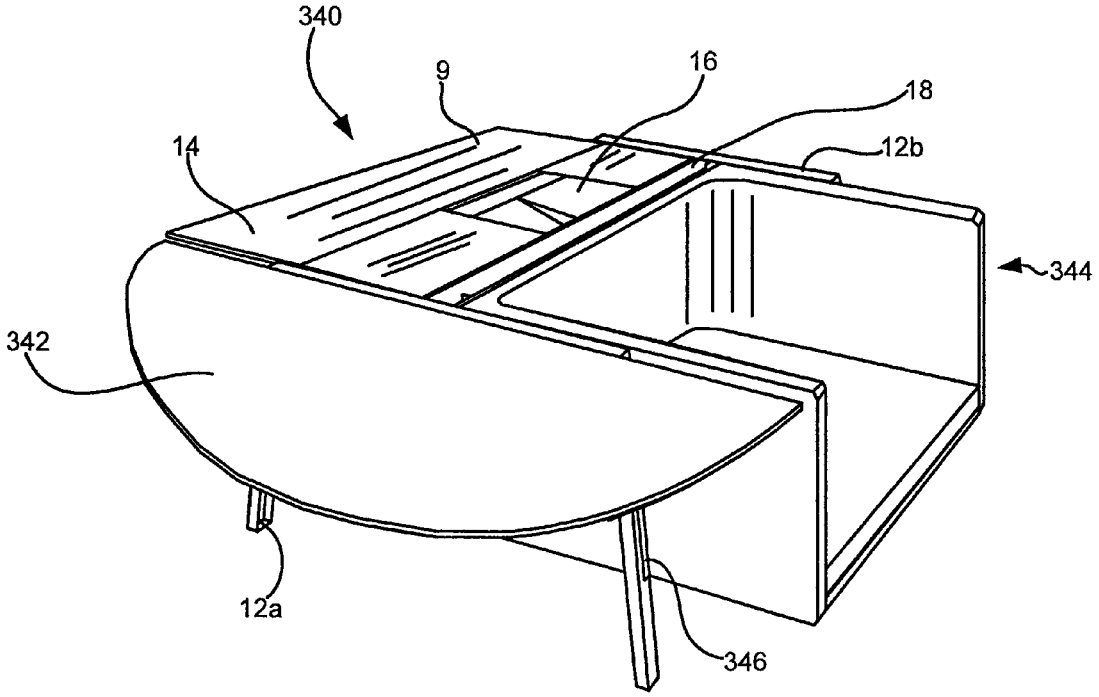
FIG. 39 is a perspective view similar to the view of FIG. 33; albeit where several components in the assembly of FIG. 33 have been replaced by a lounge sub-assembly.

In at least some embodiments it is contemplated that additional different types of furniture assemblies may be provided that can be installed between a pair of leg assemblies 12 to provide yet additional furniture configurations. For example, referring to FIG. 39, an exemplary additional configuration 340 is shown that includes a seating or lounge furniture assembly or sub-assembly 344 that has been substituted for the trough member 16 and table top assembly 14 shown in FIG. 33.

Figure 40:
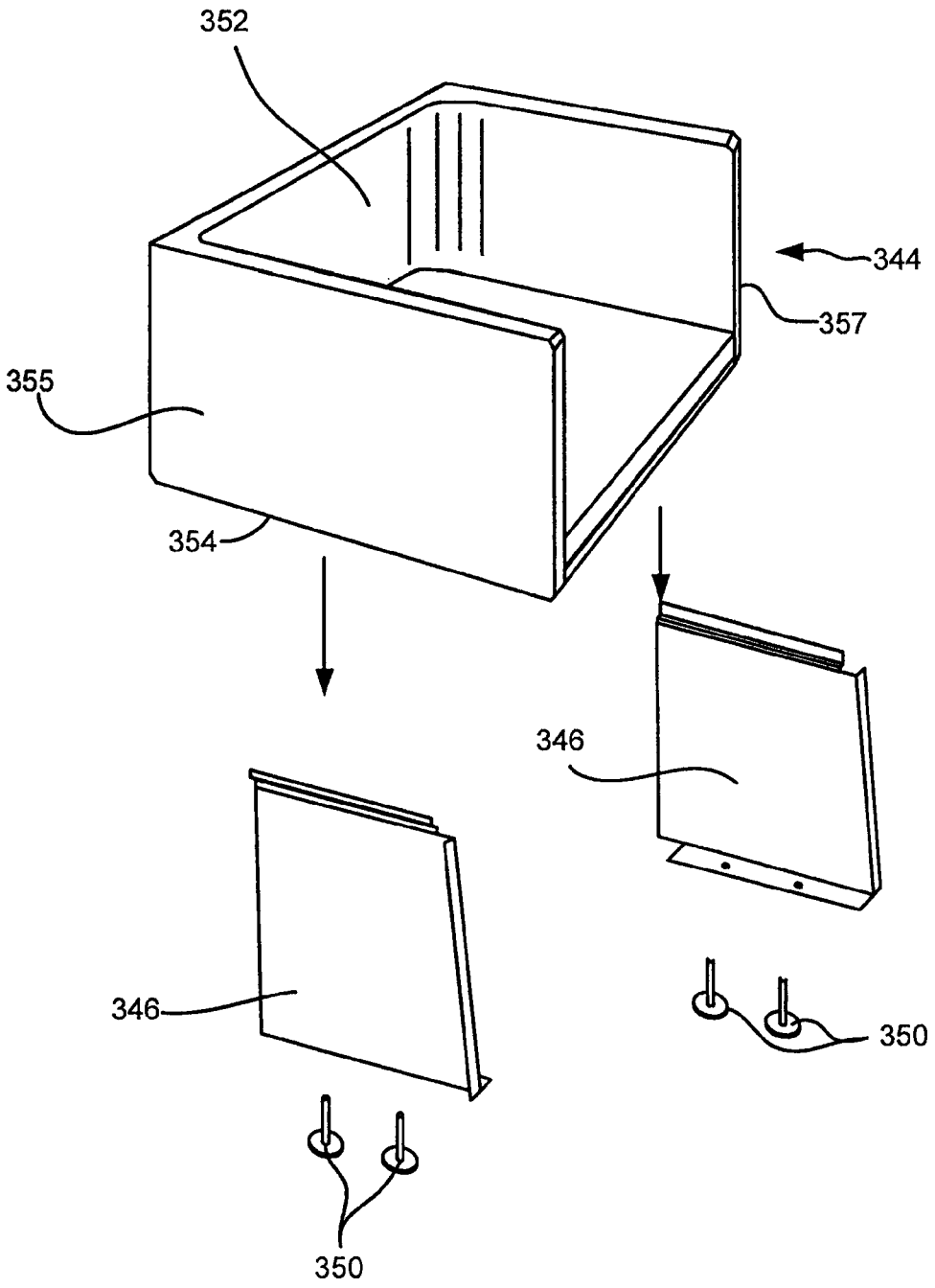
FIG. 40 is a perspective exploded view of the lounge sub-assembly of FIG. 39.
Figure 41:
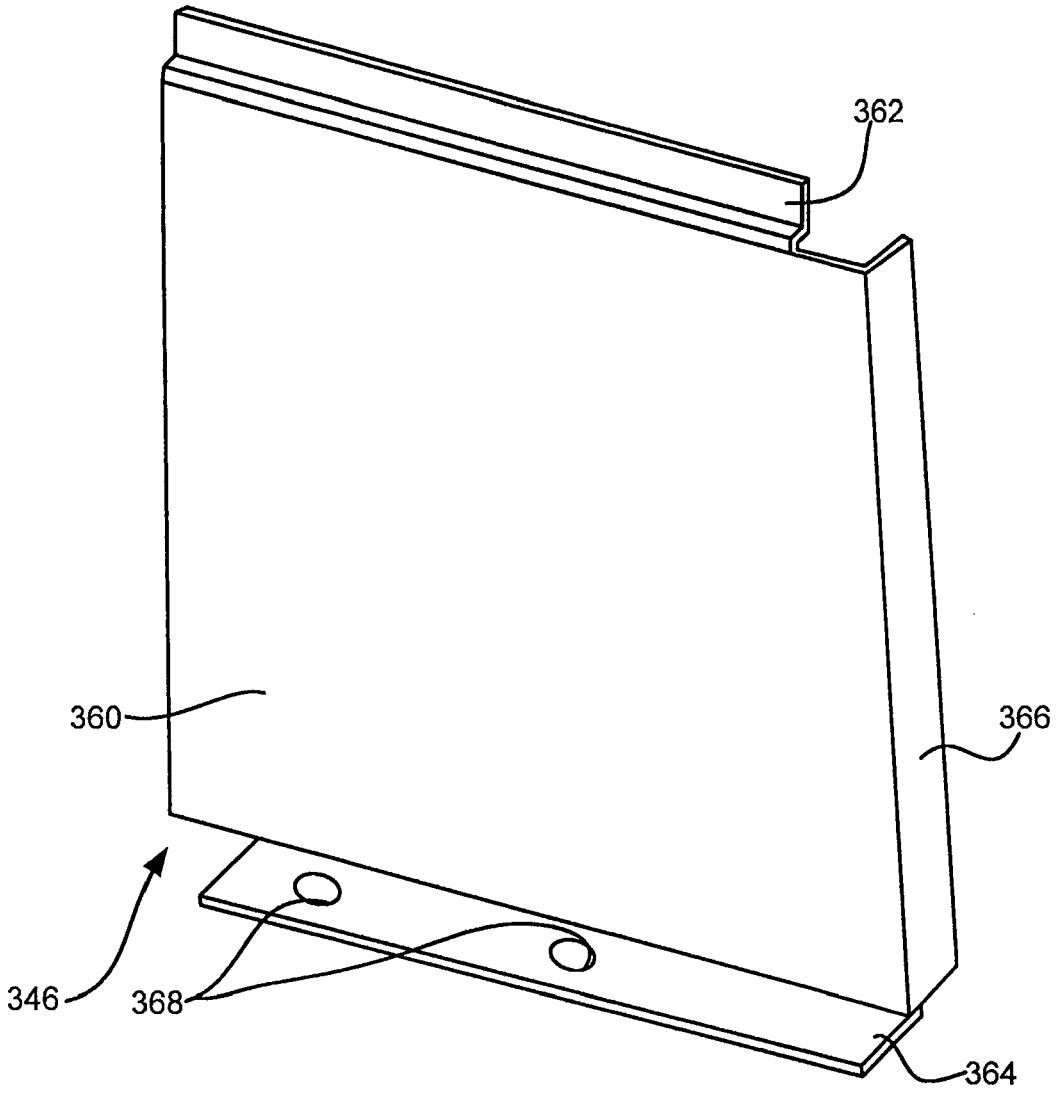
FIG. 41 is a perspective view of one of the lounge brackets shown in FIG. 40.

Referring to FIGS. 40 and 41, lounge sub-assembly 344 includes a lounge or sofa-type structure 352 (i.e., a third rigid furniture component), first and second lounge brackets 346 and finger tightening locking bolts 350. Lounge structure 352 forms a seating structure and includes an undersurface 354 and first and second side surfaces 355 and 357. The lounge structure 352 is dimensioned such that its length is substantially identical to the length dimension of channel assembly 18 described above so that lounge structure 352 can fit snuggly between facing surfaces of leg assemblies 12*a* and 12*b* when channel assembly 18 is connected there between.

Lounge bracket 346 includes a large rectangular plate 360 that forms a lip 362 that extends to a first side of plate 360 and that has a form and dimensions similar to lip 190 shown in FIGS. 12 and 13. Along an edge opposite the edge from which lip member 362 extends, a shelf member 364 extends in a direction opposite the direction in which the lip member 362 extends. Member 364 forms two openings 368 for passing locking bolts 350. Along a front edge of plate member 360, a flange 366 extends generally perpendicular to plate member 360 and in a direction opposite the direction in which shelf member 364 extends.

Figure 42:
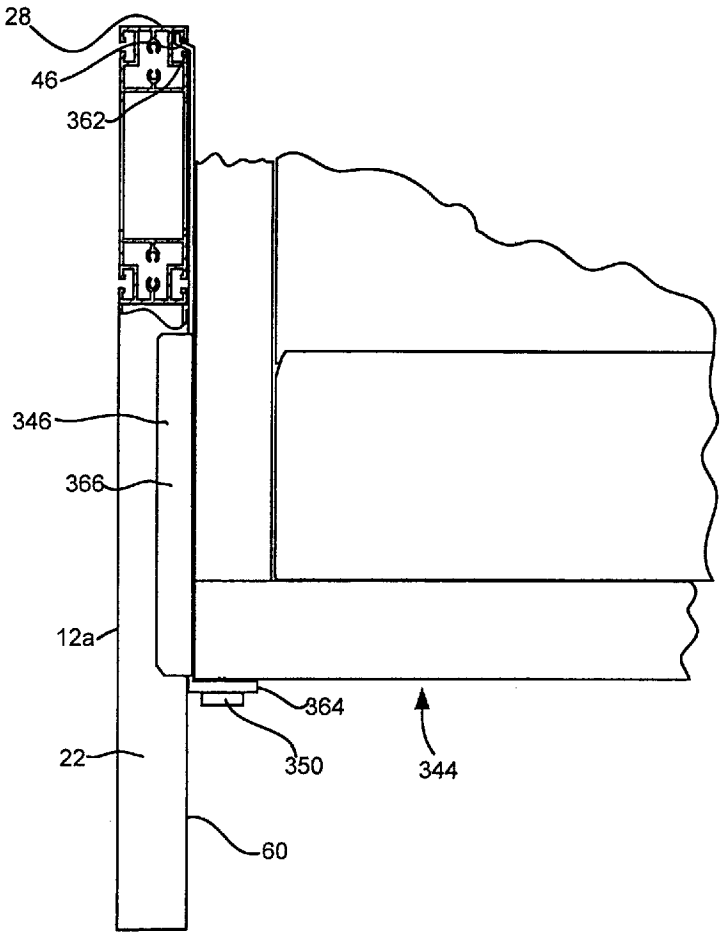
FIG. 42 is a partial cross-sectional view of the assembly of FIG. 39 showing the lounge bracket attached to a leg assembly and a lounge structure attached to the lounge bracket.

Referring once again to FIG. 39, initially it is assumed that channel assembly 18 is securely connected between leg assemblies 12*a* and 12*b*. Referring also to FIGS. 40 and 42, to install lounge sub-assembly 344, first brackets 346 are attached to the leg members 12*a* and 12*b*. To attach a bracket to a leg assembly, the lip member 362 is generally aligned with one of the upper rail slots 46 and is manipulated there into. Next, bracket 346 is rotate downward about the slot 348 until a rear surface of plate member 360 contact an adjacent side surface 60 of member 22. Here, flange member 366 extends in front of and generally contacts a front surface 11 of leg assembly 12*a* to restrict movement of the bracket 346 with respect to slot 48. Next, lounge structure 352 is aligned with the space between brackets 346 and is slid there into and set down on the shelf members 364 as shown in FIG. 42. Finger tightenable bolts 350 are slid through the bracket openings 368 and into threaded apertures in the undersurface 354 of lounge structure 352 to secure the lounge structure in place. The resulting configuration 340 is again shown in FIG. 39.

Figure 43:
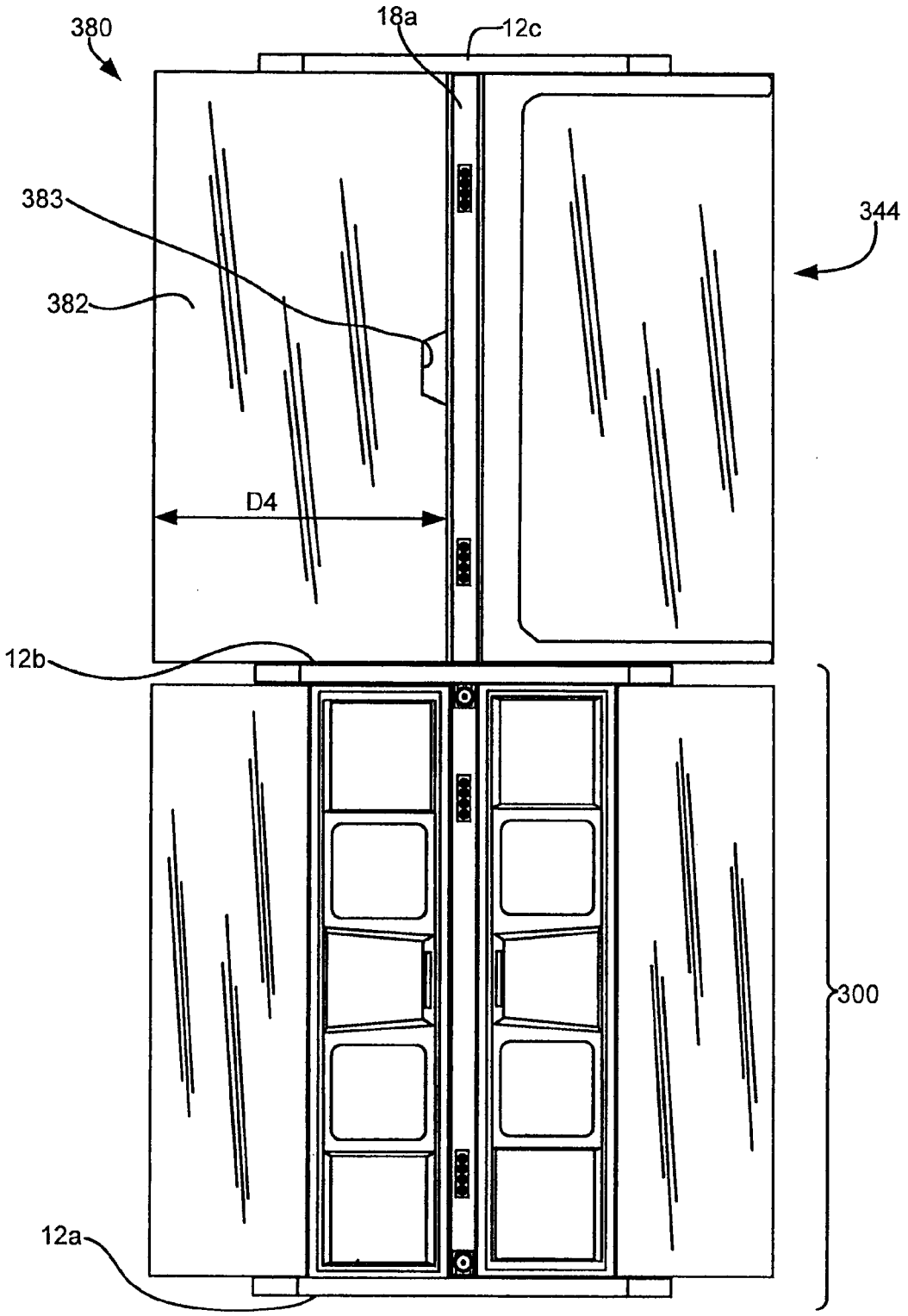
FIG. 43 is a top plan view showing yet another assembly that includes three workstations and a single lounge sub-assembly.

Referring to FIG. 43, another exemplary configuration 380 is illustrated that includes one of the configurations 300 shown in FIG. 33 as well as one of the lounge structures described above with respect to FIGS. 40 through 42 and a relatively deep table top assembly 382. Here, table top assembly 382 has a configuration that is similar to table top assembly 14 described above except that table top assembly 382 has a depth dimension D4 that is equal to the combined depths of the table top assembly 14 and one of the exemplary trough members 16 described above. Thus, table top assembly 382 takes the place of one of the table top assemblies 14 and a trough member 16 between leg members 12*b* and 12*c* and adjacent channel assembly 18*a*. Although not illustrated, table assembly 382 includes all of the components described above with respect to FIG. 21 on an underside thereof and mounts to the support arm members 15 (see again FIG. 15) in a similar fashion to that described above with respect to table top assembly 14. In this case brackets 278 (see FIG. 26) would be located about midway along each lateral edge of top member so as to be positioned to receive shoulder members 620 formed by support arm members 15 (see again FIG. 12). Table top assembly 382 forms a scalloped edge opening 383 along a rear edge to allow power/data wires to pass there through down to a space there below.

Thus, according to one aspect of the disclosed system, a kit of parts may be provided where addition parts can be added to an existing kit to add additional workstation or seating functionality. In addition, an existing configuration can be reconfigured to swap one furniture assembly for another furniture assembly while using a single core structure that includes leg assemblies 12*a* and 12*b* and a channel assembly 18. Any combinations of seating and workstation furniture assemblies may be constructed to fit requirements of specific applications. For instance, two lounge subassemblies 344 may be configured back-to-back, all workstation assemblies may include wide depth table top assemblies 382 (see again FIG. 43), etc.

Figure 44:
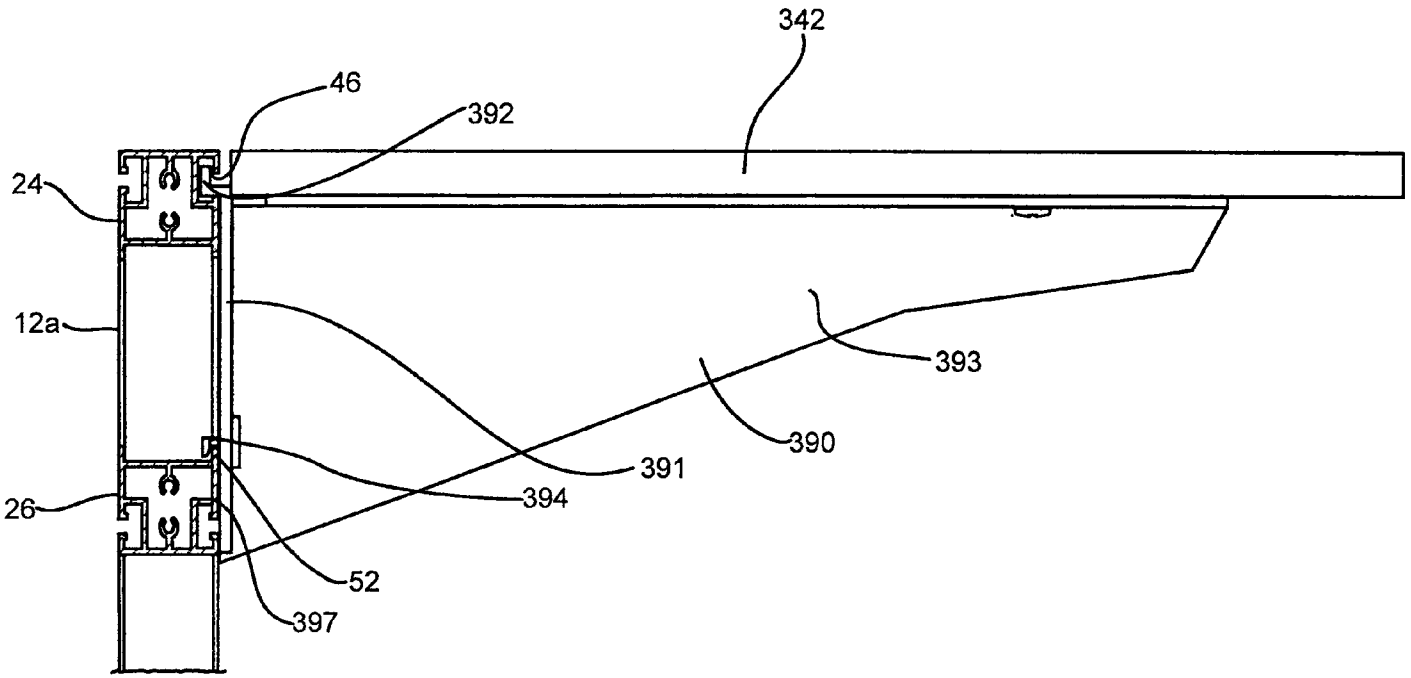
FIG. 44 is a partial cross-sectional view showing an end table and end bracket assembly that may be used to accessorize the assemblies shown in the other figures.

In addition to the components described above, at least some embodiments will include additional accessory components that can be attached to leg assemblies 12*a*, 12*b*, 12*c*, etc., via the slots and/or lips formed by the leg assembly rail members 24 and 26. For example, referring to FIG. 44, end table support brackets 390 (only one shown) may be provided for supporting a half-round table top 342 (see FIG. 39) or other type of end table via an upper rail slot 46 and lower rail lip 52. Exemplary bracket 390 includes a mounting plate 391 and an arm plate 393 that generally form a right angle. The mounting plate 391 includes a rearward and upward extending lip 392 along a top edge that is size and shaped similar to lip 190 in FIGS. 12 and 13 to be received in a rail slot 46. After lip 392 is received in slot 46, the lower portion of bracket 390 is rotated downward until a rear surface of plate 391 contacts an outer or external surface of side wall 397 of lower rail 26 so that arm member 393 is cantilevered from the leg assembly 12.

In the illustrated embodiment, a locking hook 394 is provided through plate 391 that aligns with upward extending lip 52 on rail 26 where the locking hook 394 can be rotated causing the hook 394 to engage lip 52 and retain bracket 390 on leg assembly 12. Half-round top member 342 is mounted via screws or other mechanical fasteners to the top of arm member 393.

As shown, the top surfaces of the half-round member 342, leg assembly 12*a* and top assembly 14 (see FIG. 39) are at the same height in at least some embodiments. Thus, the top surface of table top 342 and leg assembly top surface 28 form an extension of the worksurface 9 of top assembly 14.

Figure 45:
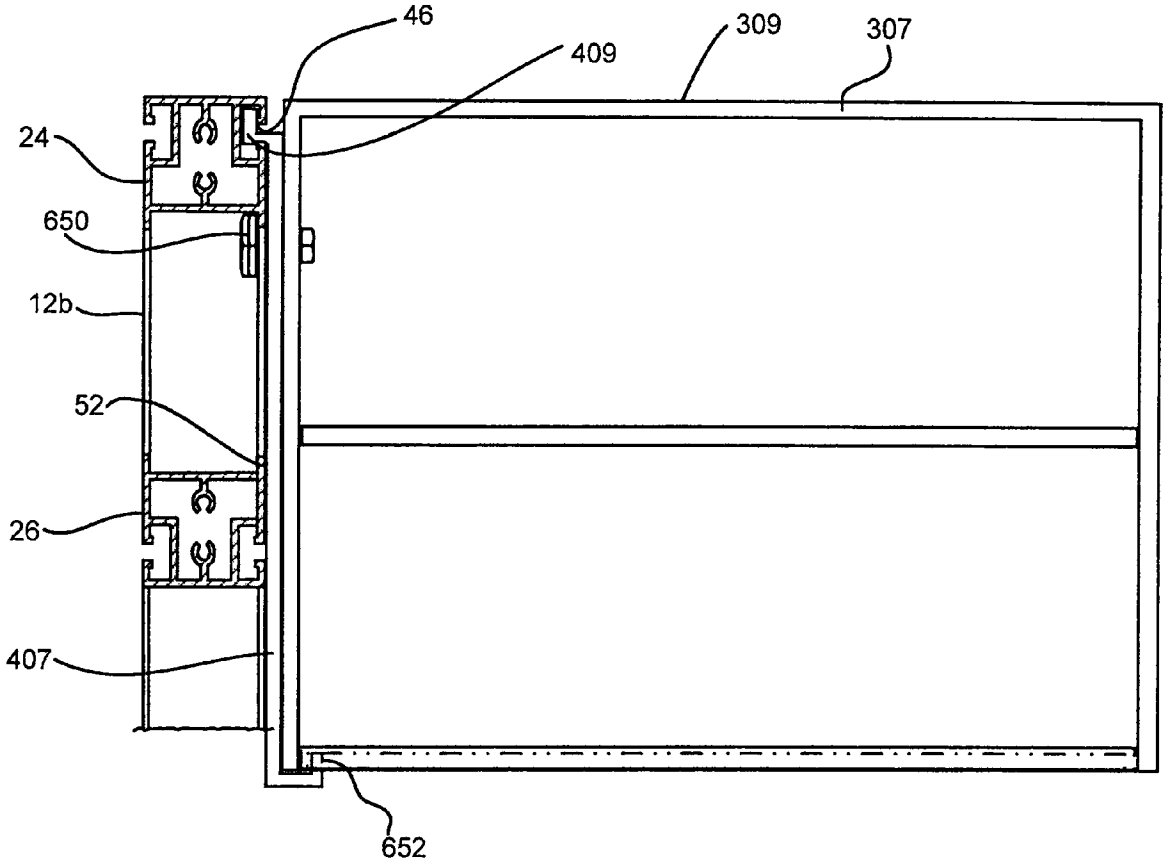
FIG. 45 is a partial cross-sectional view of a casegood accessory mounted to a side surface of one of the leg assemblies of FIG. 33.

Referring again to FIG. 33, a casegood accessory 307 is shown mounted to a vertical side surface of leg assembly 12*b* so that a top surface 309 of accessory 307 is at the same height as the top surfaces of assemblies 14 and 14*a*. Referring also to FIG. 45, to mount a casegood accessory 307 to leg 12*b*, two brackets 407 (one shown) that mount to a side surface of accessory 307 and that form upwardly extending lips 409 akin to lip 190 in FIGS. 12 and 13 are provided. As shown, lips 409 are received in upper rail T-slot 46 to hang accessory 307 along the side of the leg assembly 12*b*. The bottom of bracket 407 forms an upwardly extending hook or lip member 652 that hooks on to a lower edge of one of the side walls that forms a casegood 307 (i.e., the bottom wall of casegood 307 is recessed). Top surface 309 provides an extension of the worksurface of top assemblies 14 and 14*a* as shown in FIG. 33. two nut and bolt pairs 650 (only one shown) are provided for each of the brackets 407. each nut and bolt pair includes a large head bolt and an associated nut. A threaded shaft of each bolt extends through aligned openings in bracket 407 and a side wall of casegood 307 and is received in the associated nut to secure casegood 307 to the brackets 407. In at least some embodiments the openings in bracket 407 and casegood 307 are aligned immediately adjacent a lower edge of lip member 50 formed by upper rail 24 so that lip 50 is sandwiched between facing surfaces of brackets 407 and the large head of bolt 650 so that the bolt head restricts rotation of casegood 307 about slot 46.

Figure 46:
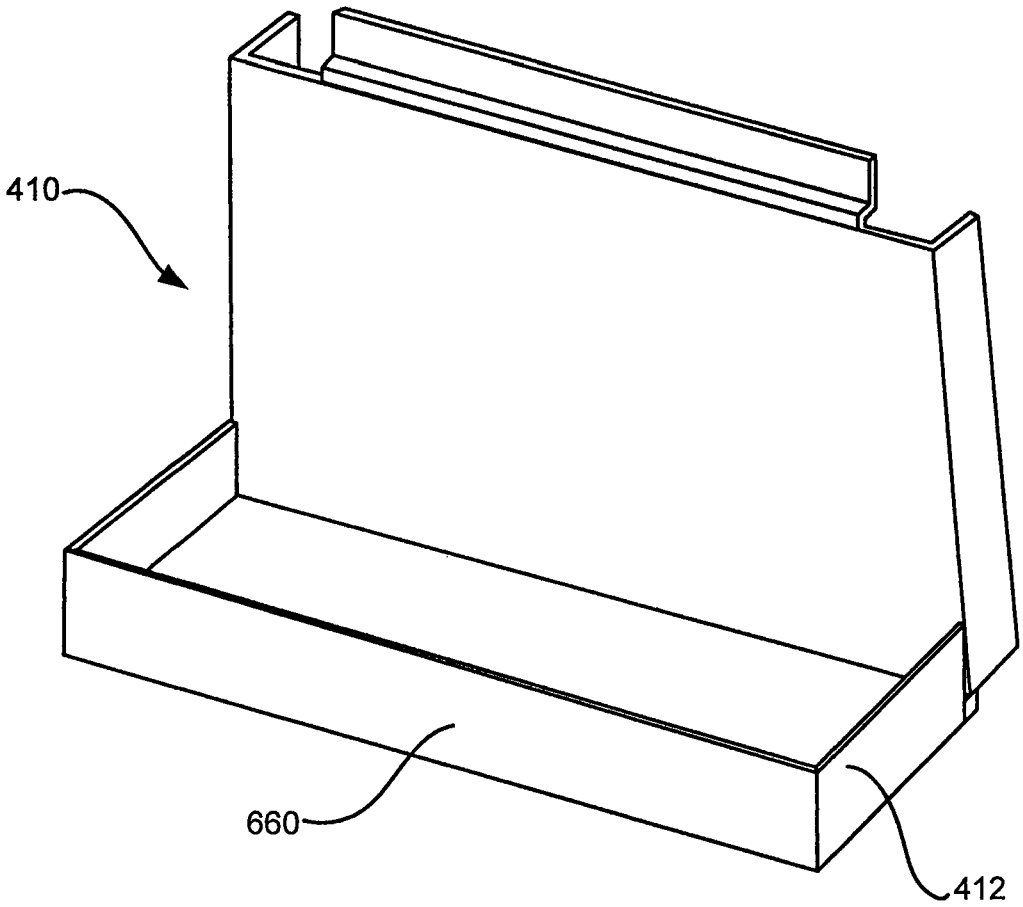
FIG. 46 is a perspective of the shelf bracket shown in FIG. 32.

Referring to FIG. 46, another exemplary accessory that may be provided for use with the configurations described above includes a shelf bracket 410. Here, bracket 410 has characteristics that are similar to the lounge bracket 346 described above except that the member 364 (see FIG. 41) is replaced by a larger shelf member 412 that does not form bolt passing holes. Exemplary shelf 410 is shown in FIG. 32 with an upwardly extending lip member received in a lower rail channel. While shelf bracket 410 is shown on an external surface of the leg assembly 12, it should be appreciated that the shelf bracket 410 may also be attached on an internal surface via an internal rail slot.

Figure 47:
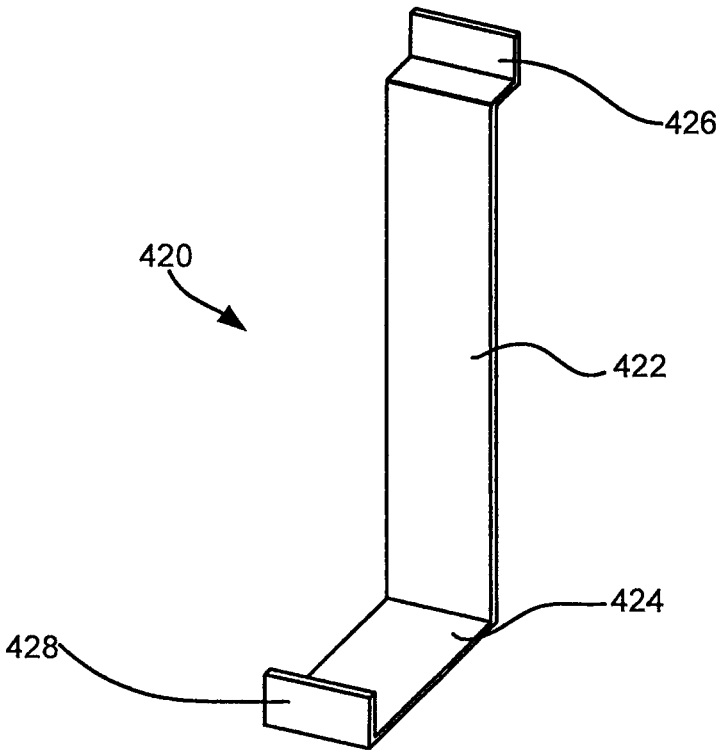
FIG. 47 is a perspective view of the purse or hook bracket shown in FIG. 32.

Referring to FIG. 47, another exemplary accessory includes a purse or hook type accessory 420 that includes a vertical member 422, a horizontal shelf member 424, an end lip member 428 and an attaching lip member 426. Referring again to FIG. 32, the exemplary hook bracket 420 is shown attached to a slot formed by a lower leg assembly rail with the lip member 426 received within the slot.

Figure 48:
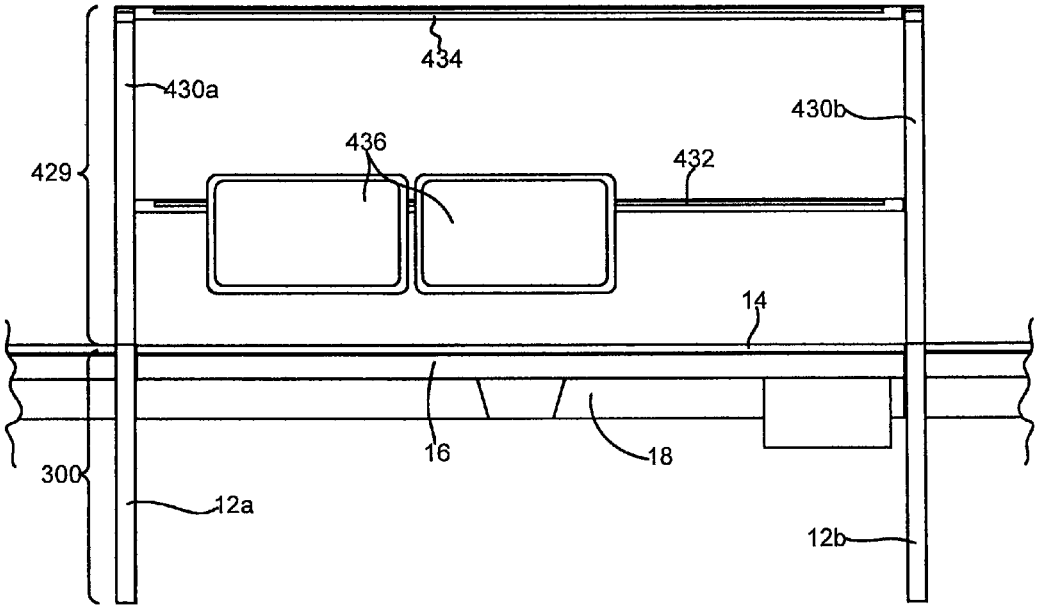
FIG. 48 is a front plan view of a desk assembly including an arch assembly added to the desk assembly.

Referring once again to FIG. 33, in at least some embodiments, it is contemplated that where facing workstations are configured, station users may desire additional arch type structure for supporting computer display screens, additional storage space, etc. To this end, referring to FIG. 48, in at least some embodiments, an additional arch assembly 429 may be added to the configuration 300 described above. Arch assembly 429 includes vertical arch assemblies 430*a* and 430*b* that mount to and extend generally upwardly from leg assemblies 12*a* and 12*b*, an upper cross rail member 434 and an intermediate cross rail member 432. In FIG. 48, two display screens 436 are shown mounted to intermediate cross rail member 432. The rail members 432 and 434 mount to the vertical frame assemblies 430 and extend there between generally above a centrally located channel member 18.

Figure 49:
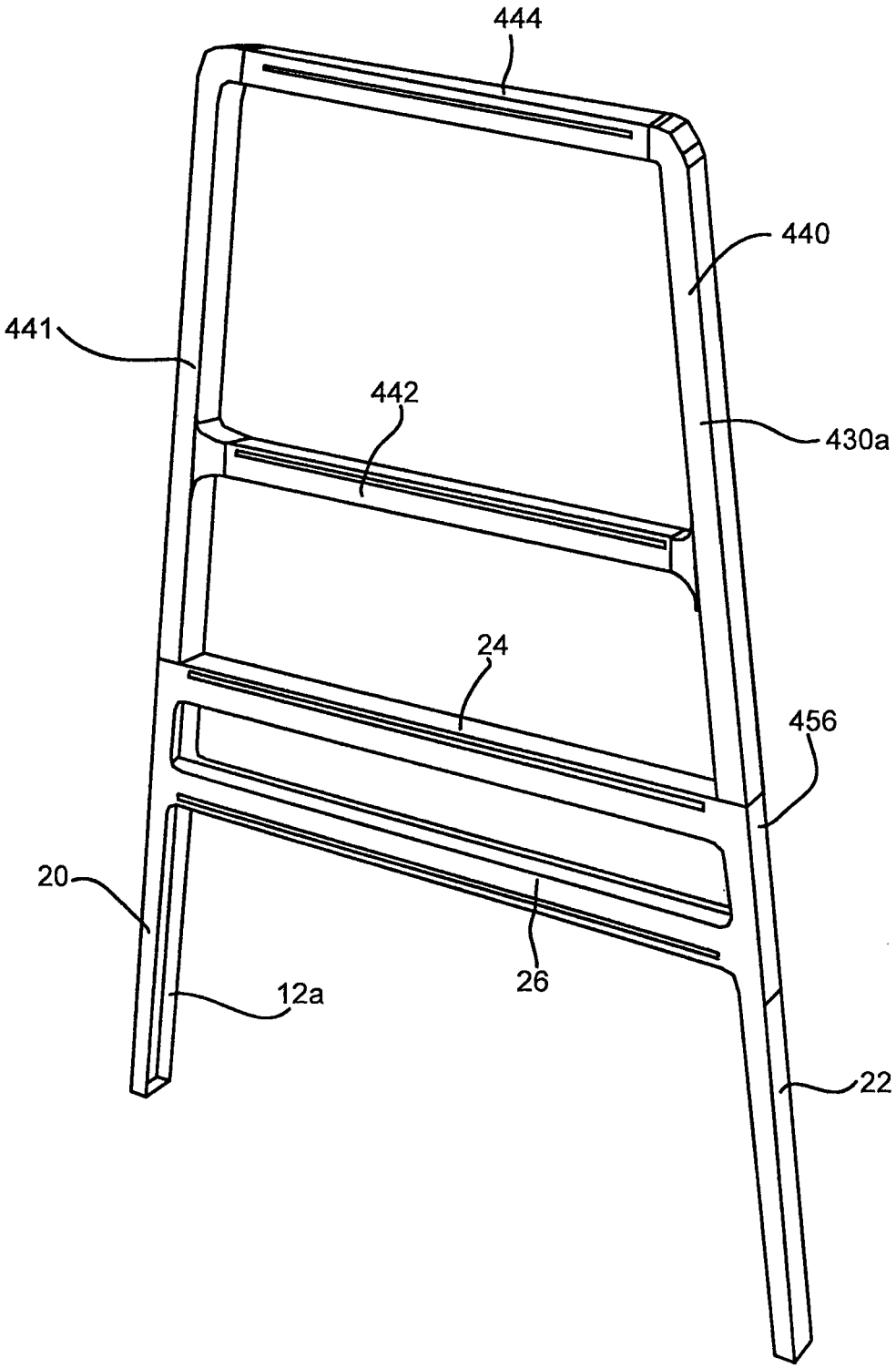
FIG. 49 is a perspective view of the exemplary leg and arch extension structure shown in FIG. 48.

Referring to FIG. 49, an exemplary vertical arch assembly 430*a* includes first and second vertical members 440 and 441 as well as a top rail member 444 and an intermediate or lower rail member 442. The rail members 444 and 442 are formed of the same extruded rail stock that is used to form the leg assembly rail members 24 and 26. Vertical members 440 and 441 attach at lower ends to the top ends of vertical leg members 20 and 22. To this end, referring again to FIG. 6, an arch mounting threaded hole 88 is provided within vertical leg member 20 for attaching an arch mounting bracket 450. In addition, a web/lattice structure including a plurality of ribs 67, 71, 73 is formed within space 91 (see FIG. 6) that operates to guide or restrict placement of the lower end of bracket 450 (see phantom in FIG. 6) upon attachment. In addition to restricting placement, the ribs 67, 71, 73 cooperate with bracket 450 to increase rigidity in the connection between the leg assembly and the arch assembly and to limit side-to-side sway between the two assemblies. Referring also to FIG. 7, the leg assembly 12 cover 40 can be removed to gain access to hole 88.

Figure 50:
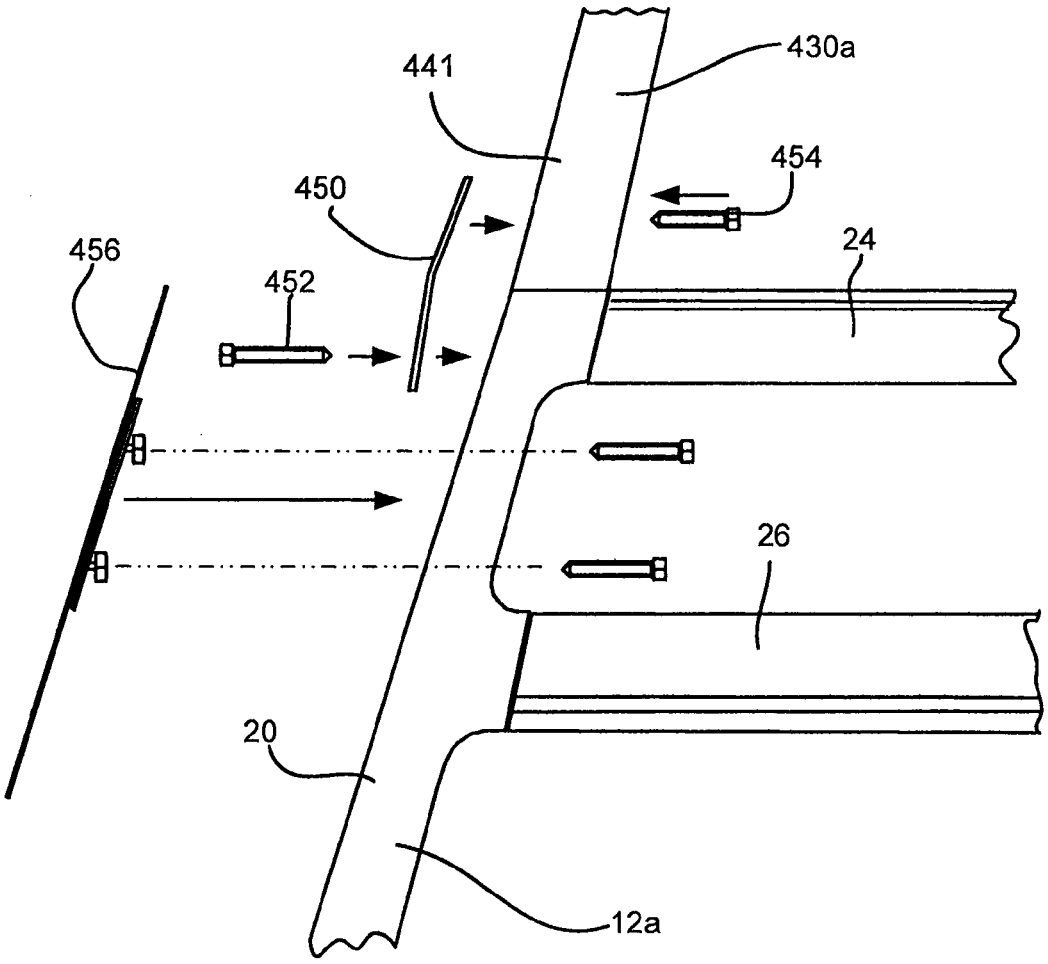
FIG. 50 is a partially exploded view of an arch attachment mechanism that is consistent with at least some aspects of the present invention.
Figure 51:
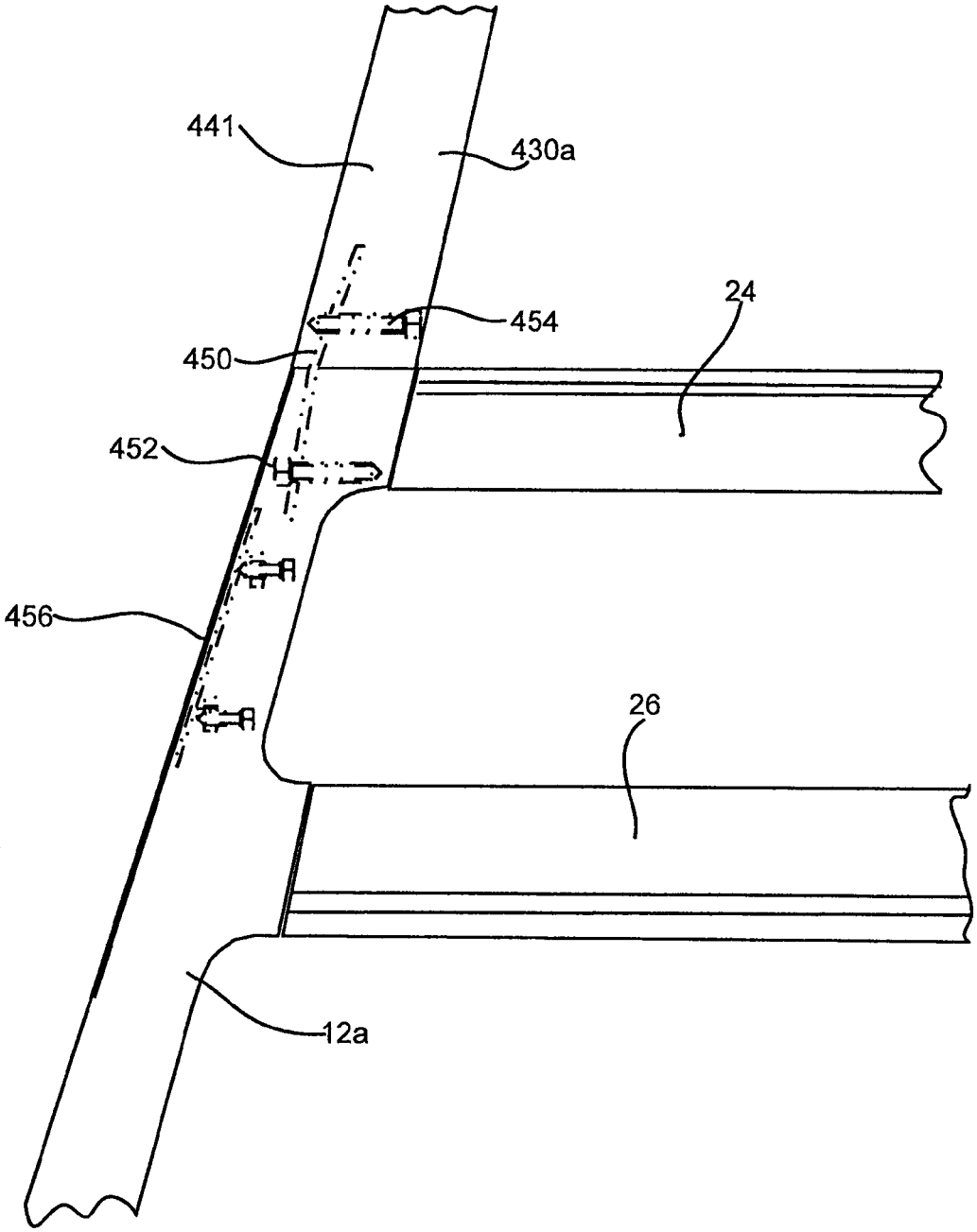
FIG. 51 is similar to FIG. 50, albeit showing the attachment mechanism assembled.

Referring to FIG. 50, a rigid metal bracket 451 and arch mounting screws 452 and 454 are provided. Bracket 451 mounts at one end via screw 452 to hole 88 (see again FIG. 6) where the lower end of bracket 450 is aligned with hole 88 via ribs 67, 71, 73. The top end of arch mounting bracket 450 passes through top slot 90 (see FIG. 6) and is inserted into a slot in the lower end of vertical member 440. Screw 454 is used to lock the bracket 450 to member 440. Next, a second cover member 456 that is designed for use when arch assembly is attached to the leg assembly 12 to close the space formed at the top of vertical leg member 20. FIG. 51 shows the arch/leg assembly connection in phantom.

Figure 52:
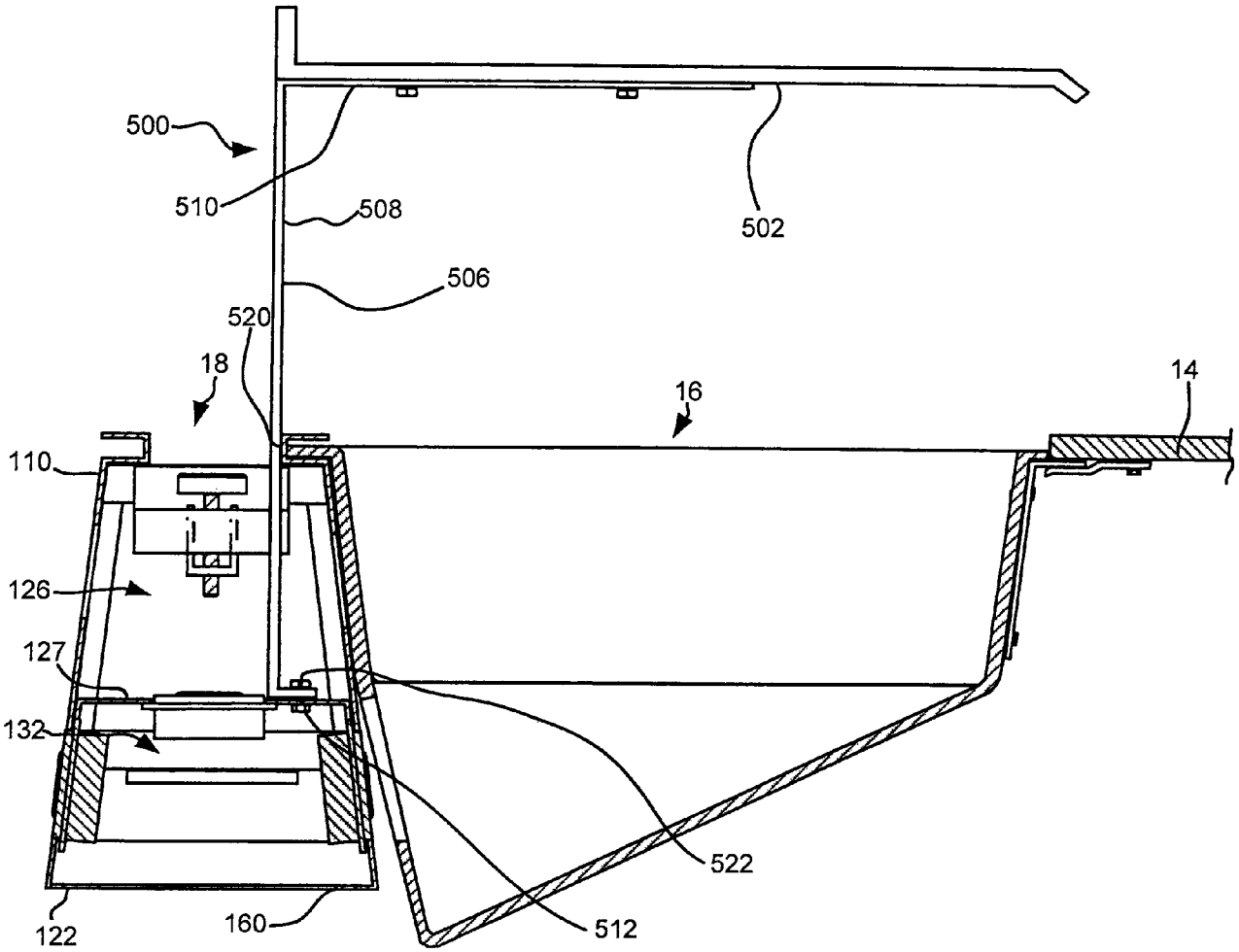
FIG. 52 is a partial cross-sectional view taken along the line 52-52 in FIG. 32 showing a channel mounted shelf assembly.
Figure 53:
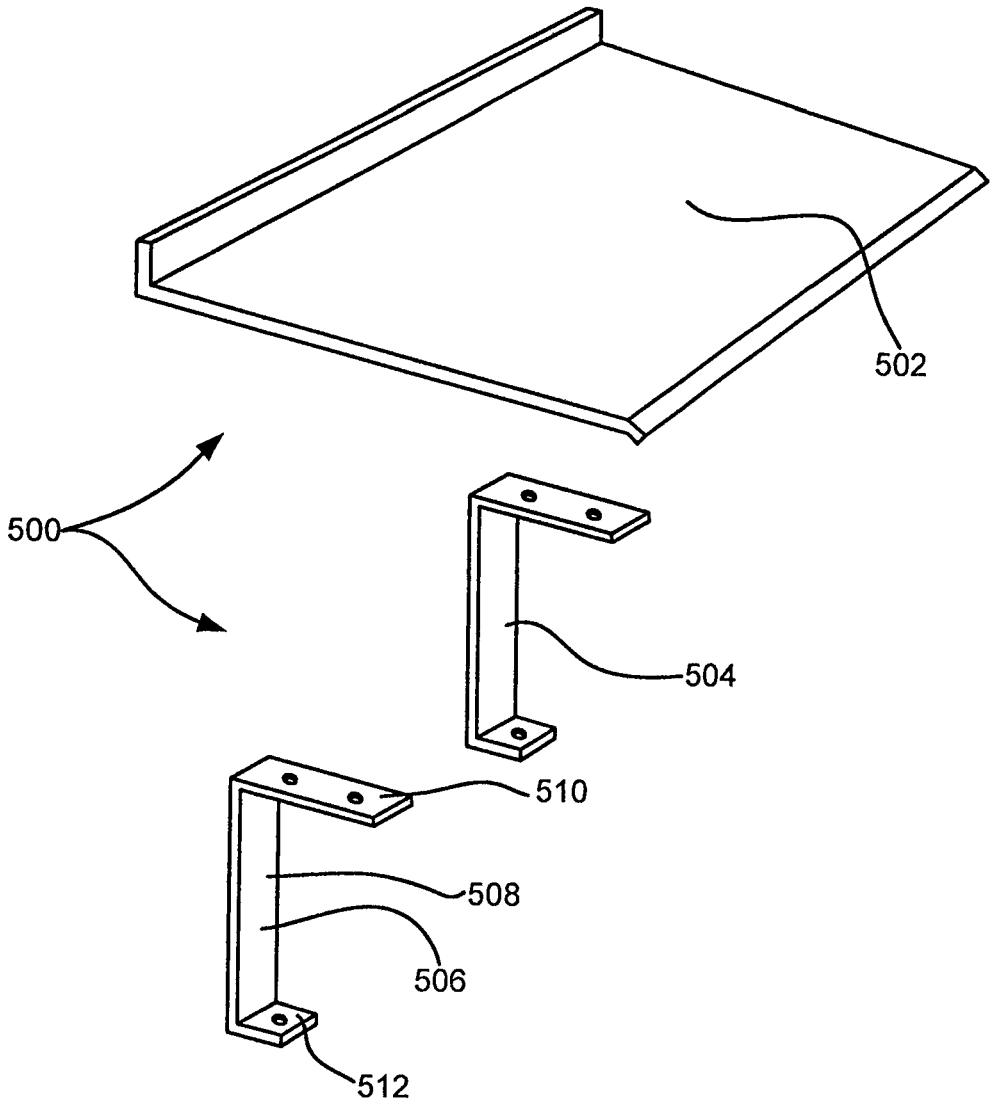
FIG. 53 is an exploded perspective view of the shelf assembly shown in FIG. 52.

Referring again to FIG. 32 and also to FIG. 52, a shelf assembly 500 for providing an over trough shelf is shown mounted within channel 126 formed by channel assembly 18. Referring also to FIG. 9, pairs of mounting holes 670 (shown in phantom) are provided within the intermediate wall 127 of channel housing 110. In the illustrated example six hole pairs 670 are shown, three pairs adjacent each side wall of housing 110 where each three pairs include a left pair, a right pair and a center pair. Referring to FIG. 53, shelf assembly 500 includes a shelf member 502 and first and second brackets 504 and 506. Exemplary bracket 506 includes a foot member 512, a leg member 508 and an arm member 510 where the foot and arm members 512 and 510 extend from opposite ends of leg member 508 in the same direction and are perpendicular to leg member 58. Each of the foot and arm members 512 and 510 form mounting holes. Arm members 510 are longer than foot members 512. Shelf member 502 includes a top shelf surface and an undersurface.

Referring to FIG. 52, a lower end of each bracket 504 and 506 is mounted via a bolt 522 to one of the mounting holes 670 inside channel 126 with leg members 508 extending up and out of the channel housing 110. A surface of leg member 508 facing housing 110 provides additional support to leg member 508. Arm members 510 extend over trough member 16 and shelf member 502 is mounted to arm members 510 as shown in FIGS. 32 and 52. While not shown, two or three shelf assemblies may be mounted over each trough member in a table configuration in a side-by-side manner.

Figure 54:
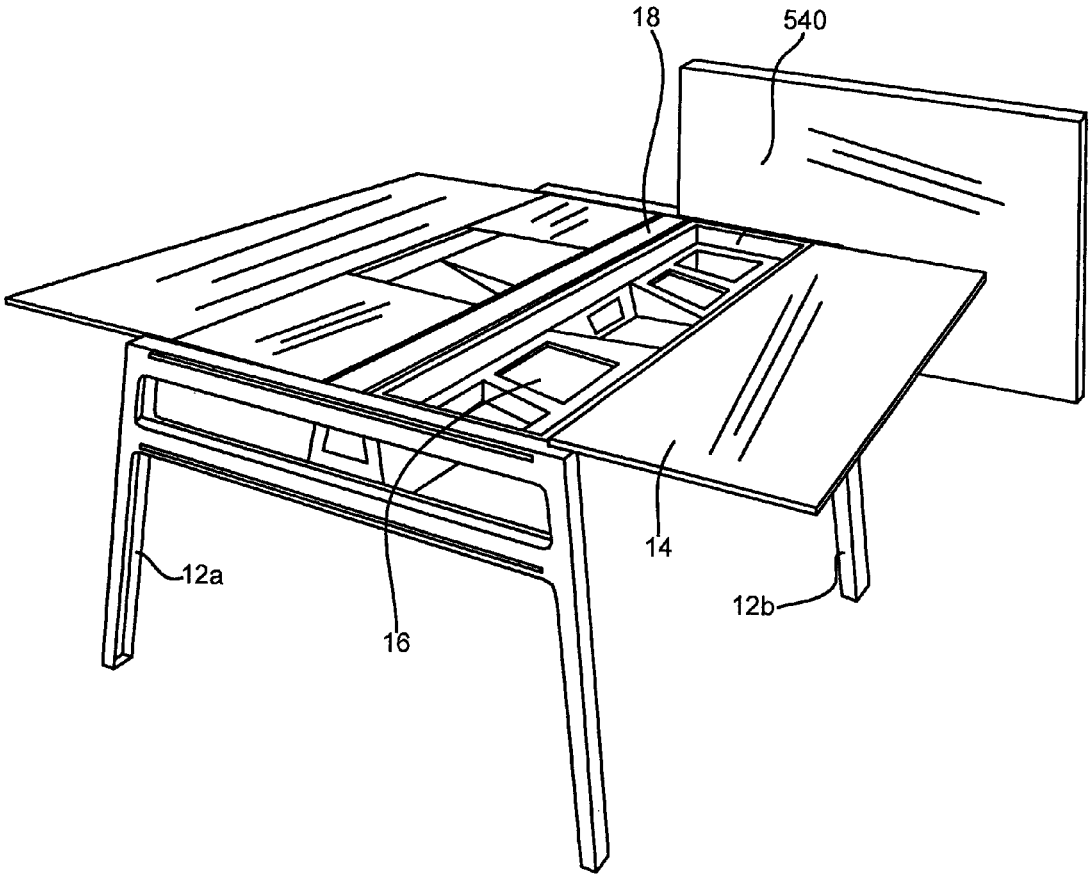
FIG. 54 is a perspective view of a table assembly similar to the table assembly shown in FIG. 33; albeit where a privacy screen assembly has been installed on one of the leg assembly.

Referring now to FIG. 54, yet one other accessory that may be provided in some table configurations includes a space dividing or privacy screen assembly 540 that can be mounted to either end of any of the leg assemblies described above. Referring also to FIGS. 55 through 57 and FIG. 23, exemplary screen assembly 540 includes a screen member 542, a bolting bracket member 548 and a clip type bracket member 550. Screen member 542 can be formed of any rigid and generally planar material. Illustrated screen member 542 is generally rectangular with a lower corner cut out to form a horizontal intermediate edge 544 and an angled intermediate edge 546. The angle between edges 544 and 546 is identical to the angle between the top surface 28 of one of the leg assemblies 12*a* and the front surface 22 of the same leg assembly 12*a* (see FIG. 3) so that after being installed, screen member 542 generally conforms to the top and front surfaces of the leg assembly.

Figure 55:
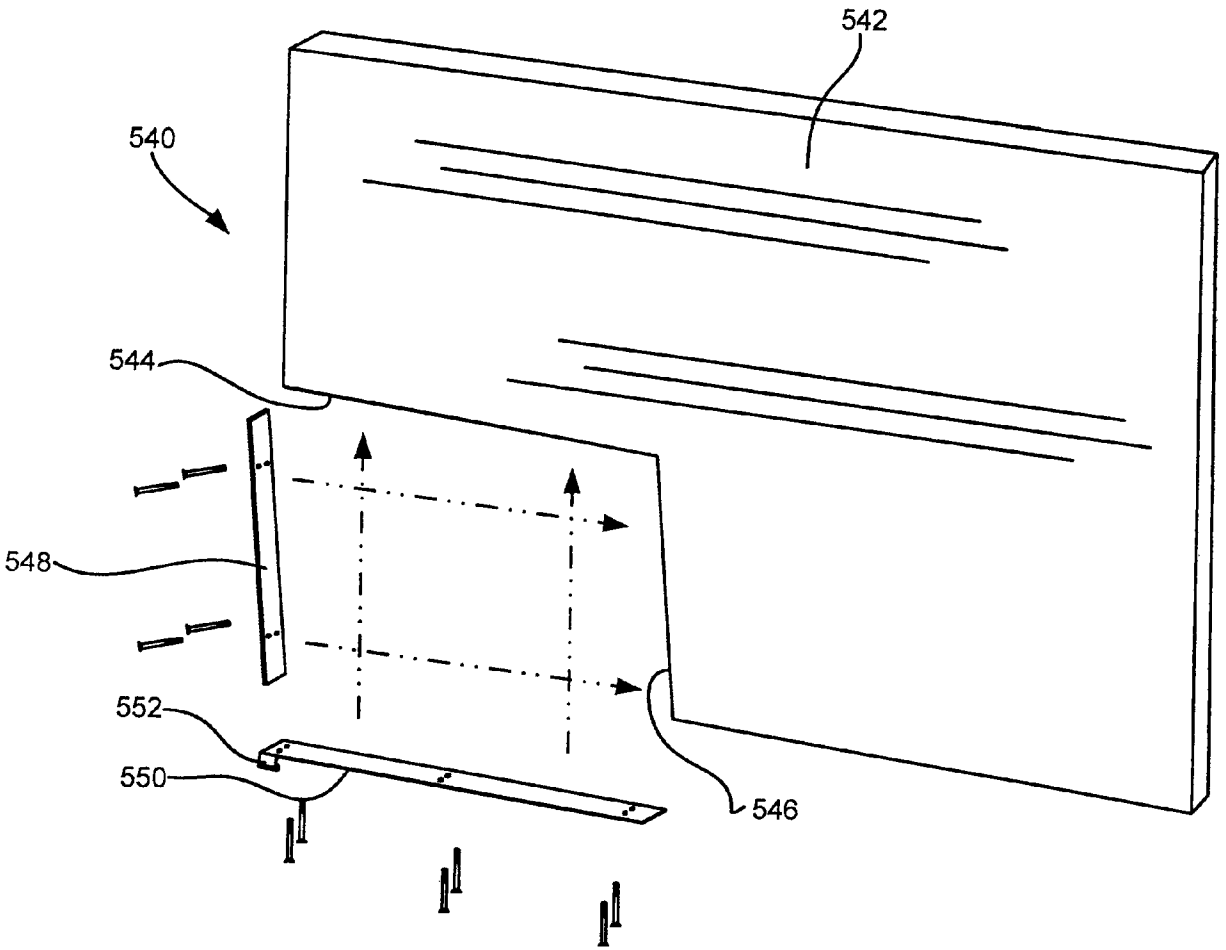
FIG. 55 is an exploded view of the screen assembly shown in FIG. 54.
Figure 56:
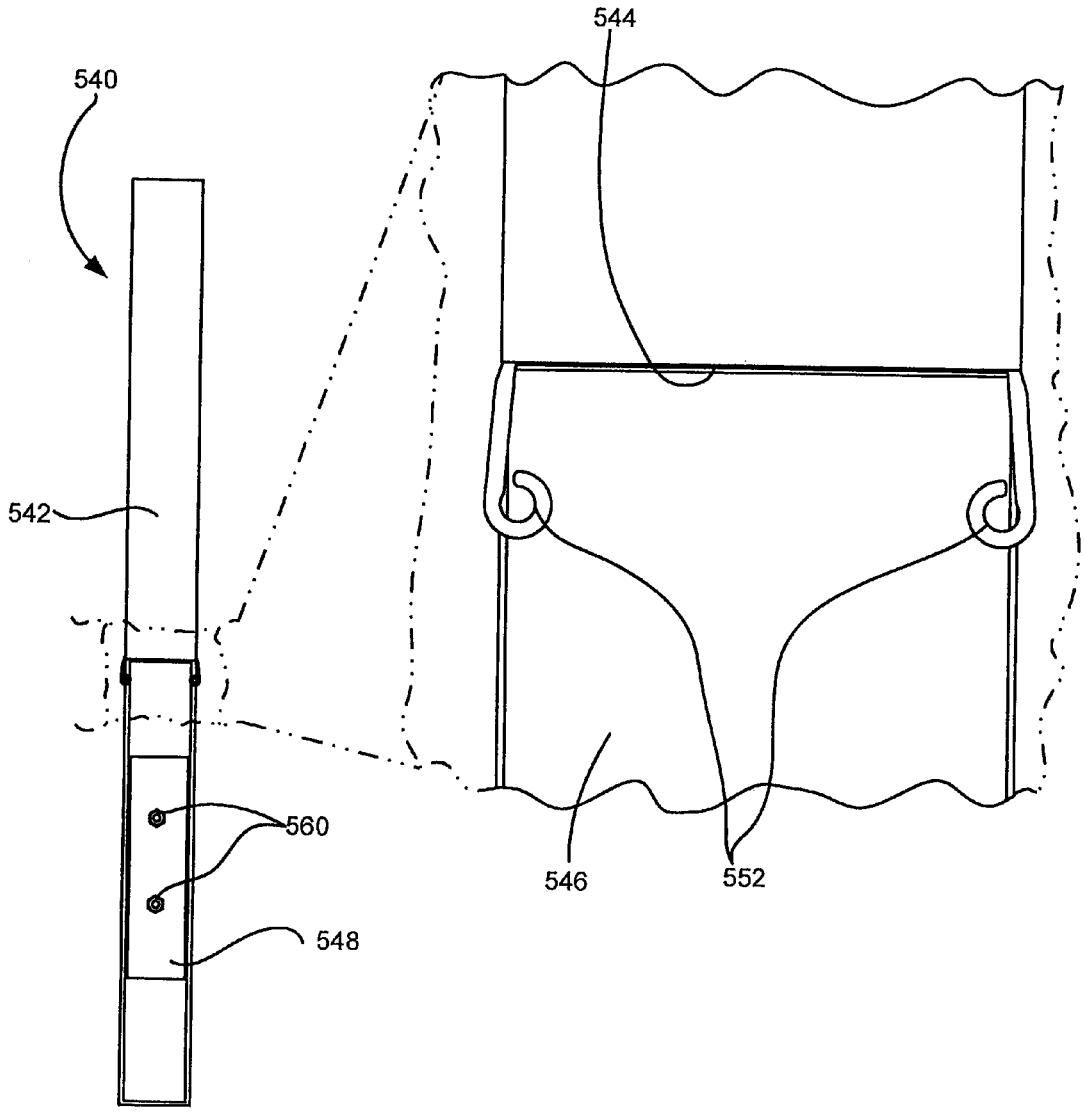
FIG. 56 is an end view of the screen assembly shown in FIG. 54.
Figure 57:
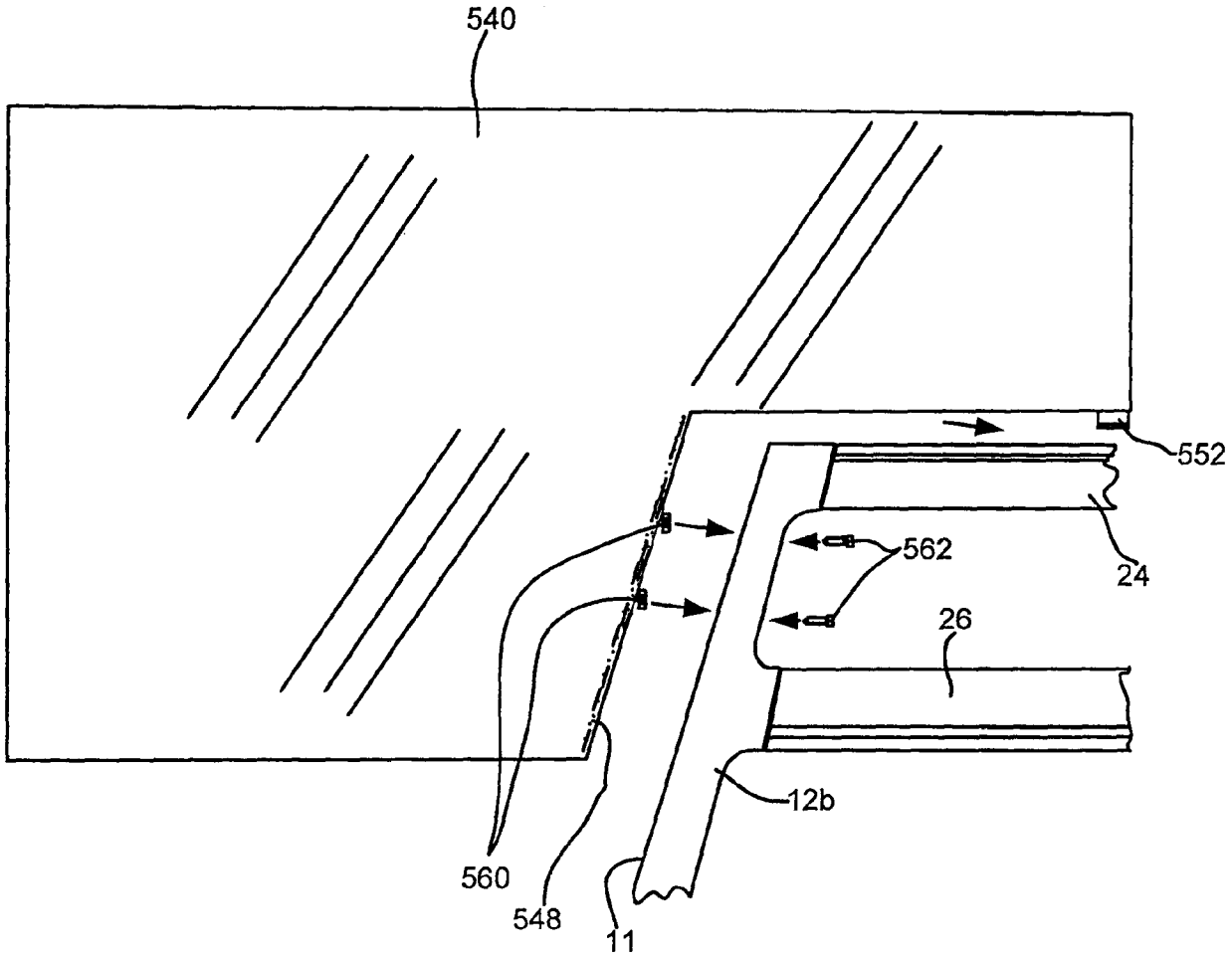
FIG. 57 is a side view of the screen assembly of FIG. 54 and a related leg assembly.

Referring still to FIGS. 55-57, bolting bracket 548 is a metal strip that is secured via screws, adhesive or some other means to angled edge 546. Bracket 548 forms posts 560 that form threaded openings that are sized and arranged to be identical to the mounting structure on the inside surface of one of the cover members described above (see again FIG. 7) so that bracket 548 and the associated screen assembly can be mounted to one of the leg assemblies 12*a* after a corner member has been removed.

Bracket 550 is an elongated rigid metal strip that includes two spring clip members 552 at one end. Clip members 552 are spaced apart a distance similar to the width of rail 24 (see again FIG. 23). Bracket 550 is screwed to, adhered to or otherwise attached to horizontal edge 544 of member 542 with clip members 552 extending downward therefrom at an end opposite the location of bolting bracket 548. In other embodiments members 548 and 550 may form a portion of a larger metal frame type screen structure.

To secure assembly 540 to a leg assembly 12*b*, referring to FIG. 57, assembly 540 is aligned along a side of leg assembly 12*b* and is forced downward until clip members 552 contact edges of top surface 28 and are forced apart. Assembly 540 is forced further downward until distal ends of clip members are received within oppositely opening slots 30 and 46 in top rail 24 (see FIG. 23). Assembly 540 is slid along top surface 28 until bracket 548 is adjacent an outer surface 11 of leg assembly 12*b* and screws 562 are passed through openings 86 and are received in post 560 holes. Thus, screws 562 and clips 552 cooperate to secure screen assembly 540 to leg assembly 12*b*.

Figure 58:
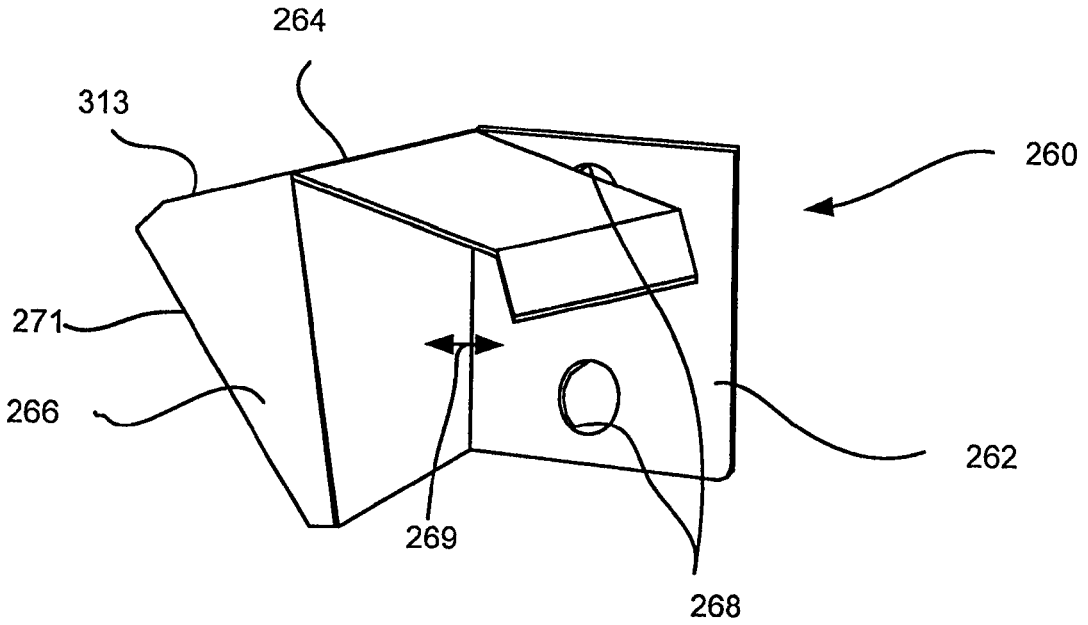
FIG. 58 is a perspective view of a latching bracket used to latch a trough member and/or a table top assembly a to a support arm members according to one additional aspect of the present disclosure.

While one way to secure a trough and a table top assembly to support arm members has been described above, other structure for accomplishing this task is also contemplated. To this end, an exemplary spring clip latching bracket 260 is shown in FIG. 58. Latching bracket 260 is an integrally formed resiliently flexible metal member that includes a mounting plate 262, a spring plate 264, a latch plate 266 and a handle member 271. Exemplary mounting plate 262 is rectilinear and forms two holes 268 for passing screws or bolts for mounting latching bracket 260 to trough member 16. Spring plate 264 extends from one of the long edges of mounting plate 262, is generally rectilinear and forms an obtuse angle with mounting plate 262. Latch plate 266 extends from one of the long edges of spring plate 264 opposite the edge that is attached to mounting plate 262 and generally has a triangular shape. A long edge opposite the edge attached to spring plate 264 forms a bearing edge 271. A short top edge of latch plate 266 forms a latch edge 270.

Latch plate 270 generally extends from spring plate 264 in a direction opposite the direction in which mounting plate 262 extends. Handle member 273 is attached along an upper short edge of spring plate 264 and generally extends to the same side of spring plate 264 as does mounting plate 262. While spring plate 264 has a steady-state configuration as shown in FIG. 58, as the label implies, spring plate 264 can be resiliently deformed by temporarily bending as indicated by arrow 269. To this end, when a force is applied along edge 271, spring plate 264 tends to bend generally toward mounting plate 262. Similarly, when force is applied to handle member 273 tending to move member 273 toward plate member 262, spring plate 264 likewise moves towards member 262.

Figure 59:
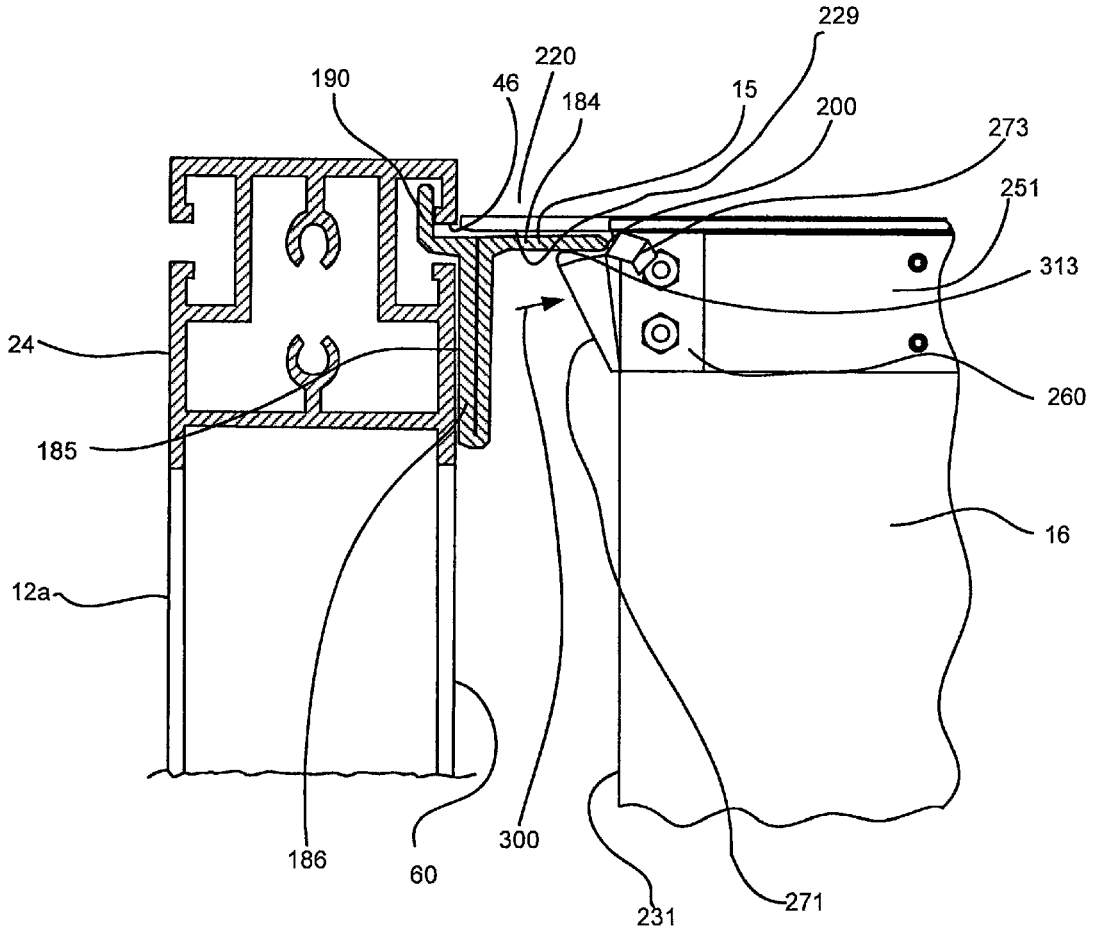
FIG. 59 shows the bracket of FIG. 58 latching a trough member to a support arm member.

Referring now to FIG. 59, an exemplary latching bracket 260 is shown mounted to an external surface of trough member 16 at one end of metal stringer member 251. As shown, latch plate 266 extends past an external surface of side wall member 231 and generally under a bottom surface of the trough lip member 220. Referring also to FIG. 14, the exemplary latching bracket shown in FIG. 59 is mounted generally at the location indicated by numeral 197. Although not shown in detail, a second latching bracket 260 is mounted at the second end 218 of trough member 16 in the area indicated by numeral 680 for interacting with the second arm support member 15 upon assembly.

Where brackets 260 are mounted to a trough member 16, to secure the trough member 16 to a channel assembly 16 and support arm members 15, after the rear portion of lip member 220 is received in channel 148 (see FIG. 26 again), the front edge portion of trough member 16 is lowered until the bearing edges 271 of latching brackets 260 contact adjacent edges 200 of shelf members 180 (see again FIG. 12). As the trough member 16 is forced downward, edges 200 apply a force to bearing surfaces 271 causing spring plates 269 to temporarily deform until latch members 266 clear edges 200. Once members 266 clears edges 200, spring plates 269 springs back to their steady-state positions and members 184 are sandwiched between latch edges 313 and the undersurfaces 229 of the lip member 220.

Bracket 260 in FIG. 58 can also be used as part of a different coupling assembly to mount table top assembly 14 to support arm members 15. To this end, referring to FIG. 60, an exemplary coupling assembly 280 includes a bracket 260*a* akin to bracket 260 illustrated in FIG. 58 and described above as well as a pin member 282. Like bracket 260 described above, bracket 260*a* includes a handle 273*a*, a latch edge 270*a* and a bearing edge 271*a*. Bracket 260*a* is mounted to strengthening runner 276 adjacent edge 451 with latch edge 270*a* generally facing the undersurface 270 of top member 279. In this embodiment a pin 282 is mounted to undersurface 270 and extends therefrom adjacent latching bracket 260*a*.

Figure 60:
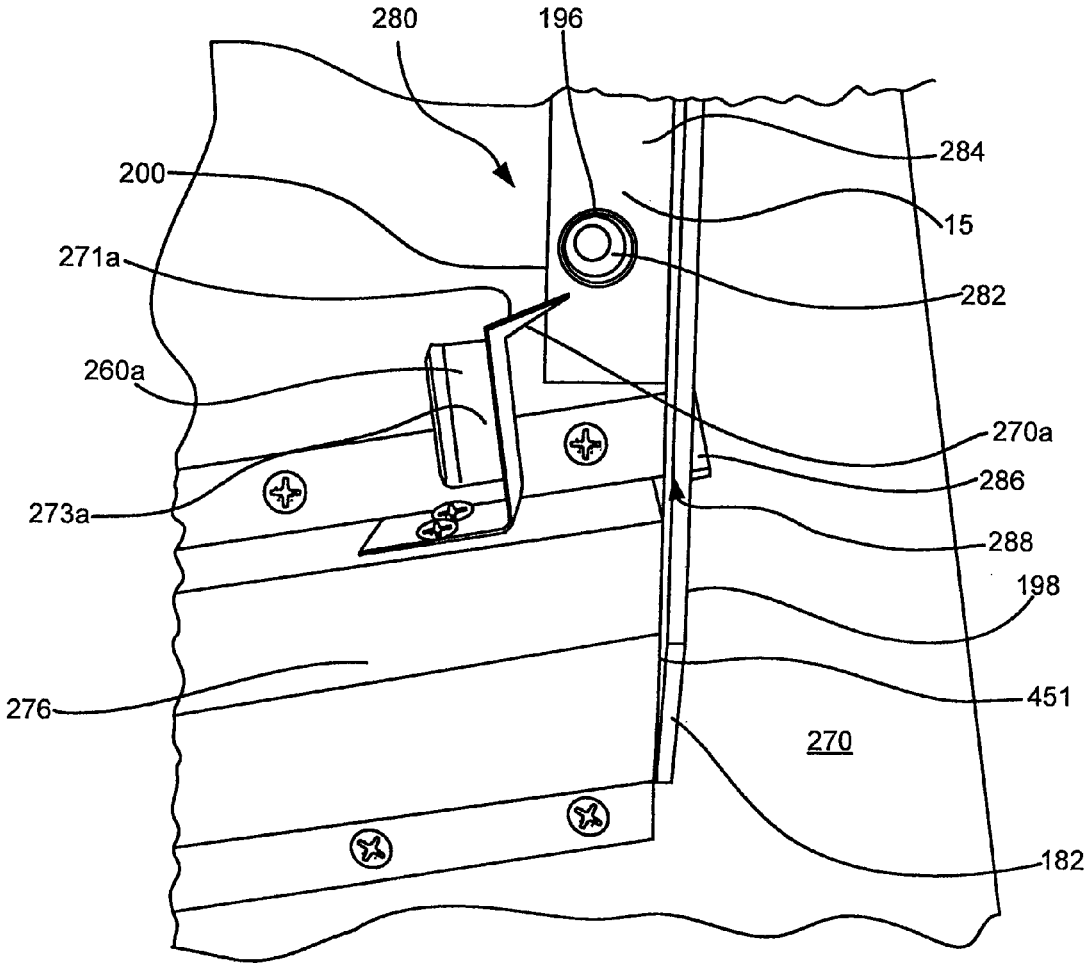
FIG. 60 shows one of the latching brackets of FIG. 58 latching a table top assembly to a support arm member according to another embodiment of the present disclosure.

Referring still to FIG. 60, again to FIG. 12, coupling assembly 280 components are mounted relative to each other such that, upon assembly of the configuration shown in FIG. 1, distal ends of the arm support members 15 are generally aligned with the coupling assemblies 280 and cooperate therewith to secure the table top member 279 to the support arm members 15. To this end, generally, as seen in FIG. 60, upon assembly, finger member 198 at the distal end of one of the support arm members 15 is received within slot 288 formed between edge 451 and the facing edge of finger member 286, pin 282 is received within hole 196 and shelf support member 184 is sandwiched between latch edge 270*a* and the undersurface 270 of the table top member. When so attached, the top member cannot be removed unless an assembly user affirmatively de-latches the latching bracket 260*a* by forcing handle member 273*a* into the unlatched position.

To secure a table top assembly 14 that includes brackets 260*a* to the support arm members 15, as the front edge of the table assembly 14 is lowered, bearing edges 271*a* of brackets 260*a* contact edges 200 formed by arm members 15 (see again FIG. 12) and force is applied through the bearing surfaces 271*a* to the spring plates that form part of brackets 260*a* causing the spring plates to deform until the latch members of the brackets 260*a* clear edges 200. After the latch members clear edges 200, the spring plates spring back into their steady-state positions and members 284 are sandwiched between undersurface 270 of the top member and the latch edge 270*a*.

While the invention may be susceptible to various modifications and alternative forms, specific embodiments have been shown by way of example in the drawings and have been described in detail herein. However, it should be understood that the invention is not intended to be limited to the particular forms disclosed. For example, while the embodiments described above each include a channel assembly 18, it should be appreciated that at least some embodiments may include a rigid rail as opposed to a channel forming member where the rail is slidably mounted at opposite ends to facing leg assembly slots. In this case, separate wire management structure could be mounted to undersurface of table tops. As another example, the leg assemblies may form coupling or support surfaces other than lip members for channel/rail attachment in at least some embodiments.

As still one other example, many other multiple person work station configurations can be constructed using the components described above. For example, referring now to FIG. 61, another configuration 580 is illustrated that includes three separate work station spaces. In configuration 580, the work stations all generally face in the same direction but they are staggered side-by-side. The components that are used to provide configuration 580 include all the components described above with respect to configuration 10 shown in FIG. 1 as well as other station subassemblies 10*a* and 10*b*. Subassembly 10*a* includes a third leg assembly 12*c*, a second table top assembly 14*a*, a second channel assembly 18*a* and a second trough member 16*a*. Similarly, subassembly 10*b* includes a fourth leg assembly 12*d*, a third table top assembly 14*b*, a third channel assembly 18*b* and a third trough member 16*b*. As shown, first channel assembly 18 is mounted at one end to a rear portion of leg assembly 12*a* and at the opposite end centrally to leg assembly 12*b* with trough member 16 and table top assembly 14 arranged to a forward side of channel assembly 18. Thus, while table top assembly 14 resided generally along one of the side surfaces of leg assembly 12*a*, table top assembly 14 is cantilevered generally to a front side of leg assembly 12*b*.

Figure 61:
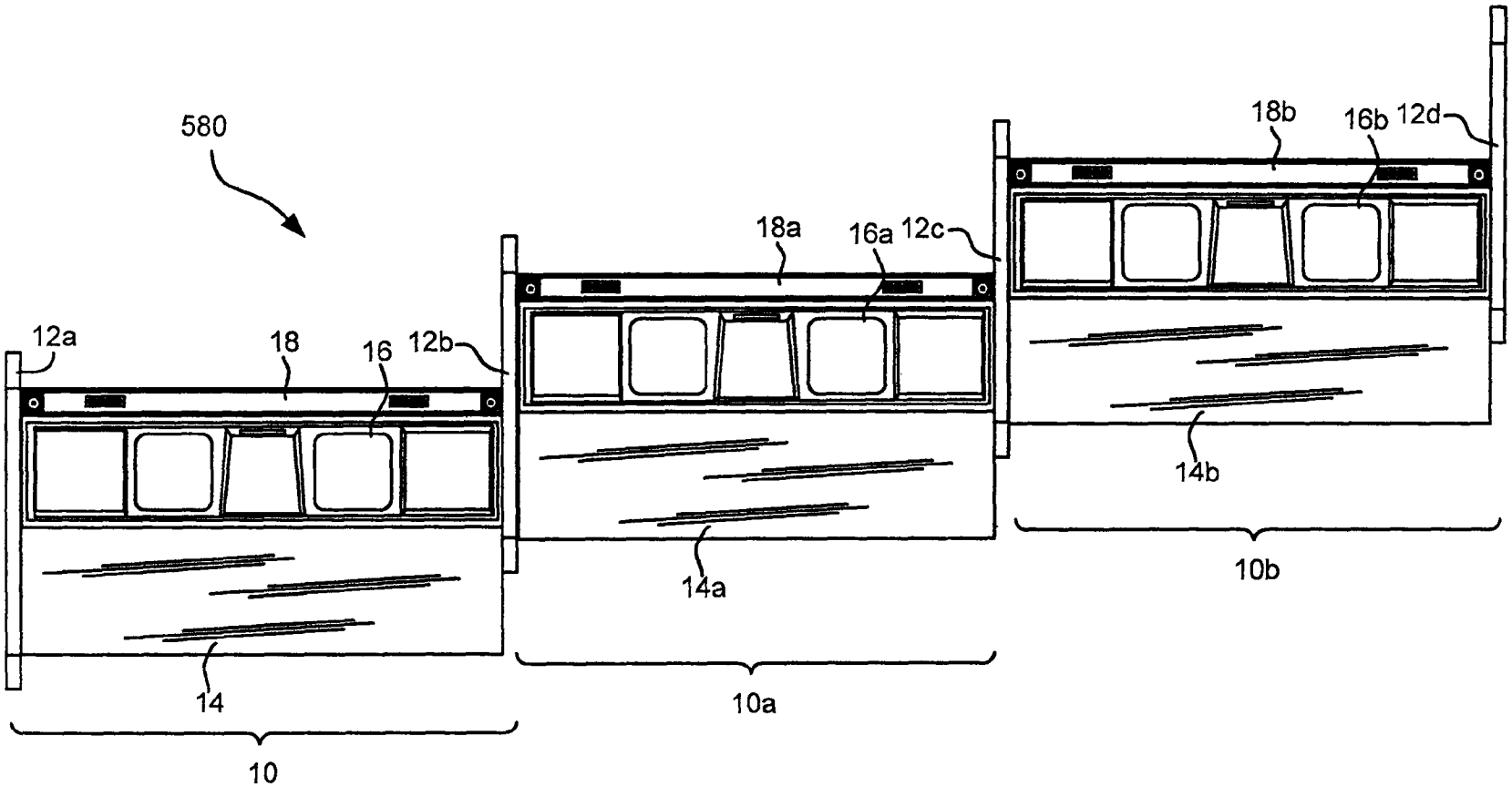
FIG. 61 shows a top plan view of three single person staggered work stations according to another embodiment of the present disclosure.

Referring still to FIG. 61, similarly, second channel assembly 18*a* is mounted at one end to a rear portion of second leg assembly 12*b* and centrally to third leg assembly 12*c* so that second table top assembly 14*a* is positioned to one side of leg assembly 12*b* and is cantilevered generally in front of third leg assembly 12*c*. Channel assembly 18*b* is mounted at one end to a rear portion of third leg assembly 12*c* and centrally to fourth leg assembly 12*d* in a fashion similar to that described above with respect to channel assemblies 18 and 18*a*.

Referring still to FIG. 61, the end result of attaching the components described above in the fashion described above is that the three work stations are staggered one from the other. In this configuration 580, channel assemblies 18, 18*a* and 18*b* are misaligned. Nevertheless, again, because each of the channel assemblies 18, 18*a* and 18*b* is open at its opposite ends and the channel assembly openings are open to the large leg assembly openings 38 (see again FIG. 1), power and data wires and cables can be routed from one channel assembly through the leg opening 38 to an adjacent one of the channel assemblies.

Figure 62:
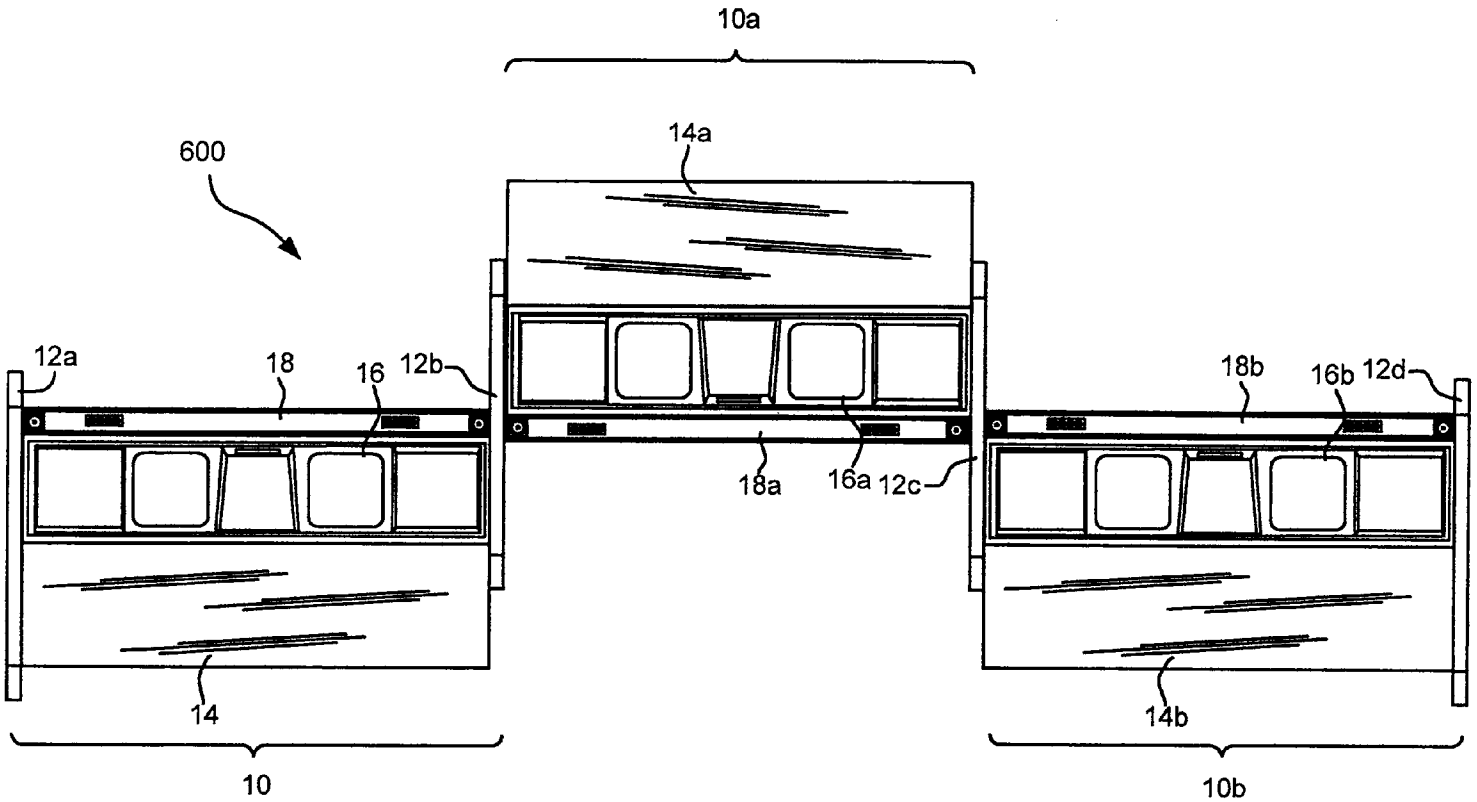
FIG. 62 shown a top plan view of three single person work stations in another staggered configuration.

Referring now to FIG. 62, one additional exemplary configuration 600 is illustrated that includes components for configuring three separate work stations. Here, adjacent work stations are staggered but face in opposite directions. To this end, exemplary configuration 600 includes one work station having all of the components described above with respect to configuration 10 shown in FIG. 1 as well as second and third work station subassemblies 10*a* and 10*b*. Subassembly 10*a* includes a third leg assembly 12*c*, a second channel assembly 18*a*, a second trough member 16*a* and a second table top assembly 14*a* while subassembly 10*b* includes a fourth leg assembly 12*d*, a third channel assembly 18*b*, a third trough member 16*b* and a third table top assembly 14*b*.

Referring still to FIG. 62, first channel assembly 18 is mounted at one end to a rear portion of first leg assembly 12*a* and centrally to second leg assembly 12*b* with first trough member 16 and first table top assembly 14 mounted to a forward side of channel assembly 18. Second channel assembly 18*a* is centrally mounted to each of second leg assembly 12*b* and third leg assembly 12*c* with second trough member 16*a* and second table top assembly 14*a* mounted to a rearward side of assembly 18*a*. Third channel assembly 18*b* is centrally mounted to third leg assembly 12*c* and to a rear portion of fourth leg assembly 12*d* with third trough member 16*b* and third table top assembly 14*b* supported to a front side of channel assembly 18*b*. Thus, as shown, all of the channel assemblies 18, 18*a*, and 18*b* are aligned with the first and third work stations corresponding to table top assemblies 14 and 14*b* located to the front side of the channel assemblies and the second or middle work station corresponding to table top assembly 14*a* located rearward of the channel assemblies.

Figure 63:
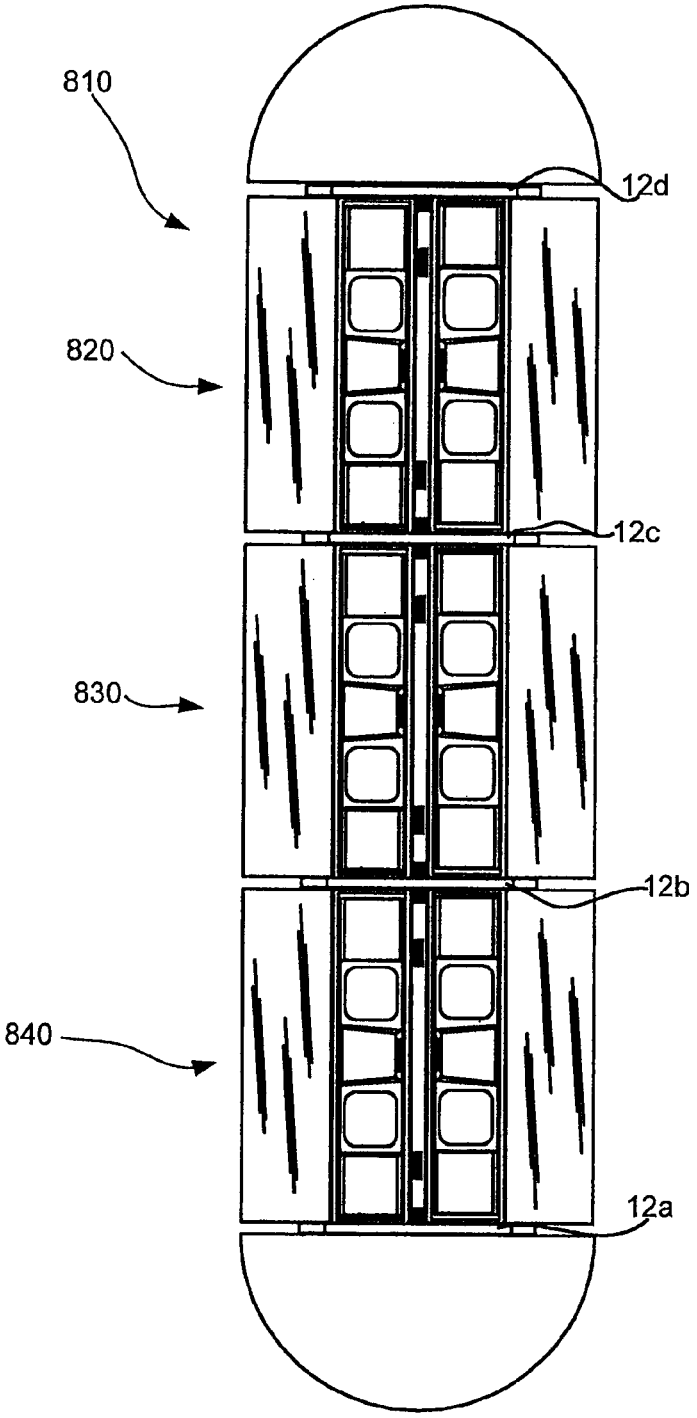
FIG. 63 is a top plan view of a six station configuration consistent with at least some aspects of the present invention.

One additional configuration 810 is shown in FIG. 63 that includes components to configure three pairs of face-to-face workstations 820, 830, 840 and two half-round end tables 850 and 860 supported by four leg assemblies 12*a*, 12*b*, 12*c* and 12*d* where all of the top surfaces of the table tops, end tables, leg members and channel assemblies are at the same height.

In at least some applications, it has been recognized that when a configuration has been designed to provide two facing work surfaces as in, for instance, FIG. 33, persons using the two different sides of the configuration may prefer to have a barrier between the two sides to afford greater privacy to each of the two configuration users. To this end, one exemplary dividing screen configuration is shown in FIGS. 64-69. The screen assembly 900 is shown in an operating position in FIG. 64 mounted to an exemplary two person workstation configuration 910. Consistent with the configurations described above, configuration 910 includes a channel assembly 18 mounted between a wide depth table assembly 382 on one side and a trough member 16 and narrow depth table assembly 14 on the opposite side. Channel assembly 18 is mounted on opposite ends and extends between first and second leg assemblies 12*a* and 12*b*. Referring specifically to FIG. 65, consistent with the configurations described above, exemplary channel assembly 18 forms, among other things, an upper channel or cavity 126 and a top surface 141 that extends along the length of channel assembly 18 where upper channel 126 forms an upward opening 925 to allow access with top surface 141 extending on either side of the opening 925 into channel 126. Top opening 925 forms a channel opening dimension C1 as shown in FIG. 65.

Figure 64:
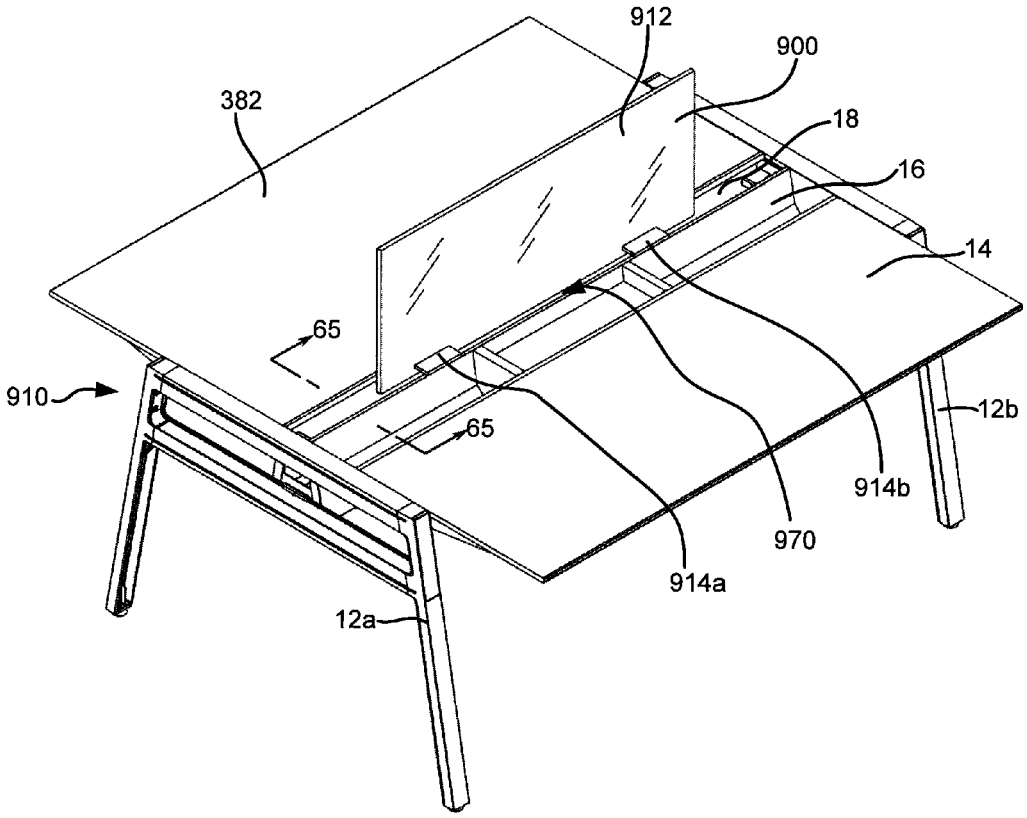
FIG. 64 is a perspective view of a table/desk assembly including an installed privacy screen assembly consistent with at least some aspects of the present invention.
Figure 65:
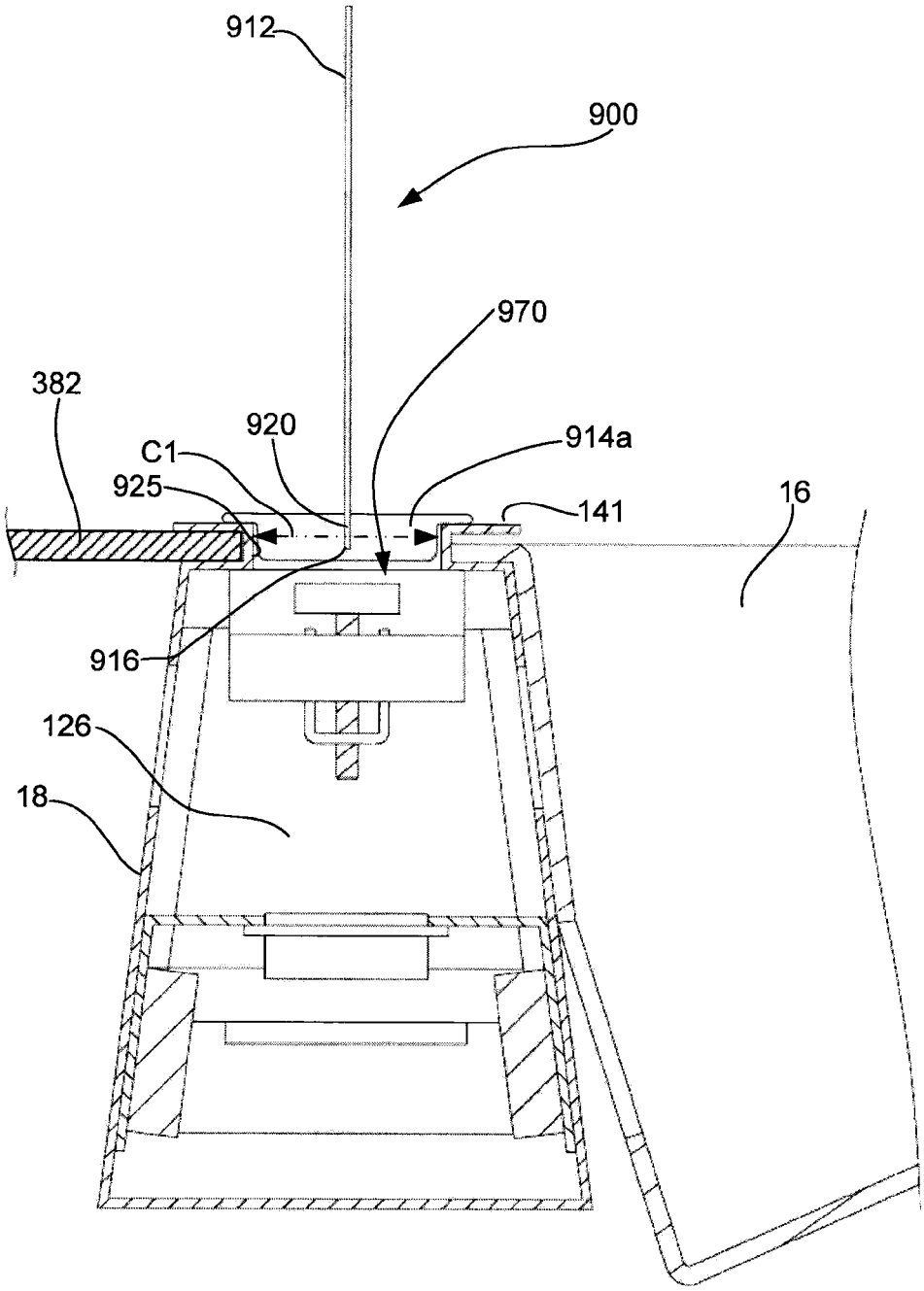
FIG. 65 is a partial cross-sectional view taken along the line 65-65 in FIG. 64 showing the screen assembly in an installed position.

Referring still to FIGS. 64 and 65, and also to FIGS. 66-69, screen assembly 900 includes a screen member 912 and first and second screen support blocks 914*a* and 914*b*, respectively. Screen member 912, in the exemplary embodiment, is a rigid rectilinear member having a height dimension which is less than the length dimension and wherein the length dimension is less than the length dimension of channel assembly 18. For example, where the channel assembly 18 is approximately 4 feet long, the length dimension of screen member 912 may be anywhere between 1½ and 3 feet long while the height dimension may be anywhere between 1 foot and 2 feet. In other embodiments, other height and length dimensions are contemplated such as, for instance, where screen 912 may have a length substantially similar to the length of channel assembly 18. In some embodiments, member 912 may be formed of a single piece of sheet metal of sufficient gauge so that the member 912, while slightly flexible is substantially unbendable so that it maintains its flat shape.

Referring to FIGS. 64-68, each of the screen support blocks 914*a* and 914*b* is similarly constructed and operates in a similar fashion, and therefore, in the interests of simplifying this explanation, only block 914*a* will be described here in detail. Block 914*a* is an integral component formed of molded plastic, aluminum, or some other rigid material and includes a body member 922 including parallel front and rear surfaces 936 and 938, respectively, and parallel first and second lateral surfaces 940 and 942, respectively, that together form a substantially square or rectilinear shape that in turn defines a top surface 930. The lateral side surfaces 940 and 942 define a block width dimension B1 (see FIG. 68) which is slightly smaller than the channel opening dimension C1 (see again FIG. 65). Flanges 924*a*, 924*b* extend laterally from surfaces 940 and 942 having top surfaces that are flush with the top surface 930 of block 922 and under surfaces 950*a* and 950*b*.

Figure 66:
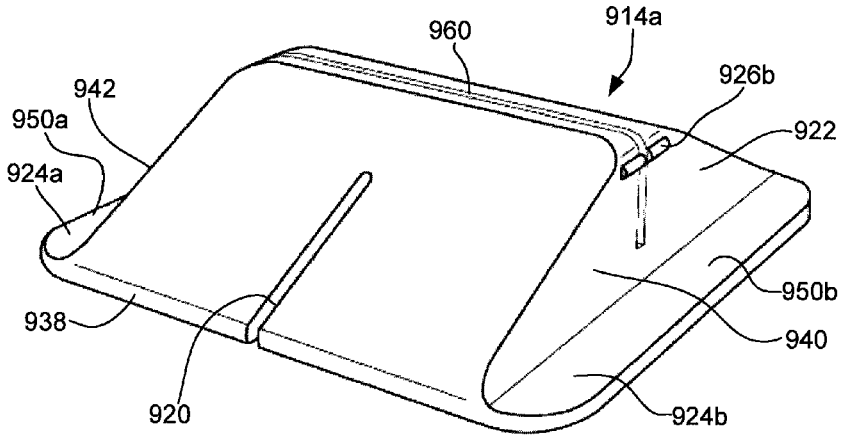
FIG. 66 is a perspective view of one of the screen support blocks shown in FIG. 64.
Figure 67:
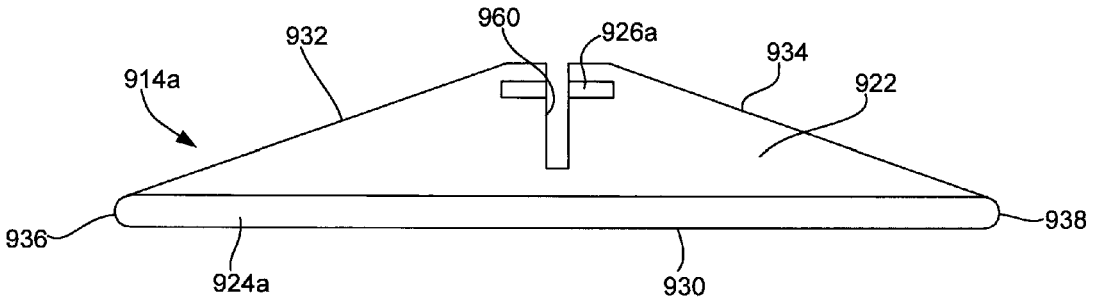
FIG. 67 is a side view of the screen support block shown in FIG. 66.
Figure 68:
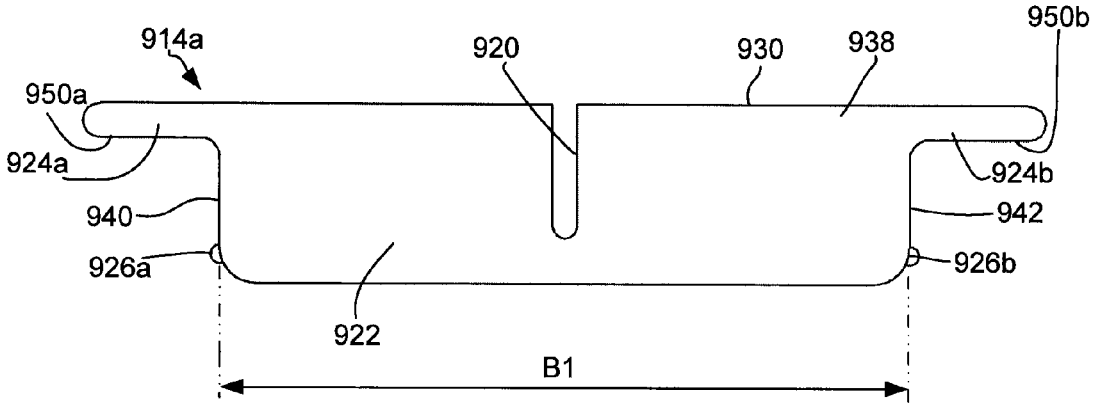
FIG. 68 is a front view of the screen support block shown in FIG. 66.

Referring still to FIGS. 65-69, an under surface of block 914*a* opposite top surface 930 forms two ramps 932 and 934. Ramp 932 extends from front surface 936 toward a central portion of body member 922 such that the body member is thicker near the central portion than adjacent front surface 936. Similarly, ramp 934 extends from rear edge 938 towards the central portion of body member 922 so that body member 922 is thicker near the central portion than adjacent rear surface 938 (ie the bottom surfaces 932 and 934 form an apex centrally). Referring to FIG. 68, midway between lateral surfaces 940 and 942, a top surface slot 920 is formed in top surface 930 that extends approximately two-thirds of the way through body member 922. The slot 920 is parallel to lateral surfaces 940 and 942. Slot 920 has a width dimension (not labeled) that is substantially similar to a width dimension of screen member 912.

Referring again to FIGS. 66 and 67, midway between front and rear surface 936 and 938, body member 922 forms a bottom slot 960 that extends through the under surface 932/934 of body member 922 about two-thirds of the way toward top surface 930 where the bottom slot 960 is substantially parallel to each of the front and rear surfaces 936 and 938. Slot 960, like slot 920, has a width dimension (not labeled) that is substantially similar to the width dimension of screen member 912.

Referring yet again to FIGS. 66-68, small ribs 926*a* and 926*b* are provided near the lower ends of lateral surfaces 940 and 942. Ribs 926*a* and 926*b* are, in at least some embodiments, at least somewhat resiliently deformable (e.g. made of plastic) and facilitate a relatively tight friction fit when support block 914*a* is received within the top channel opening as shown in FIG. 65.

Referring now to FIGS. 65 and 66, in operation, blocks 914*a* and 914*b* may be positioned within channel opening 925 in a simple and tool-less fashion for in turn supporting screen member 912 between facing workspaces formed by configuration 900. More specifically, as shown best in FIG. 65, exemplary block 914*a* may be positioned above channel 126 with first slot 920 facing upward and aligned parallel to the length of channel assembly 18 and may be lowered toward upper channel 126 until the lower surfaces 950*a* and 950*b* of flanges 924*a* and 924*b* contact the top surfaces 141 of assembly 18. At this point, lateral surfaces 940 and 942 should contact the facing surfaces of channel assembly 18 that form opening 925 with ribs 926*a* and 926*b* contacting the facing surfaces to prohibit or at least substantially limit side-to-side movement of block 914*a* within opening 925. Similarly, block 914*b* may be positioned within the top opening of channel assembly 18 so as to be spaced apart (see FIG. 64) from block 914*a*. Next, screen member 912 is placed above the first slots 920 formed by support blocks 914*a* and 914*b* and is lowered until the bottom edge 916 thereof (see FIG. 65) is received within slots 920.

At this point, referring to FIG. 64, it should be appreciated that screen member 912 is positioned between the two facing workspaces formed by configuration 910 and greater privacy is afforded to users of the two workspaces. In addition, it should be appreciated that after installation of screen assembly 900, access into the upper channel 126 can still be had between the screen member 912 and the top surfaces 141 of channel assembly 18 from either side as shown at 970 in FIGS. 64 and 65. Unless obstructed by other components, blocks 914*a* and 914*b* and the associated screen member 912 can be slid along channel assembly 18 or removed and installed at different locations along the length of channel assembly 18 to accommodate user preferences. In addition, while only one screen assembly 900 is shown in FIG. 64, it should be appreciated that two or more screen assemblies 900 may be supported by a single channel assembly 18, depending upon user preferences.

Figure 69:
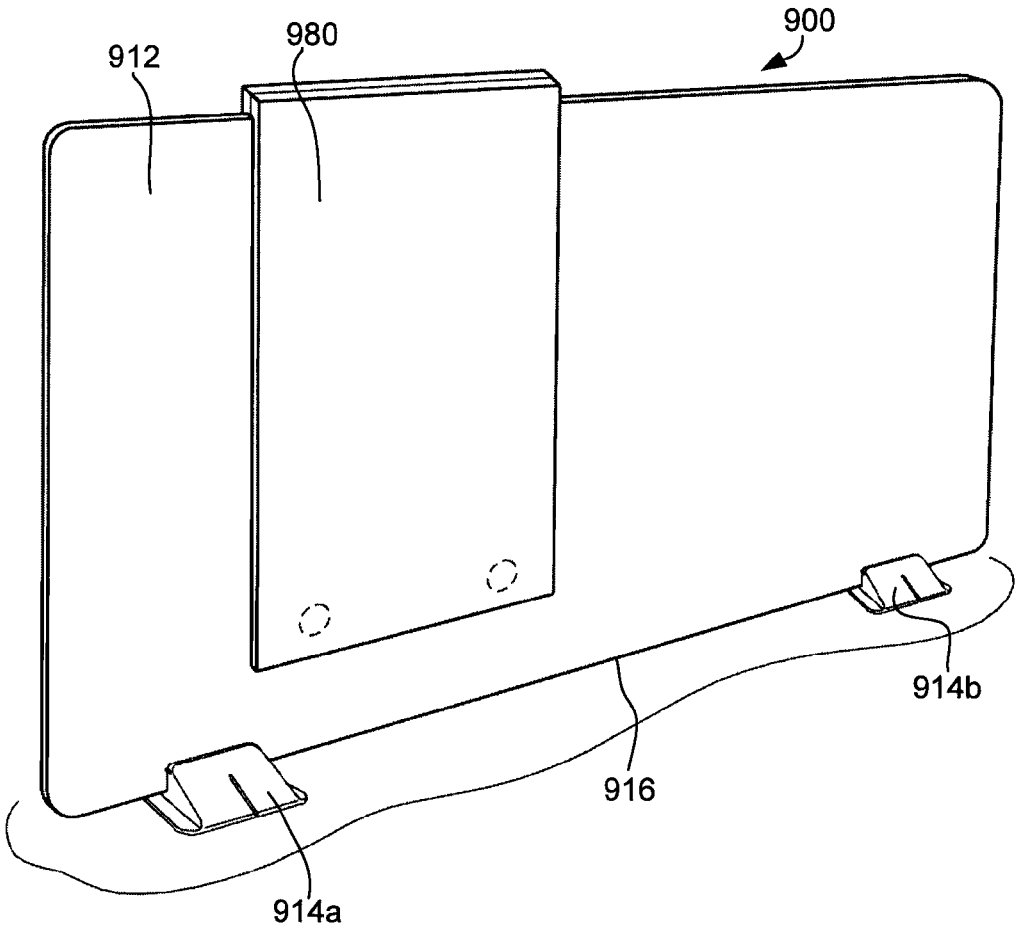
FIG. 69 is a perspective view showing the privacy screen assembly of FIG. 64 in a second supporting position, albeit separate from the table/desk assembly shown in FIG. 64.

Referring now to FIGS. 66, 67, and 69, in addition to being used with configuration 910, the screen assembly 900 may also be used independently to provide screen member 912 above any horizontal support surface. In this regard, the support blocks 914*a* and 914*b* may be positioned with top surface 930 facing downward and contacting a horizontal support surface with the ramped bottom surfaces 932 and 934 facing upward so that second slots 960 open upward as shown best in FIG. 67. Here, blocks 914*a* and 914*b* may be positioned such that second slots 960 are aligned and spaced apart and screen member 912 may then be positioned as shown in FIG. 69 with lower edge 916 received within slots 960 so that member 912 is supported in a vertical orientation.

Figure 70:
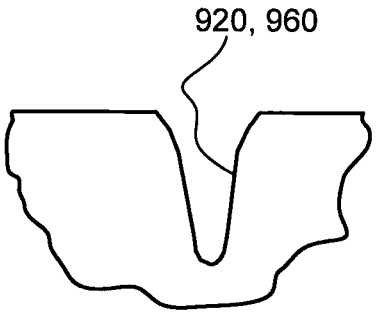
FIG. 70 is a side view of a different screen supporting block that has a different slot shape.
Figure 71:
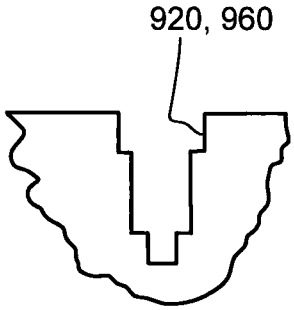
FIG. 71 is similar to FIG. 70, albeit having a different slot shape.

Ref to FIG. 70, in at least some embodiments one or both of the slots 920 and 960 may have wedge shapes and be resiliently formed to accommodate screens 912 that have different thicknesses. Alternatively, the slots 920, 960 may be stepped as in FIG. 71 to accommodate different screen thicknesses.

Figure 72:
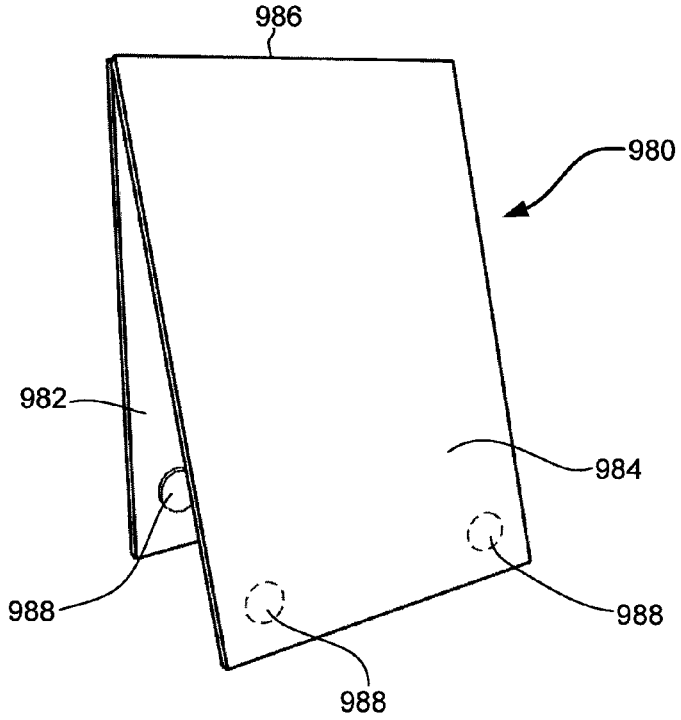
FIG. 72 is a perspective view of the accessory shown in FIG. 69.

In at least some embodiments additional accessories may be provided which can be supported by screen member 912. To this end, because member 912, in at least some embodiments, is formed of steel sheet metal, magnets, magnetic white board sheets, etc., may be attached thereto. In FIG. 72, an exemplary tack board accessory 980 is illustrated. Tack board accessory 980 includes first and second rigid rectilinear members 982 and 984, respectively, that are hinged by a hinge 986 along a top edge thereof. Each of the members 982 and 984 may include a tack surface type material on a front surface thereof and internal magnets 988. Here, accessory 980 may be attached to screen member 912 as shown in FIG. 69 by separating members 982 and 984, placing accessory 980 in a straddling fashion on the top edge of screen member 912 with members 982 and 984 on opposite sides of member 912 and then allowing the internal magnets 988 to effectively attach accessory 980 to screen 912. In at least some embodiments, the magnets are strong enough that accessory 980 may also be attached along either of the lateral edges of member 912 or even along the bottom edge 916. While members 982 and 984 may form tack surfaces, at least some embodiments' other accessories similar to accessory 980 may include white board surfaces or other types of external surfaces as desired by configuration users.

Thus, the invention is to cover all modifications, equivalents, and alternatives falling within the spirit and scope of the invention as defined by the following appended claims.

To apprise the public of the scope of this invention, the following claims are made:

What is claimed is:

1. A table assembly comprising:

at least a first leg member having front and rear ends, the leg member further forming a leg opening that opens to a first side of the leg member and a first support surface; and a rigid elongated channel member that forms a channel that extends between first and second ends, at least the first end forming a wire passing opening suitable to pass wires into and out of the channel, the first end supportable by the first support surface with the channel member in at least first and second different locations proximate the rear end of the first leg member and proximate a central portion of the leg member substantially midway between the front end and the rear end, respectively, with the channel member on the first side of the leg member;

wherein, when the first end is supported by the first support surface with the channel member at either of the first and second different locations, the wire passing opening is aligned with the leg opening so that wires can pass through the leg opening and into the channel.

2. The assembly of claim 1 further including a second leg member having front and rear ends and forming a a second leg opening, the second leg member further forming a second support surface and wherein the second end of the rigid elongated channel member forms a second wire passing opening suitable to pass wires into and out of the channel, the second end supportable by the second support surface with the channel member in at least first and second different locations proximate the rear end of the second leg member and proximate a central portion of the second leg member substantially midway between the front end and the rear end, respectively, wherein, when the second end is supported by the second support surface with the channel member at either of the first and second different locations, the second wire passing opening is aligned with the second leg opening so that wires can pass through the second leg opening and into the channel.

3. The assembly of claim 2 further including at least a first table top member supported by and extending between the first and second leg members on a first side of the channel member.

4. The assembly of claim 3 further including at least a second table top member supported by and extending between the first and second leg members on a second side of the channel member when the channel member is supported by the leg members in the second locations.

5. The assembly of claim 1 wherein the channel member and channel are a first channel member and a first channel, respectively, the assembly further including at least a second rigid elongated channel member that forms a second channel that extends between first and second ends, at least the first end of the second channel member forming a second wire passing opening suitable to pass wires into and out of the second channel, the first end of the second channel member supportable by the first support surface in at least first and second different locations wherein the second channel is aligned with the first channel when the first and second channels are aligned at the first locations and the second channel is aligned with the first channel when the first and second channels are aligned at the second locations.

6. The assembly of claim 5 wherein, when the first and second channel members are supported by the leg member at the first and second locations, respectively, the first and second channels are misaligned and each opens into the leg opening.

7. The assembly of claim 1 wherein the channel member is supported by the support surface for sliding movement between the first and second locations.

8. The assembly of claim 1 wherein the support surface forms a leg lip and the channel member includes a channel lip that mates with the leg lip to attach the first end of the channel member to the first leg member.

9. The assembly of claim 1 wherein the channel member further includes a coupler pair located at the first end of the channel member, the coupler pair including a stationary finger located on one side of the wire passing opening and a moveable finger located on an opposite side of the wire passing opening and a mechanical activator for moving the moveable finger toward and away from the stationary finger, the leg member forming first and second spaced apart coupling members wherein the stationary finger engages the first coupling member and the mechanical activator is adjusted to move the moveable finger into engagement with the second coupling member to secure the channel member to the leg member in either of the first and second locations.

10. The assembly of claim 9 wherein the leg member includes first and second spaced apart rails that form the first and second coupling members.

11. The assembly of claim 10 wherein the first and second coupling members include first and second lip members that extend toward each other and wherein the stationary finger and the moveable finger include finger extensions that extend generally in opposite directions, the fingers engaging the lip members.

12. The assembly of claim 9 wherein the mechanical activator is located within the channel when the moveable finger is moved away from the stationary finger.

13. The assembly of claim 9 wherein the moveable finger member forms a threaded aperture and the mechanical activator includes a bolt that is threadably received in the aperture.

14. The assembly of claim 1 wherein the support surface is formed along a first edge of the wire management channel and wherein the table top includes a rear edge that is supported by the support surface so that the channel is located rearward of the table top.

15. The table assembly of claim 1 wherein the leg opening has a horizontal width dimension that is at least twice as large as a vertical height dimension of the wire passing opening.

16. The table assembly of claim 1 wherein the leg member has front and rear ends, the channel member aligned proximate the rear end of the leg member when in the first position and aligned proximate a central portion of the leg member substantially midway between the front end and the rear end of the leg member when in the second position.

17. The assembly of claim 1 wherein channel formed by the channel member opens upwardly.

18. A table assembly comprising:

first and second legs forming first and second substantially horizontal elongated surfaces, respectively;

a support rail forming a support surface and extending between first and second ends, the first and second ends of the rail supported by the first and second horizontal elongated surfaces, respectively, for sliding movement between first and second different locations along each of the first and second elongated surfaces, the support rail forming a wire management channel including a power receptacle in the wire management channel; and a table top supported by the support surface between the first and second legs and positionable with the support rail at different positions adjacent the legs.

19. The assembly of claim 18 wherein the support surface is formed along a first edge of the wire management channel and wherein the table top includes a rear edge that is supported by the support surface so that the channel is located rearward of the table top.

20. The assembly of claim 19 further including first and second couplers located at the first and second ends of the wire management channel for releasably securing the wire management channel at different positions along the first and second elongated surfaces.

21. The assembly of claim 18 wherein each of the first and second surfaces forms a leg lip and wherein the wire management channel includes a stationary finger member at each end that mates with the leg lips to support the wire management channel between the legs for sliding motion along the leg lips.

22. The assembly of claim 18 wherein each of the first elongated surfaces is an upper elongated surface and each leg member further includes a second lower elongated surface that is spaced vertically below and substantially parallel to the upper elongated surface.

23. The assembly of claim 22 wherein each upper elongated surface forms an upper leg lip, each second elongated surface forms a lower leg lip, the wire management channel including first and second couplers at first and second ends, respectively, each coupler includes a stationary finger member and a moveable finger member that engage the lower and upper leg lips on an adjacent leg member, respectively, to secure the channel member to the leg members.

24. The assembly of claim 23 wherein the upper and lower leg lips on the first leg extend toward each other and wherein the upper and lower leg lips on the second leg extend toward each other.

25. The assembly of claim 23 wherein the wire management channel forms first and second channel openings at the first and second ends and the first and second channel openings are aligned with the space between the upper and lower elongated surfaces of the first and second legs.

26. The assembly of claim 18 wherein the first and second legs include facing surfaces and wherein the rail and the table top are located between the facing surfaces of the first and second legs.

27. The assembly of claim 18 wherein the support surface is formed along a first side of the wire management channel and wherein the rail forms a second support surface along a second side of the wire management channel, the table top being a first table top, the assembly further including a second table top supported by the second support surface.

28. The assembly of claim 18 wherein the support rail has a length dimension between the first and second ends, the assembly further including first and second brackets secured to the first and second leg members, respectively, that support the table top between the legs.

29. The assembly of claim 28 wherein the first and second brackets extend in a direction substantially perpendicular to the length of the support rail.

30. A table assembly comprising:

a leg member having front and rear ends wherein a forward direction is from the rear toward the front of the leg member, the leg member further forming a substantially vertical side surface aligned along the forward direction;

an elongated support member extending between a connecting end and a distal end and including a connecting portion proximate the connecting end and a distal portion proximate the distal end, the support member forming a support surface, the connecting portion secured to the leg member with the connecting portion adjacent the vertical side surface and the distal portion extending away from the connecting portion in the forward direction, the distal portion extends from the connecting portion along a trajectory that forms an angle of less than sixty degrees with the vertical side surface; and a table top supported by the support surface.

31. The assembly of claim 30 wherein the leg member includes a front surface and wherein the distal end of the support member extends past the front surface of the leg member.

32. The assembly of claim 30 wherein the vertical side surface forms a slot and the connecting portion includes a lip that is receivable within the slot to secure the support member adjacent the vertical side surface.

33. The assembly of claim 32 wherein the lip member extends along substantially the entire length of the connecting portion and the connecting portion includes substantially half the bracket member.

34. The assembly of claim 32 wherein the leg member includes a substantially horizontal beam member that forms the slot and wherein the slot is formed along at least a portion of the length of the horizontal beam member.

35. The assembly of claim 34 wherein the elongated support member can be slid along the slot to be in different positions with respect to the leg member.

36. The assembly of claim 34 wherein the slot is formed along substantially the entire length of the beam member.

37. The assembly of claim 30 wherein the support member is secured to the leg member for sliding motion there along between at least first and second positions.

38. The assembly of claim 37 wherein the leg member includes a front surface and wherein the distal end of the support member extends past the front surface of the leg member when in the second position.

39. The assembly of claim 38 wherein the distal end of the support member is rearward of the front surface of the leg member when the support member is in the first position.

40. The assembly of claim 30 wherein the distal portion extends from the connecting portion along a trajectory that forms an angle of less than sixty degrees with the vertical side surface.

41. The assembly of claim 40 wherein the distal portion extends from the connecting portion along a trajectory that forms an angle between five degrees and twenty degrees with the vertical side surface.

42. The assembly of claim 30 wherein the distal portion is longer than the connecting portion.

43. The assembly of claim 30 wherein the leg member forms a top surface and wherein a top surface of the table top is substantially flush with the top surface of the leg member.

44. The assembly of claim 30 wherein the leg member and the support member are a first leg member and a first support member, respectively, the assembly further including a second leg member including a second vertical side surface and a second elongated support member extending between a connecting end and a distal end and including a connecting portion proximate the connecting end and a distal portion proximate the distal end, the second support member forming a second support surface, the connecting portion secured to the leg member with the connecting portion adjacent the vertical side surface of the second leg member and the distal portion extending away from the connecting portion in the forward direction where the table top member is also supported by the second support surface.

45. The assembly of claim 44 wherein the first and second support members are securable to the first and second leg members in at least first and second different positions along length dimensions of the vertical support surfaces.

46. The assembly of claim 45 wherein a frame space is formed between facing surfaces of the leg members and wherein, when the support members are in the first positions, the distal ends are within the frame space and when the support members are in the second positions, the distal ends are located forward of the frame space.

47. The assembly of claim 30 wherein the support surface is formed along a first edge of the wire management channel and wherein the table top includes a rear edge that is supported by the support surface so that the channel is located rearward of the table top.

48. A table assembly comprising:

first and second leg members that form first and second facing surfaces, respectively;

an elongated channel member extending between the first and second leg members and connected at opposite ends between the first and second facing surfaces, the channel member forming a wire management channel along a length dimension and forming at least a substantially horizontal channel support surface along at least a portion of the length dimension;

first and second support members mounted to and extending from the first and second facing surfaces, respectively, each support member forming a substantially horizontal support member support surface; and a table top assembly supported by the channel support surface and the support member support surfaces, wherein each leg member includes a top surface and wherein a top surface of the table top assembly is flush with the top surfaces of the leg members.

49. The assembly of claim 48 wherein the table top assembly includes a table top member having a rear edge and an undersurface wherein a portion of the undersurface adjacent the rear edge is supported by the channel support surface.

50. The assembly of claim 48 wherein the table top assembly includes a table top member and a trough member, the trough member extending between the facing surfaces of the leg members and including a rear edge that is supported by the channel support surface, the trough member forming a front edge that forms a trough support surface, the table top having a rear edge and an undersurface, a portion of the undersurface adjacent the rear edge supported by the trough support surface.

51. The assembly of claim 50 wherein the trough member and the table top member are both supported by the support member support surfaces.

52. The assembly of claim 48 wherein the channel member and the support members are mounted to the leg members for substantially horizontal sliding motion along the facing surfaces of the leg members.

53. The assembly of claim 52 wherein the leg members each have a front surface and wherein, in at least one position, distal ends of the bracket members extends past the front surfaces of the leg members.

54. A table assembly comprising:

first and second leg members that form first and second facing surfaces, respectively, a frame space located between the facing surfaces of the leg members, each leg member forming a leg member top surface;

an elongated channel member connected at opposite ends to the first and second facing surfaces and located within the frame space, the channel member forming a wire management channel along its length and a support surface along a first edge of the wire management channel;

a table top member forming a table top surface and supported by the leg members wherein the table top member is located entirely within the frame space and the table top surface is substantially flush with the leg member top surfaces, the table top member including a rear edge that is supported by the support surface so that the channel is located rearward of the table top and is at least in part at the same height as the rear edge of the table top.

55. A table assembly comprising:

a plurality of leg members, each leg member having first and second oppositely facing lateral side surfaces, the leg members spaced apart to define frame spaces between adjacent pairs of the leg members, the frame spaces including at least a first frame space, the leg members including at least a first leg member and a last leg member wherein each of the first and last leg members are only adjacent one other leg member; and pairs of table top members including at least a first table top member pair, each table top member pair including first and second table top members supported at least in part within one of the frame spaces and extending between facing side surfaces of the leg member pair that defines the frame space in which the table pair is supported, the first and second table top members in each pair forming first and second table top surfaces, respectively, where the first and second table top surfaces at the same height.

56. The assembly of claim 55 further including a first end table member supported by the first leg member on a side of the first leg member opposite the one leg member that is adjacent the first leg member, the first end table member forming a top surface that is at the same height as the first and second table top members.

57. The assembly of claim 56 wherein the first end table member forms a semicircular top surface.

58. The assembly of claim 56 further including a second end table member supported by the last leg member on a side of the last leg member opposite the one leg member that is adjacent the last leg member, the second end table member forming a top surface that is at the same height as the first and second table top members.

59. The assembly of claim 58 wherein each of the first and second end table members form a semicircular top surface.

60. The assembly of claim 55 wherein each of the leg members forms a top surface and wherein each of the top surfaces of the leg members are at the same height as the top surfaces of the first and second table top members.

61. The assembly of claim 55 further including at least a first trough member mounted in each frame space, each trough member mounted at opposite ends to the leg members that define the frame space in which the trough member is mounted, each trough member including a bottom wall member having a top surface located at a height below the height of the first and second table top members.

62. The assembly of claim 61 further including a separate channel member for each of the frame spaces, each channel member mounted at opposite ends to the leg members that define the frame space in which the channel member is mounted, each channel member forming a wire management channel along a length dimension where a top opening opens into the wire management channel.

63. The assembly of claim 55 wherein the assembly includes at least three leg members that define two frame spaces and at least two table top pairs wherein each pair is supported in a separate one of the frame spaces.

64. The assembly of claim 55 wherein the support surface is formed along a first edge of the wire management channel and wherein the table top includes a rear edge that is supported by the support surface so that the channel is located rearward of the table top.

* * * * *